US012012722B2

(12) United States Patent
Horii

(10) Patent No.: US 12,012,722 B2
(45) Date of Patent: Jun. 18, 2024

(54) WORKING MACHINE

(71) Applicant: KUBOTA CORPORATION, Osaka (JP)

(72) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 498 days.

(21) Appl. No.: 17/332,049

(22) Filed: May 27, 2021

(65) Prior Publication Data

US 2021/0285183 A1 Sep. 16, 2021

Related U.S. Application Data

(63) Continuation of application No. PCT/JP2019/047910, filed on Dec. 6, 2019.

(30) Foreign Application Priority Data

Dec. 25, 2018 (JP) ..... 2018-241465

(51) Int. Cl.
*E02F 9/20* (2006.01)
*E02F 3/38* (2006.01)
*E02F 9/16* (2006.01)

(52) U.S. Cl.
CPC ..... *E02F 9/2033* (2013.01); *E02F 3/384* (2013.01); *E02F 9/16* (2013.01); *E02F 9/2004* (2013.01)

(58) Field of Classification Search
CPC . E02F 3/384; E02F 3/386; E02F 3/388; E02F 9/2033; E02F 9/2004; E02F 9/264; E02F 3/432; E02F 3/433; E02F 3/435
See application file for complete search history.

(56) References Cited

U.S. PATENT DOCUMENTS 5,088,020 A * 2/1992 Nishida ..... E02F 9/2033 701/50
6,415,604 B1 7/2002 Motomura et al.
2015/0275471 A1* 10/2015 Matsumoto ..... E02F 3/432 701/50
2019/0161944 A1* 5/2019 Olsson ..... E02F 3/966
(Continued)

FOREIGN PATENT DOCUMENTS

JP 1-290829 A 11/1989
JP 2-140330 A 5/1990
(Continued)

*Primary Examiner* — Khoi H Tran
*Assistant Examiner* — Tanner L Cullen
(74) *Attorney, Agent, or Firm* — Birch, Stewart, Kolasch & Birch, LLP

(57) ABSTRACT

A working machine includes a machine body, a support bracket protruding forward from the machine body, a swing bracket pivotally supported by the support bracket to be capable of horizontally pivoting, a boom pivotally supported by the swing bracket to be capable of pivoting up and down, a swing sensor configured to detect a position of the swing bracket, and a controller configured to acquire a detection signal from the swing sensor and to control a swinging movement defined as a pivotal movement of the swing bracket. The controller includes a swinging stopper unit to stop the swinging movement when the swing bracket in the pivotal movement reaches a center position at which the boom is orientated in a forward direction of the machine body.

4 Claims, 65 Drawing Sheets

(56) References Cited

U.S. PATENT DOCUMENTS

| | | | | |
|---|---|---|---|---|
| 2021/0180291 | A1* | 6/2021 | Saiki | E02F 9/26 |
| 2021/0262196 | A1* | 8/2021 | Ito | E02F 3/32 |
| 2023/0257967 | A1* | 8/2023 | Okazaki | E02F 3/431<br>414/688 |

FOREIGN PATENT DOCUMENTS

| | | | | | |
|---|---|---|---|---|---|
| JP | 3-51434 | A | | 3/1991 | |
| JP | 8-144316 | A | | 6/1996 | |
| JP | 9-78632 | A | | 3/1997 | |
| JP | H0978632 | A | * | 3/1997 | E02F 3/43 |
| JP | 11-293709 | A | | 10/1999 | |
| JP | 4608088 | B2 | | 1/2011 | |
| KR | 20090071062 | A | * | 7/2009 | E02F 9/14 |
| WO | WO 2017/213580 | A1 | | 12/2017 | |

* cited by examiner

Enlarged view of Portion H5

WORKING MACHINE

CROSS REFERENCE TO RELATED APPLICATIONS

This application is a continuation application of International Application No. PCT/JP2019/047910, filed on Dec. 6, 2019, which claims the benefit of priority to Japanese Patent Application No. 2018/241465, filed on Dec. 25, 2018. The entire contents of each of these applications are hereby incorporated herein by reference.

BACKGROUND OF THE INVENTION

Field of the Invention

The present invention relates to a working machine such as a backhoe.

Description of the Related Art

A working machine disclosed in Japanese Patent Publication No. 4608088 is commonly known.

In the working machine disclosed in Japanese Patent Publication No. 4608088, a cabin is mounted on a machine body and a front support bracket is provided to protrude forward from the machine body. A swing bracket is pivotally supported by the support bracket swingably in a horizontal direction. A boom is pivotally supported by the swing bracket swingably in a vertical direction.

SUMMARY OF THE INVENTION

A working machine according to one aspect of the present invention includes a machine body, a support bracket protruding forward from the machine body, a swing bracket pivotally supported by the support bracket to be capable of horizontally pivoting, a boom pivotally supported by the swing bracket to be capable of pivoting up and down, a swing sensor to detect a position of the swing bracket, and a controller to acquire a detection signal from the swing sensor and to control a swinging movement defined as the pivotal movement of the swing bracket. The controller includes a swinging stopper unit configured to stop the swinging movement when the swing bracket in the pivotal movement reaches a center position at which the boom is orientated in a forward direction of the machine body.

The swinging stopper unit releases the stop of the swinging movement after passage of a predetermined time from the stop of the swinging movement.

The working machine includes a stopping release switch connected to the controller. The controller includes a stopping-function release unit configured so that, according to operation of the stopping release switch, the stopping-function release unit prevents the swinging stopper unit from stopping the swinging movement when the stopping release switch is operated.

The working machine includes an operator section including an operator seat and an operation device mounted on the machine body, and a detection sensor to detect a position of the boom with respect to the operator section. The controller includes a boom stopper unit configured to acquire a signal from the detection sensor and to stop the boom before reaching a position where the boom comes to interfere with the operator section.

The above and other elements, features, steps, characteristics and advantages of the present invention will become more apparent from the following detailed description of the preferred embodiments with reference to the attached drawings.

BRIEF DESCRIPTION OF THE DRAWINGS

A more complete appreciation of preferred embodiments of the present invention and many of the attendant advantages thereof will be readily obtained as the same becomes better understood by reference to the following detailed description when considered in connection with the accompanying drawings described below.

DETAILED DESCRIPTION OF THE PREFERRED EMBODIMENTS

Figure 1:
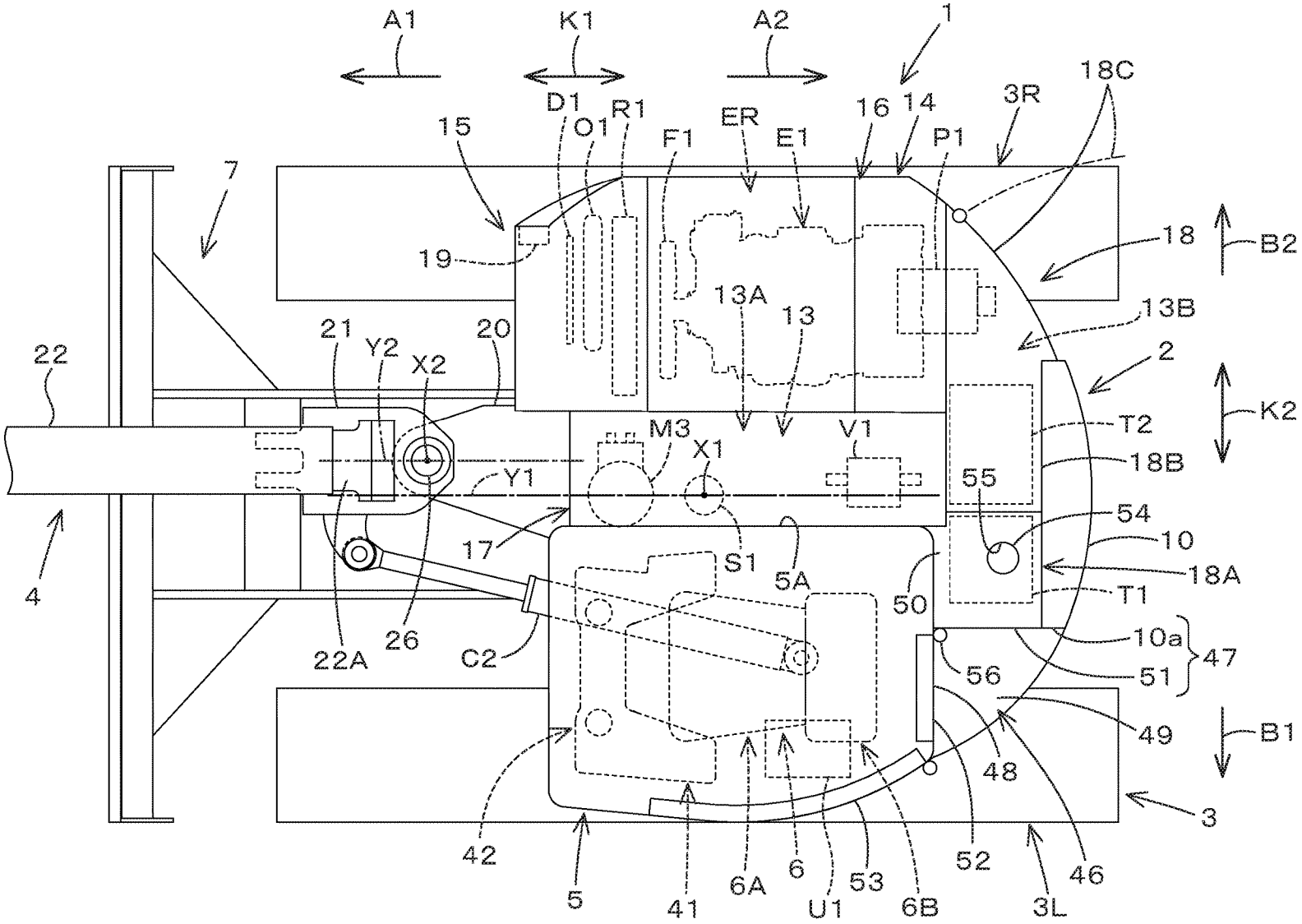
FIG. 1 is a schematic plan view of a working machine.

Preferred embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with appropriate reference to the drawings.

Figure 2:
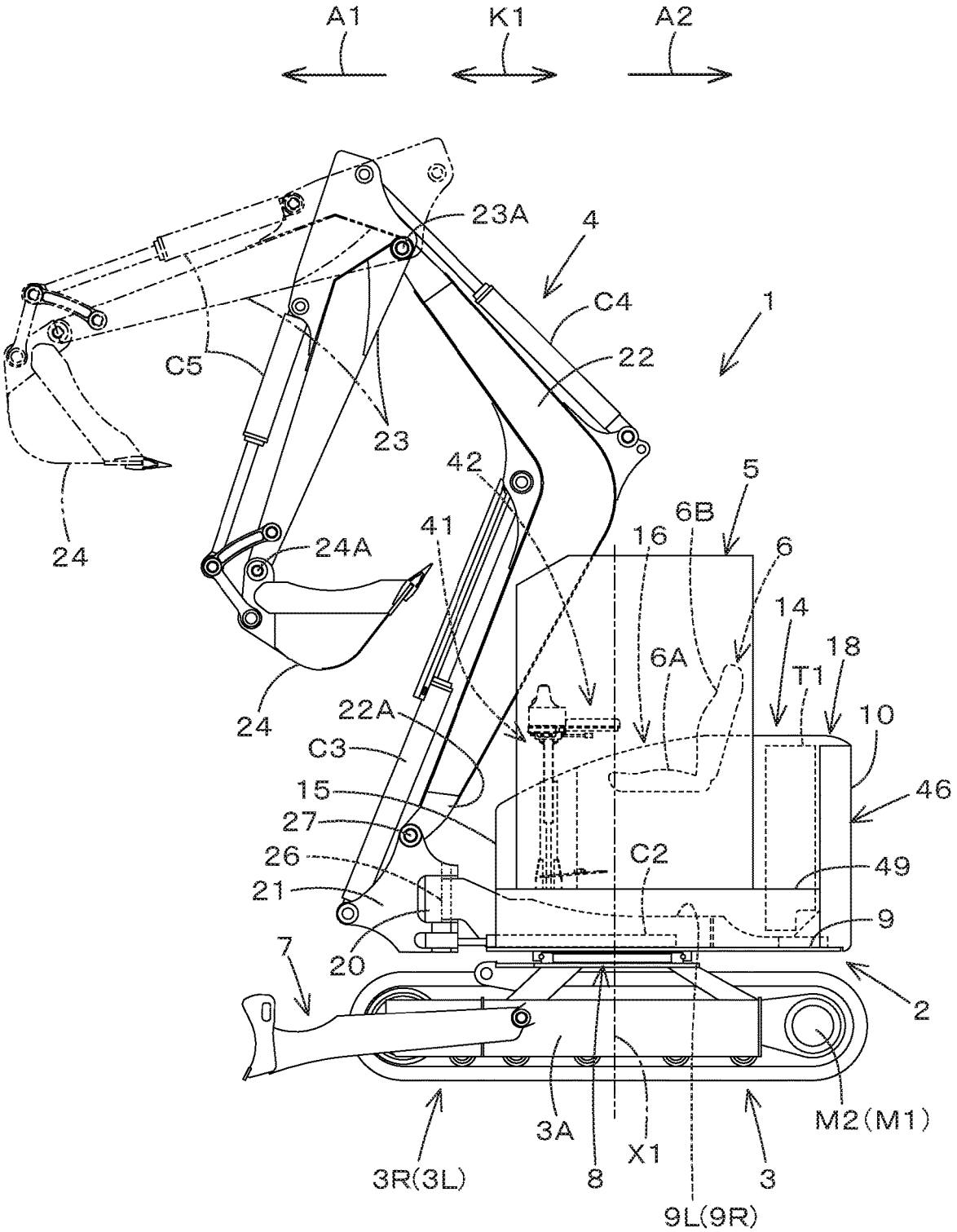
FIG. 2 is a schematic side view of the working machine.

FIG. 1 is a schematic plan view illustrating an overall configuration of a working machine 1. FIG. 2 is a schematic side view of the working machine 1. In this embodiment, a backhoe, which is a swiveling working machine, is exemplified as the working machine 1.

As shown in FIGS. 1 and 2, the working machine 1 is provided with a machine body (swivel base) 2, a traveling device 3, and a working device 4. A cabin 5 is mounted on the machine body 2. In a room of the cabin 5, a driver seat (seat) 6 on which an operator (driver) sits is provided. In other words, the driver seat 6 is mounted on the machine body 2, and the cabin 5 surrounds the driver seat 6. In addition, the cabin 5 is a driver seat protection device. A canopy may be the driver seat protection device. The driver seat 6 has a seat portion 6A on which the operator sits, and a backrest portion 6B that supports the back of the operator.

In the description of this embodiment, a front side of an operator seated on the driver seat 6 of the working machine 1 (a direction of an arrowed line A1 in FIGS. 1 and 2) is referred to as the front, the rear side of the operator (a direction of an arrowed line A2 in FIGS. 1 and 2) is referred to as the rear, a left side of the operator (a direction of an arrowed line B1 in FIG. 1) is referred to as the left, and a right side of the operator (a direction of an arrowed line B2 in FIG. 1) is referred to as the right.

As shown in FIG. 1, a horizontal direction, which is orthogonal to a fore-and-aft direction K1, is described as a machine width direction K2 (a width direction of the machine body 2). In the machine body 2, a direction extending from a center portion to a left portion and a direction extending from the center portion to a right portion are each referred to as a machine outward direction (an outward direction in the machine width direction). In other words, the machine outward direction corresponds to the machine width direction K2 and is a direction separating from the center of the machine body 2 in the with direction. A direction opposite to the machine outward direction is described as a machine inward direction (an inward direction in the machine width direction). In other words, the machine inward direction corresponds to the machine width direction K2 and is a direction approaching the center of the machine body 2.

As shown in FIGS. 1 and 2, the traveling device 3 supports the machine body 2 so that the machine body 2 with the traveling body 3 is configured travelable. The traveling device 3 includes a traveling frame 3A, a first traveling unit 3L installed on the left side of the traveling frame 3A, and a second traveling unit 3R installed on the right side of the traveling frame 3A. The first traveling unit 3L and the second traveling unit 3R are crawler-type traveling units. The first traveling unit 3L is driven by a first traveling motor M1. The second traveling unit 3R is driven by a second traveling motor M2. The first traveling motor M1 and the second traveling motor M2 are constituted of hydraulic motors (hydraulic actuators).

A dozer 7 is attached to a front portion of the traveling device 3. The dozer 7 is configured to extend and retract a dozer cylinder (hydraulic actuator) to perform the lifting and lowering (the lifting and lowering of a blade).

As shown in FIG. 2, the machine body 2 is supported on the traveling frame 3A such that the machine body 2 is capable of swiveling around a swivel axis X1 with a swivel bearing 8. The swivel axis X1 is an axis extending in the vertical direction through the center of the swivel bearing 8.

Figure 3:
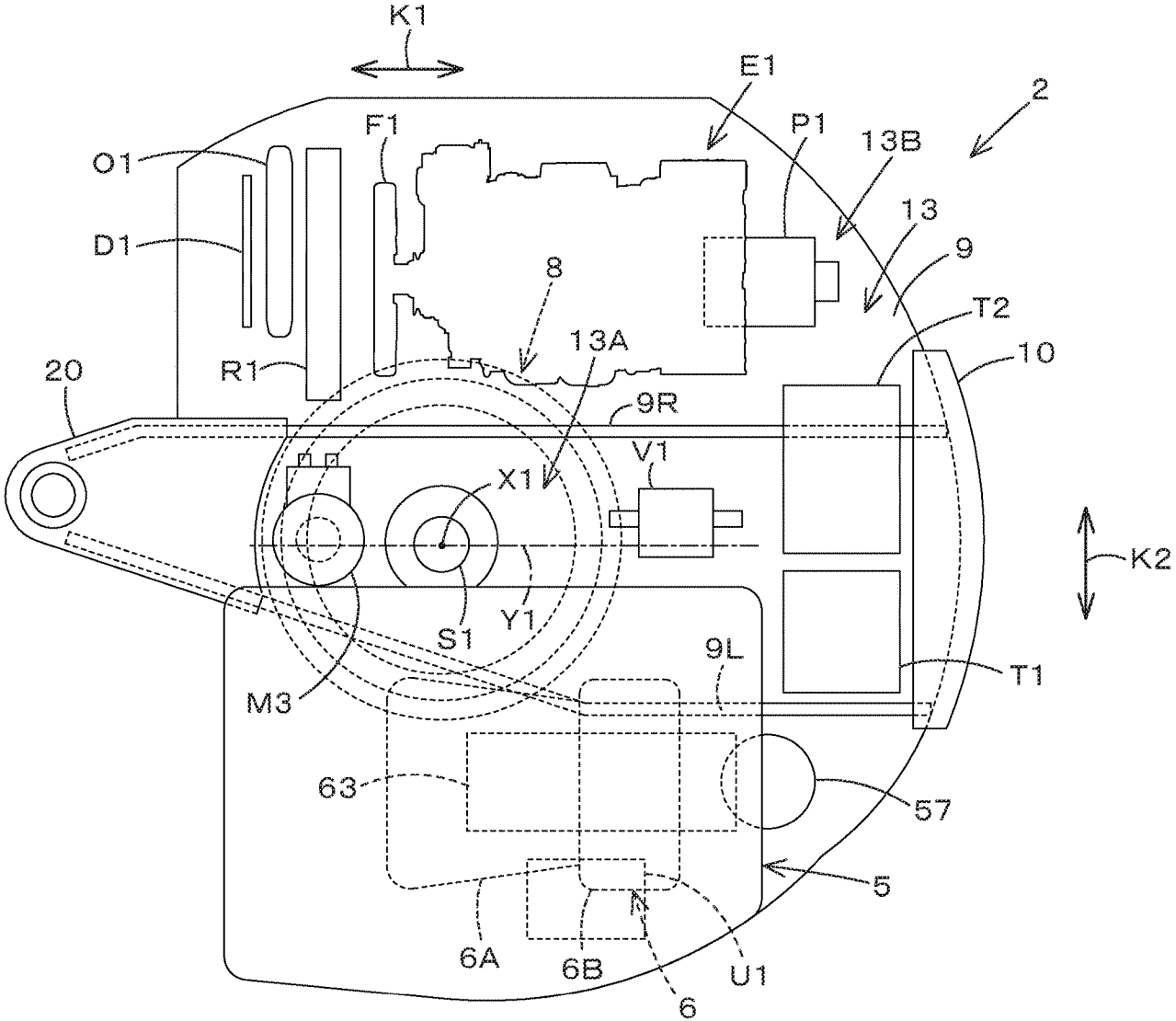
FIG. 3 is a plan view illustrating arrangement of devices and the like mounted on the working machine.

As shown in FIGS. 1 and 3, the cabin 5 is mounted on one side portion (left portion) of the machine body 2 in the width direction K2. The cabin 5 is located closer to one side portion (left portion) in the machine width direction K2 than on a center line Y1 crossing the swivel axis X1 and extending in the fore-and-aft direction K1. In addition, the cabin 5 is located near the front portion of the machine body 2.

As shown in FIGS. 1 and 3, a prime mover E1 is mounted on the other side portion (right portion) of the machine body 2 in the machine width direction K2. The prime mover E1 is mounted longitudinally on the machine body 2. The longitudinally-mounting of the prime mover E1 means arrangement of the prime mover E1 with its crankshaft axially extended in the fore-and-aft direction.

The prime mover E1 is located closer to the other side portion (right portion) in the machine width direction K2 than on the center line Y1. The prime mover E1 is a diesel engine. The prime mover E1 may be a gasoline engine, an LPG engine, or an electric motor, or may be a hybrid type including an engine and an electric motor.

A hydraulic pump P1 is installed at the rear portion of the prime mover E1. The hydraulic pump P1 is driven by the power of the prime mover E1 to pressurize and output a hydraulic fluid that is to be used in a hydraulic driving portion. The hydraulic driving portion is, for example, a hydraulic actuator provided on the working machine 1. In front of the prime mover E1, a radiator R1, an oil cooler O1, and a condenser D1 are arranged and mounted on the machine body 2. The radiator R1 is a cooling device that cools cooling water of the prime mover E1, and the oil cooler O1 is a cooling device that cools operation fluid. The condenser D1 is a cooling device (condenser) that cools refrigerant of an air conditioning system (air conditioner) provided on the working machine 1.

A cooling fan F1 is installed between the radiator R1 and the prime mover E1 to generate an cooling air for cooling the prime mover E1. The cooling fan F1 is driven by the power of the prime mover E1 to generate the cooling air flowing from the front to the rear.

As shown in FIGS. 2 and 3, the machine body 2 includes a base plate (hereinafter referred to as a swiveling base plate) 9 that swivels around the swivel axis X1. The swiveling base plate 9 is formed of a steel plate or the like, and defines the bottom portion of the machine body 2. The prime mover E1 is mounted on the swiveling base plate 9. Longitudinal ribs 9L and 9R, serving as reinforcing members, are provided on the central portion of the upper surface of the swiveling base plate 9 so as to extend between front and rear portions of the machine body 2. The longitudinal rib 9L is located closer to one side with respective to the center of the machine body 2 in the machine width direction K2, and the longitudinal rib 9R is located closer to the other side. The swiveling base plate 9 is provided thereon with at least one support member for supporting any equipment to be mounted on the machine body 2, so that the swiveling base plate 9 with the longitudinal ribs 9L and 9R, the at least one support member and the like provided thereon constitutes a swiveling frame which serves as a framework of the machine body 2. The swiveling cover 12 covers the periphery of the swiveling frame in the horizontal direction (see FIG. 4 and FIG. 5).

A weight 10 is provided at a rear portion of the machine body 2. The weight 10 is located on the rear portion of the machine body 2, and is attached at a lower portion thereof to the swiveling base plate 9. The weight 10 protrudes upward from the swiveling base plate 9. Furthermore, the weight 10 is located rearward from the cabin 5 and the driver seat 6.

Figure 4:
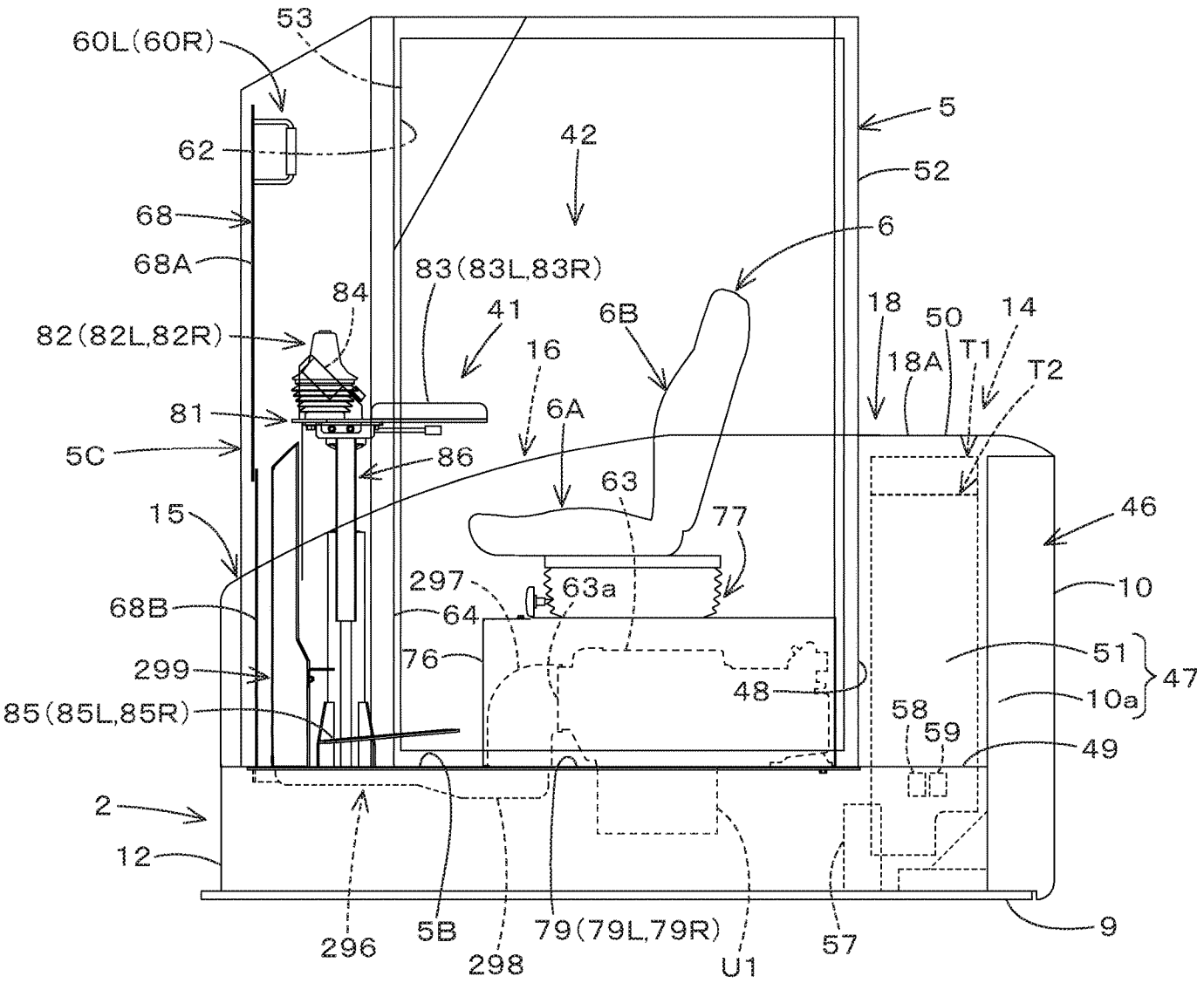
FIG. 4 is a side view of an upper portion of the working machine.
Figure 5:
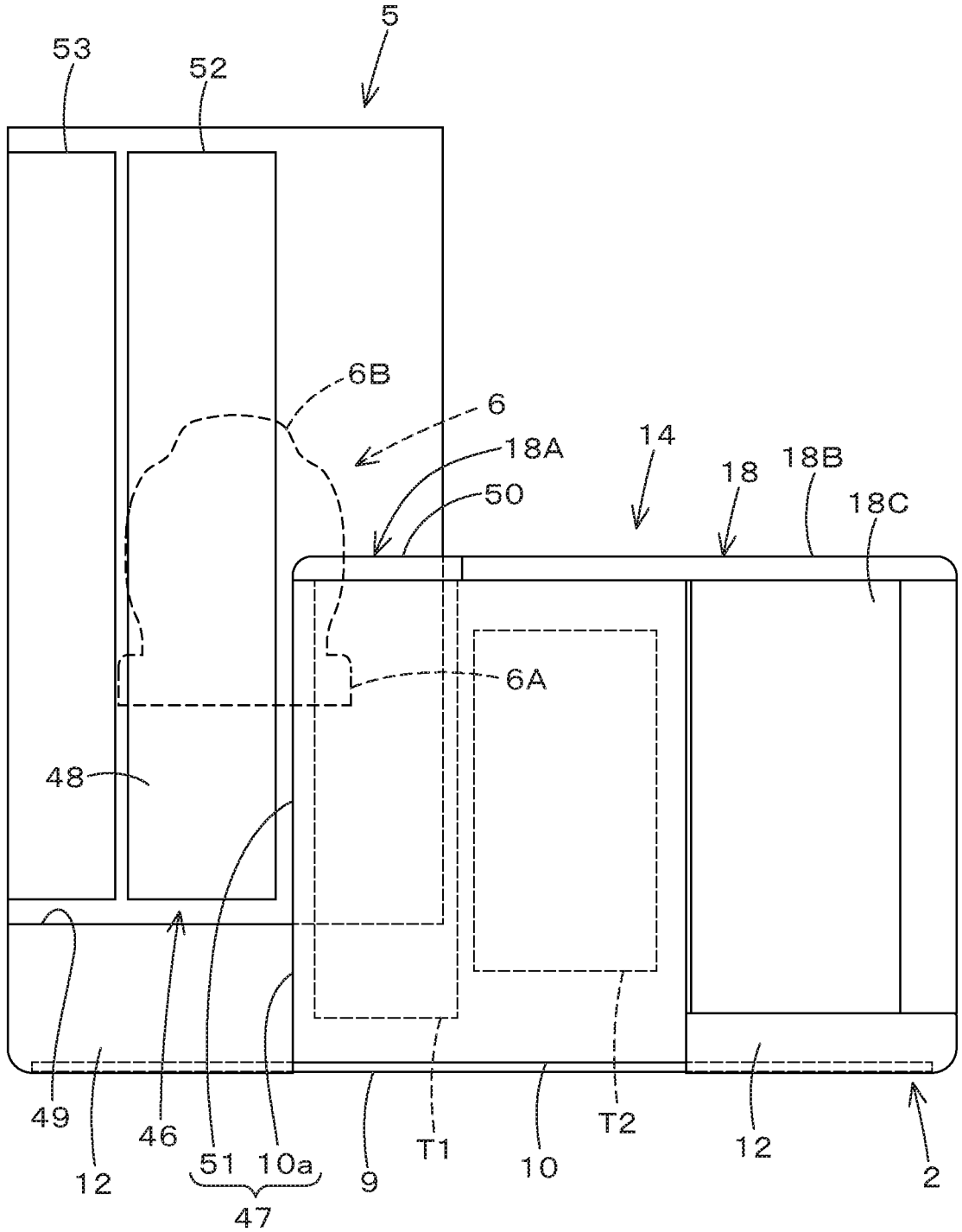
FIG. 5 is a back view of the upper portion of the working machine.

As shown in FIGS. 3, 4, and 5, the weight 10 is formed narrower than a width of a rear portion of the swiveling base plate 9 in the machine width direction K2 (substantially a half of width of the rear portion of the machine body 2), and is located on the central portion of the swiveling base plate 9 in the machine width direction K2. An upper end of the weight 10 is located at the height of a vertical intermediate portions of the cabin 5 and the driver seat 6. That is, the weight 10 is formed to extend upward from the swiveling base plate 9 to the height of the vertical intermediate portions of the cabin 5 and the driver seat 6. As shown in FIGS. 1 to 3, a fuel tank T1 and an operation fluid tank T2, arranged side by side in the machine width direction K2, are mounted on the rear portion of the machine body 2. The fuel tank T1 is a tank to store fuel for the prime mover E1. The operation fluid tank T2 is a tank to store an operation fluid. The fuel tank T1 and the operation fluid tank T2 are located between the weight 10 and an operator section 42. The operator section 42 includes the driver seat 6 and a manipulation unit 41 to be described later.

The weight 10 is located rearward from the fuel tank T1 and the operation fluid tank T2. The fuel tank T1 and the operation fluid tank T2 are arranged within a width of the weight 10 in the machine width direction K2 to face a front surface of the weight 10. The fuel tank T1 is positioned on one side (left side) with respect to the operation fluid tank T2 in the machine width direction K2, and the operation fluid tank T2 is positioned on the other side (right side) with respect to the fuel tank T1 in the machine width direction K2.

Figure 6:
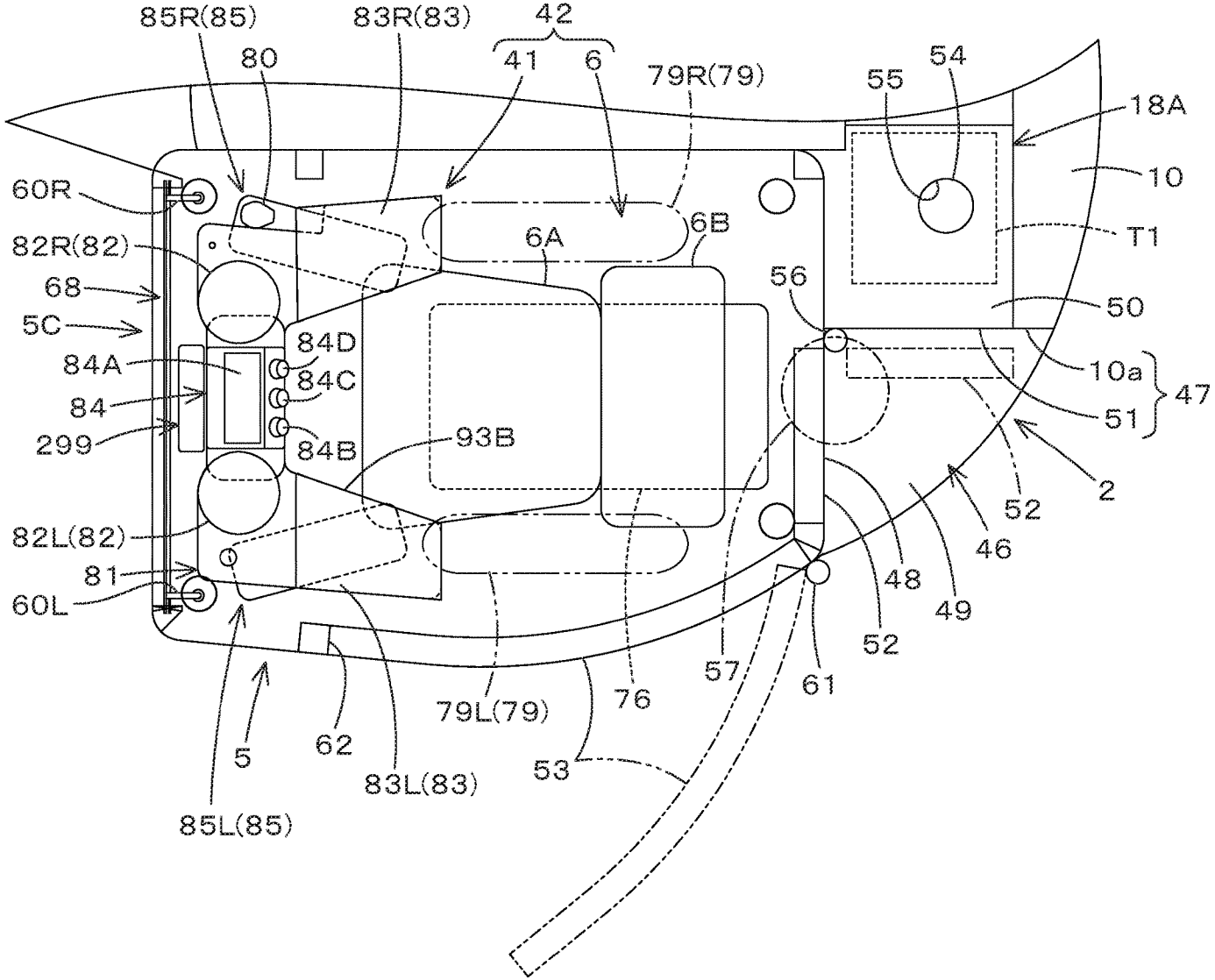
FIG. 6 is a plan view of a cabin.

As shown in FIGS. 4 to 6, a space 46 is provided rearward from the lower portion of the cabin 5. A space 46 is provided rearwardly outward in the machine width direction from the cabin 5. The space 46 is defined by a first face 47, a second face 48, and a step 49.

A side face of at least one rear-mounted member located behind the cabin 5 is defined as the first face 47. The side face of the rear-mounted member is located behind the lower portion of the cabin 5 and faces in the machine outward direction. In the embodiment, a first cover 18A and the weight 10 serve as the at least one rear-mounted member. The first cover 18A covers the fuel tank T1, and is located between the weight 10 and the operator section 42. The first cover 18A includes an upper wall portion 50 covering an upper side of the fuel tank T1 and a side wall portion 51 covering the left side of the fuel tank T1. A side face of the rear-mounted member, that is, the first face 47, is formed of a side surface of the first cover 18A (i.e., an outer side surface of the side wall portion 51) and a left side surface 10*a* of the weight 10. The first face 47 is located closer to the center of the machine body 2 in the width direction than the center of the cabin 5 in the machine width direction K2. The first face 47 is not limited to the configuration formed of the side surface of the first cover 18A and the side surface 10*a* of the weight 10, but may be formed of the side wall of the fuel tank (rear-mounted member) T1, for example.

A rear surface of the cabin 5 is defined as the second face 48.

The step 49 is provided at a lower end portion of the cabin 5, and defines the lower face of the space 46. That is, the space above the step (floor surface) 49 is the space 46. The step 49 is a member that defines the upper surface of the machine body 2 on which an operator steps. The fuel tank T1 is located in the vicinity of the step 49.

As described above, the space 46 is defined by the first face 47, the second face 48, and the step 49 so as to extend upward from the lower end portion of the cabin 5 and to be open upward. The space 46 is also open leftward (in the machine outward direction) and rearward.

As shown in FIG. 5, a rear window 52 is provided on the rear side face of the cabin 5, through which the rear of the cabin 5 can be viewed from the interior. This rear window 52 is provided at a left portion (a machine-outward side portion) of the rear face of the cabin 5 and in front of the space 46. The rear window 52 is formed to extend from the upper portion to the lower portion of the cabin 5. A width of the rear window 52 in the machine width direction K2 defines the width of the front face of the space 46 from one end to the other end in the machine width direction K2, and the lower portion of the rear window 52 corresponds to the space 46.

The rear window 52 is configured to be opened and closed. As shown in FIG. 6, the rear window 52 is supported at a right end side thereof with at least one hinge 56 that allows the rear window 52 to swing around a vertical axis (an axis extending in the vertical direction). This allows the rear window 52 to be opened toward the rear to enter the space 46, as shown by the virtual line in FIG. 6.

The step 49 is located on the side of the fuel tank T1. As shown in FIG. 6, the upper wall portion 50 of the first cover 18A is formed with an opening 55 above a fuel-filler opening of the fuel tank T1. The opening 55 is openably closed by a lid 54. In this manner, although the fuel tank T1 having the vertically-long shape is mounted to have the fuel-filler opening at the high position according to the embodiment, an operator stepping on the step 49 can easily fill the fuel tank T1 with fuel.

As shown in FIG. 4, a fueling device 57 is provided in the machine body 2 below the step 49 to fill the fuel to the fuel tank T1. The fueling device 57 includes a fueling pump, a suction hose, and a fueling hose, and is configured so that the fueling pump sucks fuel from a fuel container through the suction hose and delivers the sucked fuel to the fuel tank T1 through the fueling hose.

In addition, as shown in FIG. 4, a sedimenter 58 for removing water from fuel contaminated with the water, a fuel pump 59 for delivering fuel to the prime mover E1, and other devices are housed in the machine body 2 below the step 49.

The steps 49 can be opened and closed, and when the steps 49 is opened, the fueling device 57, the fuel pump 59, the sedimenter 58, and the like can be easily accessed.

As shown in FIG. 6, a door 53 is provided on a machine-outward side (a left side) face of the cabin 5. The door 53 is supported at a rear portion thereof rotatably around a vertical axis with at least one hinge 61, and is movable at a front portion thereof in the machine width direction K2 to selectively open or close an entrance 62.

As shown in FIG. 3, the swivel motor M3 is located at the front portion of the swiveling base plate 9 (machine body 2) that is the center portion of the swiveling base plate 9 in the machine width direction K2, and the swivel motor M3 drives and swivels the swiveling base plate 9 around a swivel axis X1. The swivel motor M3 is a hydraulic motor (hydraulic actuator, hydraulic device).

As shown in FIGS. 1 and 3, a swivel joint (hydraulic device) S1 defines the swivel axis X1. The swivel joint S1 serves as a hydraulic device and also serves as a rotating coupler (rotary joint) to make a fluidal communication between hydraulic devices on the machine body 2 and hydraulic devices on the traveling device 3. The swivel motor M3 is located in front of the swivel joint S1. A control valve (hydraulic device) V1 is located behind the swivel joint S1.

Figure 37:
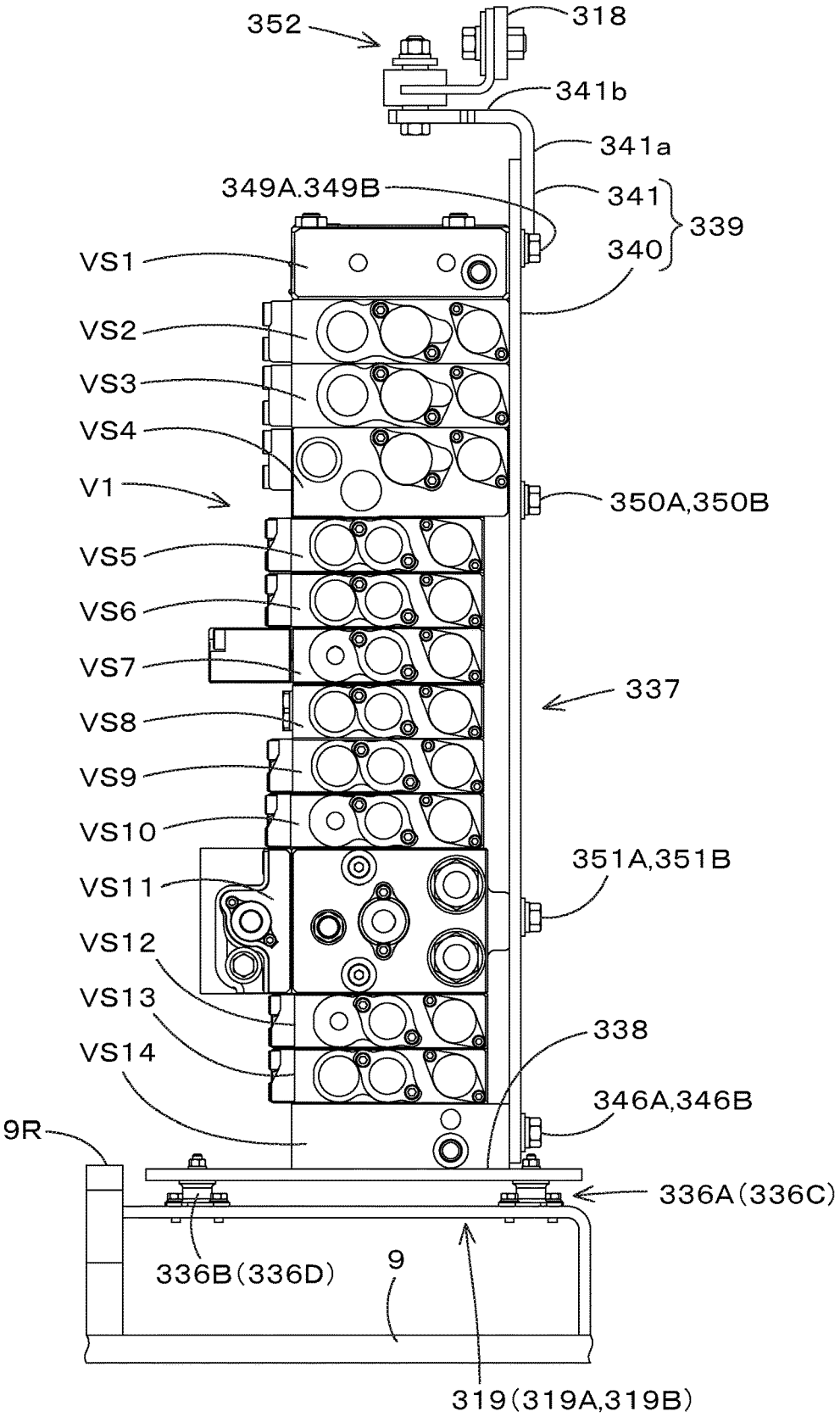
FIG. 37 is a front view illustrating the attachment condition of the control valve.

The control valve V1 is a composite control valve unit (hydraulic device) of a sectional type with a plurality of control valves (valves) coupled to and stacked on one another in the vertical direction (see FIG. 37).

The control valves constituting the control valve V1 are control valves configured to control hydraulic actuators such as hydraulic cylinders and hydraulic motors provided on the working machine 1. Each of the control valves constituting the control valve V1 is configured as a valve, e.g., a pilot-operated solenoid valve, electrically controlled by a later-discussed controller U1. The pilot-operated solenoid valve includes a solenoid and a main spool and is configured so that the solenoid is controlled to control the motion of the main spool so as to control a pilot pressure for controlling the flow of hydraulic fluid. For example, the valves serving as the control valves constituting the control valve V1 are configured to control a first traveling motor M1, a second traveling motor M2, a swivel motor M3, a dozer cylinder, a swing cylinder C2, a boom cylinder C3, an arm cylinder C4, a working tool cylinder C5 for operating a later-discussed working tool 24, respectively. One of the control valves may be configured as an auxiliary control valve for controlling a hydraulic actuator of the working tool 24. In particular, when a kind of working tool 24 including a hydraulic actuator is attached to the working machine 1, the control valve unit configured to as the auxiliary control valve is used to control the hydraulic actuator of the working tool 24.

The operation fluid tank T2 is located rearward from the control valve V1. A hydraulic pump P1 is located rightward from a front half portion of the operation fluid tank T2.

A zone in which hydraulic devices including the swivel motor M3, the swivel joint S1, the control valve V1, the operation fluid tank T2 and the hydraulic pump P1 are arranged to continue from the swivel motor M3 to the hydraulic pump P1 is defined as a hydraulic device arrangement section 13 where the hydraulic devices are arranged. In other words, the hydraulic device arrangement section 13 for arrangement of the hydraulic devices is provided between the cabin 5 and the prime mover E1, and the hydraulic devices arranged in the hydraulic device arrangement section 13 includes the swivel joint S1, the swivel motor M3, and the control valve V1. The hydraulic device arrangement section 13 includes a first arrangement portion (arrangement portion) 13A where the swivel joint S1, the swivel motor M3, and the control valve V1 are arranged, and a second arrangement portion 13B where the operation fluid tank T2 and the hydraulic pump P1 are arranged (see FIG. 1).

As shown in FIG. 4, the controller U1 is installed below the cabin 5. The controller U1 controls the control valves that constitute the control valve V1. The controller U1 is mounted on a floor portion 5B of the cabin 5 defined as the bottom portion of the cabin 5. As shown in FIG. 3, the controller U1 is located below the left portion of the driver seat 6.

Each of the swivel joint S1, the swivel motor M3, and the control valve V1 are partially or fully offset from the cabin 5 in the machine width direction K2. This allows access to each of the above-mentioned devices in the maintenance and the like without unloading the cabin 5.

As shown in FIG. 1, the machine body 2 is provided with a covering device 14 configured to cover members mounted on the working machine 1. The covering device 14 includes a first cover body (cover body) 15, a second cover body 16, a third cover body (cover member) 17, and a fourth cover body (rear cover body) 18.

The first cover body 15 is located at the front right portion of the machine body 2, and covers the radiator R1, the oil cooler O1, and the condenser D1. An outside air intake 19 for introducing the outside air to the inside of the first cover body 15 is provided in a side surface of a front portion of the first cover body 15. The cooling fan F1 sucks the outside air introduced from the outside air intake 19.

The second cover body 16 is located behind the first cover body 15, and covers the prime mover E1. That is, the second cover body 16 is a hood defining a prime mover room (engine room) ER for housing the prime mover E1 (hereinafter referred to as a hood).

A third cover 17 is located between the first and second cover bodies 15 and 16 and the cabin 5 (driver seat 6) to cover the device arrangement section 13. In the embodiment, the third cover 17 covers the first arrangement portion 13A defined as a portion of the device arrangement section 13 between the prime mover E1 and the cabin 5. That is, the third cover body 17 covers the swivel joint S1, the swivel motor M3, and the control valve V1.

The fourth cover body 18 is located on the rear portion of the swiveling base plate 9, and covers the fuel tank T1, the operation fluid tank T2, and the like. The fourth cover body 18 includes a first cover 18A, a second cover 18B, and a third cover 18C. The first cover 18A covers the upper and left portions of the fuel tank T1 (see FIG. 4). The second cover 18B covers a part of upper portions of the operation fluid tank T2 and the hydraulic pump P1. The third cover 18C is located on a right side of the weight 10, and covers a rear portion of the hydraulic pump P1. The second cover 18B and the third cover 18C are configured to be opened and closed.

As shown in FIG. 3, the machine body 2 is provided with a support bracket 20 at a front portion thereof slightly rightward from the center in the machine width direction K2. The support bracket 20 is fixed to front portions of the longitudinal ribs 9L and 9R, and protrudes forward from the machine body 2.

As shown in FIGS. 1 and 2, a swing bracket 21 is pivotably attached to a front portion of the support bracket 20 (i.e., a portion of the support bracket 20 protruding from the machine body 2) via a swing shaft 26 to be capable of swinging around the vertical axis of the swing shaft 26. Thus, the swing bracket 21 is pivotable in the machine width direction K2 (in the horizontal direction around the swing shaft 26). The swing shaft 26 is located closer to the other side in the machine width direction K2 than the operator section 42.

As shown in FIG. 1, the swing bracket 21 is located in front of the swivel joint S1. The swing bracket 21 is located at a position where at least a part of the swing bracket 21 overlaps the center line Y1 when the swing bracket 21 is located in front of the swivel axis X1 and the later-discussed boom 22 is orientated in the forward direction (forward) of the machine body. The center line Y1 is located (substantially in the center) between the line Y2 in the fore-and-aft direction passing through the axis X2 of the swing shaft 26 and the right side surface 5A of the cabin 5. The line Y2 passes between the prime mover E1 and the operator section 42.

As shown in FIG. 2, the working device 4 is attached to the swing bracket 21. The working device 4 includes the boom 22, an arm 23, and a working tool (bucket) 24. A base portion 22A of the boom 22 is pivotally supported on an upper portion of the swing bracket 21 with a boom pivot shaft 27. In detail, the base portion 22A is pivotably attached to the upper portion of the swing bracket 21 to be capable of swinging around a lateral axis (an axis extending in the machine width direction K2) with the boom 22 orientated in the forward direction of the machine body. Therefore, the boom 22 is pivotable in the vertical direction. The boom 22 is bent at a longitudinal center portion thereof so that the bent portion is convex rearward when the boom 22 is at its uppermost pivotal movement position shown in FIG. 2.

The arm 23 is pivotally supported on a tip portion of the boom 22 with an arm pivot shaft 23A. In detail, the arm 23 is pivotally attached to the boom 22 so as to be pivotable around the axis defined as the lateral axis in the state where the boom is orientated forward of the machine body. In this manner, the arm 23 is pivotable in the fore-and-aft direction K1 or in the vertical direction. In other words, the arm 23 can pivot in the direction approaching the boom 23 (crowding direction) and in the direction separating from the boom 23 (dumping direction).

In this embodiment, a bucket serving as a standard attachment to be attached to the working device 4 is exemplified as the working tool 24. Hereafter, the working tool 24 may be referred to as a bucket.

The working tool 24 is pivotally supported on the tip end portion of the arm 23 with the working tool pivot shaft 24A. In detail, the working tool 24 is pivotably attached to the arm 23 to be capable of swinging around the axis defined as the lateral axis in the state where the boom 22 oriented to the forward direction of the machine body. In this manner, the working tool 24 is pivotable in the direction approaching the arm 23 (crowding direction) and in the direction separating from the arm 23 (dumping direction). In other words, the bucket 24 is provided on the arm 23 to be capable of performing a scooping motion and a dumping motion. The scooping motion is a pivotal movement of the bucket 24 in the direction toward the boom 22 for scooping up earth and sand, for example. The dumping motion is a pivotal movement of the bucket 24 away from the boom 22 for dropping (discharging) the scooped earth and sand, for example.

Multiple types of buckets 24 with different lateral widths (widths in the machine width direction K2) are available, and any one of the buckets 24 can be selectively mounted. In place of the bucket 24, any one of working tools (attachments) such as a pallet fork and a mania fork, or any one of working tools with hydraulic actuators (i.e., hydraulic attachments) such as a hydraulic crusher, an angle broom, an earth auger, a snow blower, a sweeper, a mower and a hydraulic breaker can be attached.

The swing bracket 21 is capable of being pivoted by the extending and retracting of the swing cylinder C2 provided in the machine body 2. The boom 22 is capable of being pivoted by the extending and retracting of the boom cylinder C3. The arm 23 is capable of being pivoted by the extending and retracting of the arm cylinder C4. The working tool 24 is capable of being pivoted by the extending and retracting of the working tool cylinder (bucket cylinder) C5. The swing cylinder C2, the boom cylinder C3, the arm cylinder C4, and the working tool cylinder C5 are constituted of hydraulic cylinders (hydraulic actuators).

As shown in FIG. 1, a base portion 22A of the boom 22 is located closer to the center line Y1 than the cabin 5. In other words, the swing bracket 21 and the base portion 22A of the boom 22 are located forward from a space between the prime mover E1 and the cabin 5. Accordingly, when the boom 22 is moved upward (to the uppermost position) with respect to the swing bracket 21 oriented to the front (in the forward direction), a lower portion of the boom 22 overlaps the cabin 5 (positioned on a side of the cabin 5) in the side view, and a junction between the boom 22 and the arm 23 is positioned substantially-vertically upward from the swing bracket 21 (see FIG. 2).

When the boom 22 is raised at its uppermost pivotal movement position and the arm 23 is swung in the direction moving the bucket 24 toward the boom 22 while keeping the bucket 24 in the scooping motion, a substantially whole of the bucket 24 is positioned rearward (in a direction A2) from the front end of the dozer 7, and a part of the bucket 24 is positioned rearward from a front end of the swing bracket 21.

In this manner, the arm 23 and the bucket 24 can be brought closer to the machine body 2 so as to locate a part of the bucket 24 rearward from the front end of the swing bracket 21 when the boom 22 is at the uppermost position. Accordingly the working device 4 can be turned in a small radius with the machine body 2 in the swivel motion, thereby stabilizing the motion of the working device 4 for loading earth and sand on the loading tray of a dump truck, or suspending a load from a hook provided at the tip end of the arm 23, for example. In addition, since the bucket 24 can be positioned at a high position close to the machine body 2 when the boom 22 is at the uppermost position, the working machine 1, when loading earth, sand, or the like onto a load carrying platform of a dump truck, can be positioned with the machine body 2 close to the load carrying platform, thereby improving workability. In addition, when the arm 23 is pivoted to separate away from the boom 22 from the state shown by solid lines in FIG. 2, a trajectory of bottom portion of the bucket 24 is defined as extending upward, thereby smoothening the dumping motion for loading earth, sand, or the like onto the load carrying platform of the dump truck.

Figure 7:
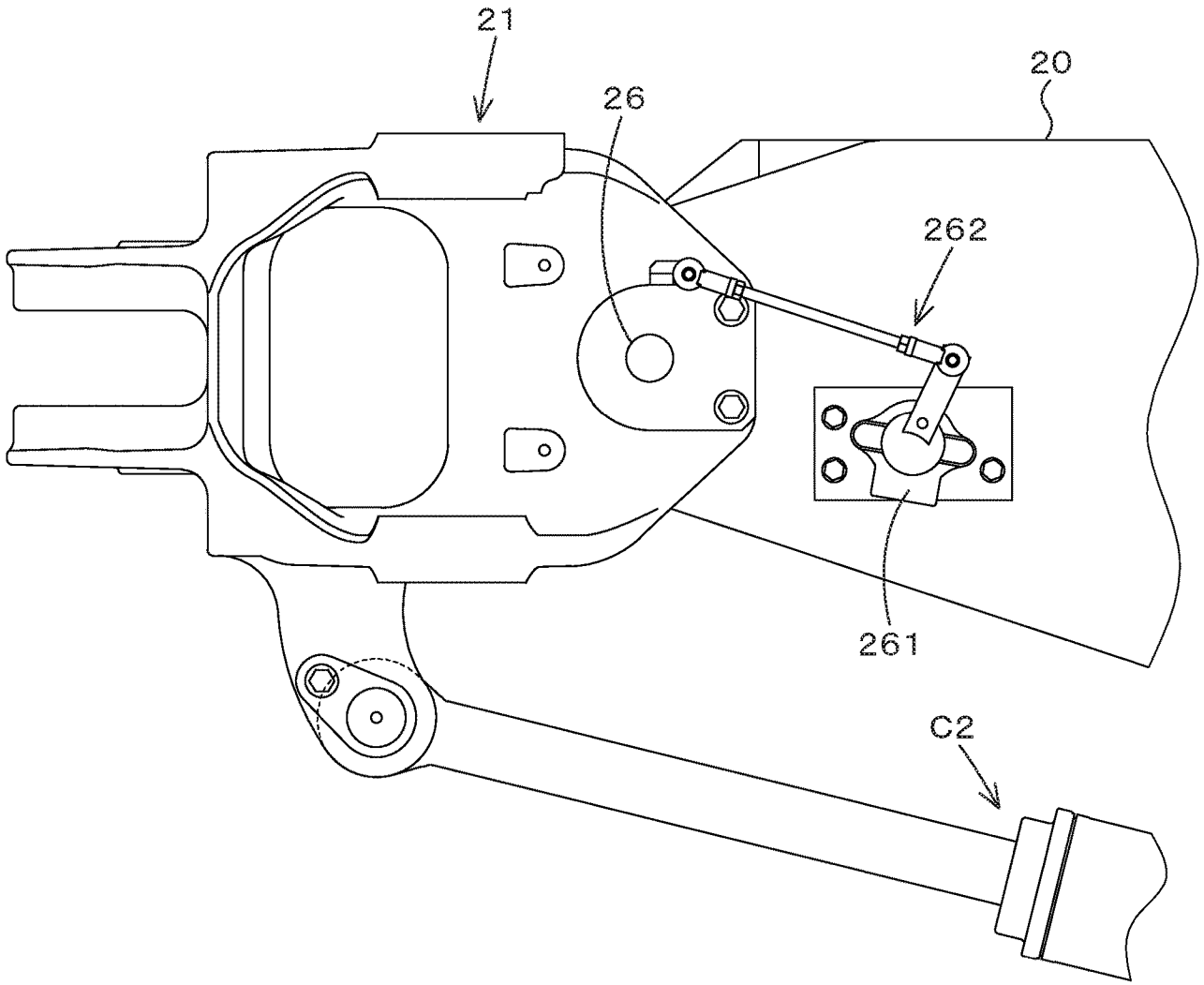
FIG. 7 is a plan view illustrating an attachment portion of a swing sensor.

As shown in FIG. 7, the working machine 1 includes a swing sensor 261 configured to detect a position of the swing bracket 21. The swing sensor 261 is constituted of a potentiometer, for example. The swing sensor 261 is attached to the support bracket 20. The swing sensor 261 is interlockingly connected to the swing bracket 21 via a first linkage 262. Accordingly, the swing sensor 261 detects a turn angle (swing angle) of the swing bracket 21 around the swing shaft 26. That is, the swing sensor 261 detects a position of the swing bracket 21 with respect to the support bracket 20 (machine body 2).

Figure 8:
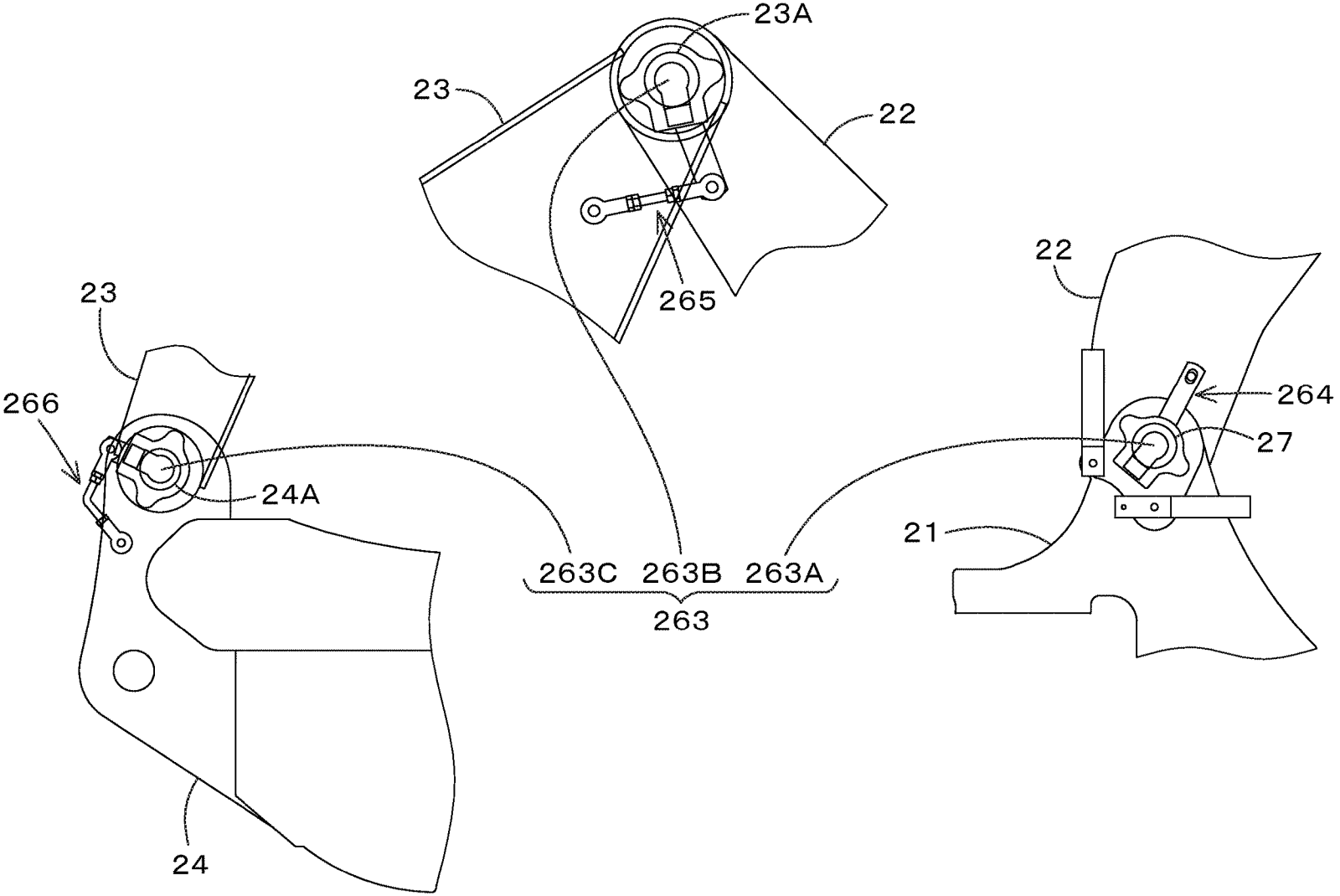
FIG. 8 is a side view illustrating a boom sensor, an arm sensor, and a working tool sensor.

As shown in FIG. 8, the working machine 1 includes a working device sensor 263 configured to detect a state of the working device 4. The working device sensor 263 includes a boom sensor 263A to detect a position of the boom 22, an arm sensor 263B to detect a position of the arm 23, and a working tool sensor 263C to detect a position of the working tool 24. The boom sensor 263A, the arm sensor 263B, and the working tool sensor 263C are constituted of potentiometers, for example.

The boom sensor 263A is attached to the swing bracket 21. The boom sensor 263A is also interlockingly connected to the boom 22 via a second linkage 264. Accordingly, the boom sensor 263A detects a turn angle of the boom 22 around the boom pivot shaft 27. That is, the boom sensor 263A detects a position of the boom 22 with respect to the swing bracket 21.

The arm sensor 263B is attached to the boom 22. The arm sensor 263B is also interlockingly connected to the arm 23 via a third linkage 265. Accordingly, the arm sensor 263B detects a turn angle of the arm 23 around the arm pivot shaft 23A. That is, the arm sensor 263B detects a position of the arm 23 with respect to the boom 22.

The working tool sensor 263C is attached to the arm 23. The working tool sensor 263C is interlockingly connected to the working tool 24 via a fourth linkage 266. Accordingly, the working tool sensor 263C detects a turn angle of the working tool 24 around the working tool pivot shaft 24A. That is, the working tool sensor 263C detects a position of the working tool 24 with respect to the arm 23.

The working device sensor 263 detects a status (posture) of the working device 4 when the boom sensor 263A detects a position of the boom 22, the arm sensor 263B detects a position of the arm 23, and the working tool sensor 263C detects a position of the working tool 24.

Figure 9:
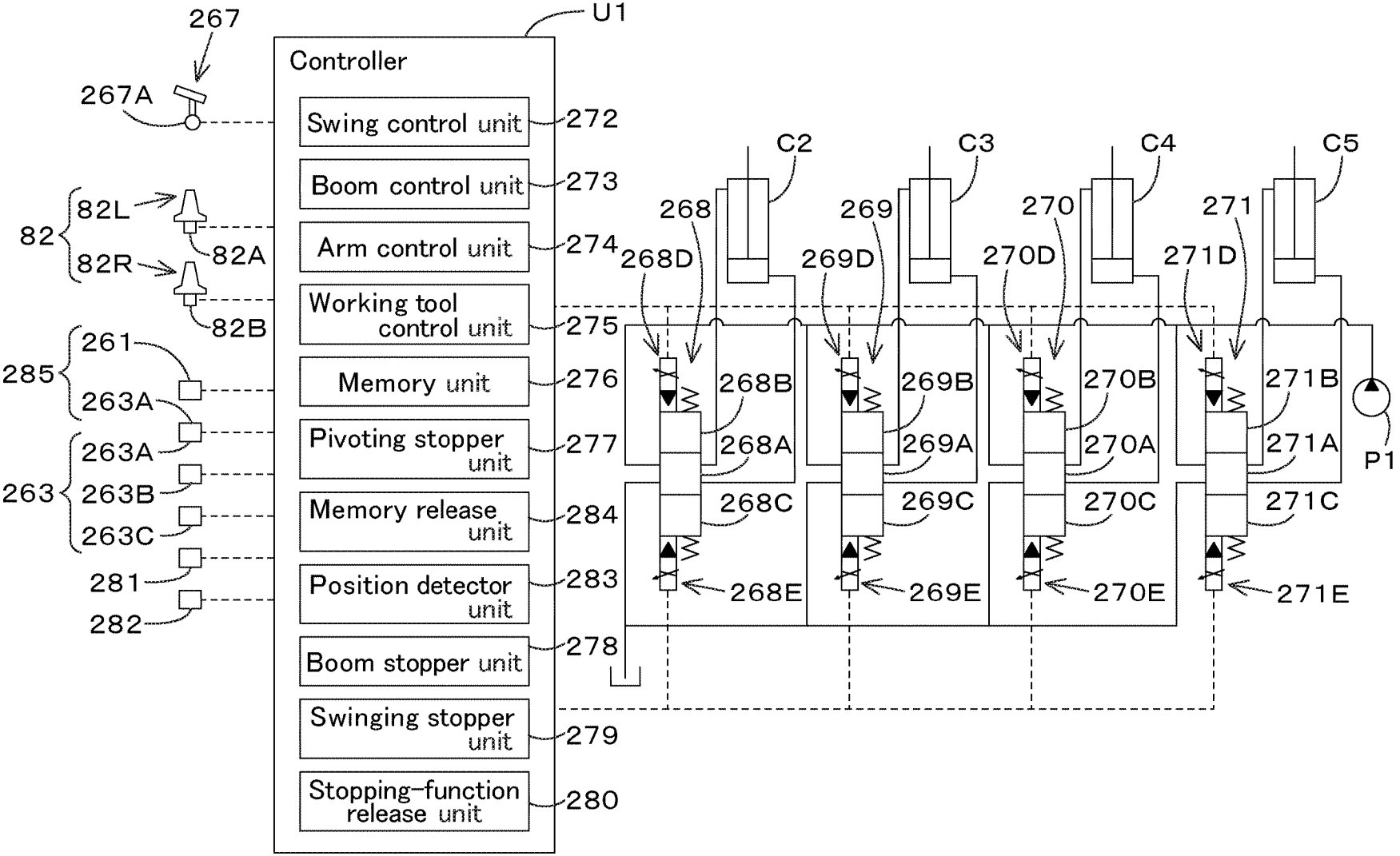
FIG. 9 is a schematic diagram of a control system.

FIG. 9 shows a control system for the swing bracket 21 and the working device 4. The control system includes the controller U1, a swing control valve 268, a boom control valve 269, an arm control valve 270, and a working tool control valve 271.

The controller U1 is constituted of a microcomputer including a CPU (Central Processing Unit) and EEPROM (Electrically Erasable Programmable Read-Only Memory), for example.

The swing control valve 268, the boom control valve 269, the arm control valve 270, and the working tool control valve 271 are the control valves constituting the control valve V1, and are constituted of the pilot-type solenoid valves described above. The swing control valve 268 controls the swing cylinder C2, the boom control valve 269 controls the boom cylinder C3, the arm control valve 270 controls the arm cylinder C4, and the working tool control valve 271 controls the working tool cylinder C5.

In particular, the swing control valve 268 can be switched from a neutral position 268 to a first position 268B or a second position 268C by selectively exciting or unexciting a first solenoid 268D and a second solenoid 268E. When the swing control valve 268 is switched to the first position 268B, the swing cylinder C2 is extended so that the swing bracket 21 pivots to the right. When the swing control valve 268 is switched to the second position 268C, the swing cylinder C2 is retracted so that the swing bracket 21 pivots to the left.

The boom control valve 269 can be switched from a neutral position 269A to a first position 269B or a second position 269C by exciting or unexciting a first solenoid 269D and a second solenoid 269E. When the boom control valve 269 is switched to the first position 269B, the boom cylinder C3 is extended so that the boom 22 pivots upward. When the boom control valve 269 is switched to the second position 269C, the boom cylinder C3 is retracted so that the boom 22 pivots downward.

The arm control valve 270 can be switched from a neutral position 270A to a first position 270B or a second position 270C by exciting or unexciting a first solenoid 270D and a second solenoid 270E. When the arm control valve 270 is switched to the first position 270B, the arm cylinder C4 is extended so that the arm 23 pivots in a direction approaching the boom 22. When the arm control valve 270 is switched to the second position 270C, the arm cylinder C4 is retracted so that the arm 23 swings in a direction separating away from the boom 22.

The working tool control valve 271 can be switched from a neutral position 271A to a first position 271B or a second position 271C by exciting or unexciting a first solenoid 271D and a second solenoid 271E. When the working tool control valve 271 is switched to the first position 271B, the working tool cylinder C5 is extended so that the working tool 24 pivots in a direction approaching the arm 23. When the working tool control valve 271 is switched to the second position 271C, the working tool cylinder C5 is retracted so that the working tool 24 pivots in a direction separating away from the arm 23.

As shown in FIG. 9, the controller U1 includes a swing control unit 272 configured to control switching of the swing control valve 268, a boom control unit 273 configured to control switching of the boom control valve 269, an arm control unit 274 configured to control switching of the arm control valve 270, and a working tool control unit 275 configured to control switching of the working tool control valve 271. That is, the controller U1 controls motions of the swing bracket 21, the boom 22, the arm 23, and the bucket 24.

As shown in FIG. 9, the swing sensor 261, the boom sensor 263A, the arm sensor 263B, and the working tool sensor 263C are electrically connected to the controller U1. Accordingly, the controller U1 obtains detection signals from the swing sensor 261, the boom sensor 263A, the arm sensor 263B, and the working tool sensor 263C.

In this manner, the controller U1 knows (monitors) the position of the swing bracket 21 with respect to the support bracket 20, the position of the boom 22 with respect to the swing bracket 21, the position of the arm 23 with respect to the boom 22, the position of the working tool 24 with respect to the arm 23, and the state of the working device 4. The controller U1 also recognizes the position of the boom 22 with respect to the cabin 5 based on the position of the swing bracket 21 with respect to the support bracket 20 and the position of the boom 22 with respect to the swing bracket 21.

As shown in FIG. 9, a swing operation tool 267 is operably connected to the controller U1. The swing operation tool 267 is constituted of a pedal, for example, and is provided on the floor portion 5B in front of the driver seat 6. The swing operation tool 267 includes a sensor (position sensor) 267A configured to detect an operational direction and an operation amount of the swing operation tool 267. The sensor 267A is electrically connected to the controller U1. When the swing operation tool 267 is operated by stepping into the left side, for example, the swing control valve 268 is switched to the second position 268C in accordance with a command signal output from the swing control unit 272, and the swing bracket 21 pivots to the left. When the swing operation tool 267 is operated by stepping into the right side, the swing control valve 268 is switched to the first position 268B in accordance with a command signal output from the swing control unit 272, and the swing bracket 21 pivots to the right.

As shown in FIG. 9, a manipulator 82 is operably connected to the controller U1. The manipulator 82 is provided on a manipulator console 81 (see FIGS. 4 and 6) located in front of the driver seat 6. The manipulator 82 is a member (grip) that is gripped to be operated by an operator. The manipulator 82 includes a first manipulation handle 82L and a second manipulation handle 82R.

The first manipulation handle 82L is operable to swivel the machine body 2 and to pivot the arm 23, for example. The first manipulation handle 82L includes a sensor (position sensor) 82A configured to detect an operational direction and an operation amount of the first manipulation handle 82L. The sensor 82A is electrically connected to the controller U1. Based on the detection signal from the sensor 82A, the controller U1 controls the arm control valve 270 or a swivel control valve (not shown in the drawings) for controlling the swivel motor M3.

The second manipulation handle 82R is operable to swing the boom 15 and to swing the working tool 24, for example. The second manipulation handle 82R includes a sensor (position sensor) 82B configured to detect an operational direction and an operation amount of the second manipulation handle 82R. The sensor 82B is electrically connected to the controller U1. Based on the detection signal from the sensor 82B, the controller U1 controls the boom control valve 269 or the working tool control valve 271.

For example, when a wide bucket 24 or a large working tool 24 is attached to the working machine 1 and the swing bracket 21 is pivoted to the left, the wide bucket 24 or the large working tool 24 may interfere with the cabin 5 (operator section 42).

Accordingly, the working machine 1 includes a swing interference prevention function to stop the movement of the swing bracket 21 at a position where the working tool 24 is free from interfering with the cabin 5. The swing interference prevention function will be described below.

The controller U1 includes a memory unit 276, a pivoting stopper unit 277, and a memory release unit 284. A regulator switch 281 is electrically connected to the controller U1. The regulator switch 281 is provided on the manipulator console 81, for example. The regulator switch 281 may be a physically-operated hardware switch such as a pushbutton switch or a rotary switch, or a software switch that uses software to switch between on and off. The software switch is displayed, for example, on a display unit 84A of a monitor 84 (see FIG. 6) provided on the manipulator console 81.

The memory portion 276 stores a predetermined position of the swing bracket 21 when the regulator switch 281 is turned on. In detail, by operating the swing operation tool 267, the swing bracket 21 is pivoted, and then stopped at an arbitrary regulation position (selected as a position for automatically stopping the swing bracket 21). In this state, when the regulator switch 281 is turned on, the memory unit 276 stores the regulation position.

When the swing bracket 21 in the pivotal movement reaches the regulation position corresponding to that stored in the memory unit 276, the pivoting stopper unit 277 outputs a command signal (a signal to return to the neutral position 268A) to the swing control valve 268 to stop the pivotal movement of the swing bracket 21. Due to the command signal, the swing bracket 21 is stopped at the regulation position. Therefore, even when the swing bracket 21 is pivoted by operating the swing operation tool 267, the swing bracket 21 can be automatically and forcibly stopped at the prescribed regulation position to prevent the working tool 24 from interfering with the cabin 5.

The memory unit 276 stores the regulation position of the swing bracket 21 defined when the working device 4 is in a predetermined state (predetermined posture). For example, while the working device 4 is set in the predetermined state, the swing bracket 21 is pivoted leftward from the forward direction of the machine body, and the pivotal movement of the swing bracket 21 is stopped at an arbitrary position before the working tool 24 abuts against the cabin 5. Then, the arbitrary position is stored in the memory unit 276, thereby preventing the working device 4 from interfering with the cabin 5 (operator section 42) and the like.

The predetermined state of the working device 4 is, for example, the state in which the boom 22 is set at the uppermost pivotal movement position, the arm 23 is set at a pivotal movement position closest to the boom 22, and the working tool 24 is set at a pivotal movement position closest to the arm 23. In this state, it is effective to memorize the regulation position of the swing bracket 21 because the working tool 24 in this state is likely to interfere with the cabin.

As described above, in using any one of various types of working tools 24, the position of the swing bracket 21 before the working tool 24 interferes with the cabin 5 is stored, and a swing movement defined as the pivotal movement of the swing bracket 21 is stopped when the swing bracket 21 reaches a position corresponding to the stored position, in this manner, the operator can perform the swing operation without paying attention to the interference between the working tool 24 and the cabin 5.

The memory release unit 284 releases the memory of the regulation position stored in the memory portion 276. In detail, by turning off the regulator switch 281, the memory release unit 284 releases the memory of the regulation position stored in the memory portion 276. In this manner, when the working tool 24 is replaced with another working tool 24, for example, the stop position of the swing bracket 21 can be reset according to a size of the replacement working tool 24.

The release of the memory of the regulated position by the memory release portion 284 may be performed by a regulation release switch different from the regulator switch 281.

The setting of the regulation position may be performed when the swing bracket 21 pivoted from the center position, where the boom 22 is oriented to in the forward direction of the machine body, reaches a position closer to the operator section 42 than the center position.

Figure 10:
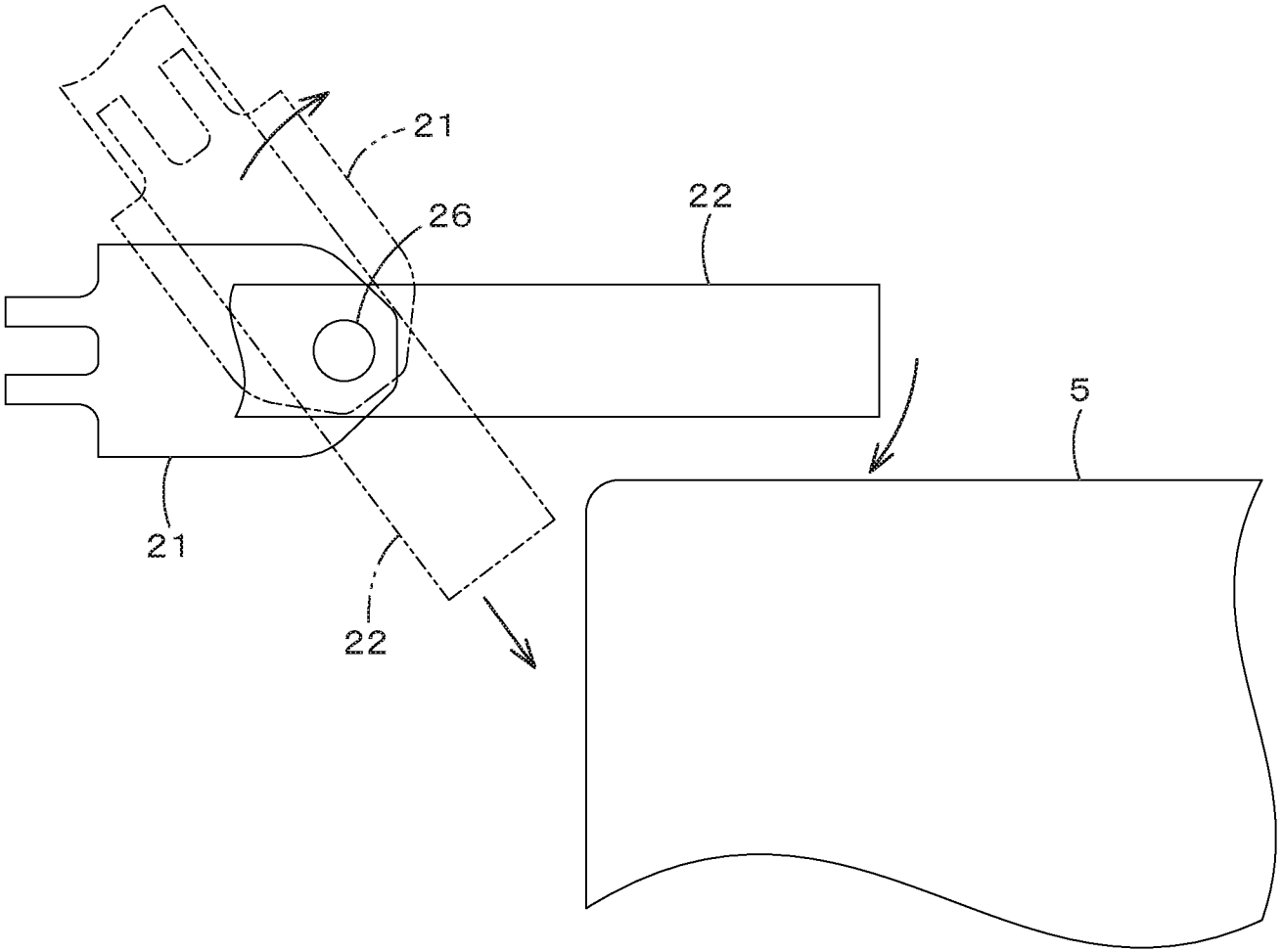
FIG. 10 is a plan view illustrating a relationship between the cabin and the boom.

As shown by solid lines in FIG. 10, when the boom 22 is moved upward at the center position where the swing bracket 21 is oriented in the forward direction of the machine body, the boom 22 overlaps the cabin 5 when viewed in the machine width direction K2. That is, the boom 22 can be pivoted upward to a position on a lateral side of the operator section 42. As shown by an arrowed line, when the swing bracket 21 is pivoted rightward from the position where it is in the above-mentioned state, the boom 22 may come close to the cabin 5 (operator section 42) so that the boom 22 becomes more likely to interfere with the cabin 5. In addition, as shown by virtual lines, when the boom 22 is pivoted upward in the state where the swing bracket 21 is set at its rightward swing position, the boom 22 may come close to the cabin 5 (operator section 42) so that the boom 22 may interfere with the cabin 5.

In consideration of the problem, the working machine 1 includes a boom interference prevention function to prevent the boom 22 from interfering with the cabin 5 (operator section 42). The boom interference prevention function will be described.

As shown in FIG. 9, the controller U1 includes a position detector unit 283 and a boom stopper unit 278. The position detector unit 283 detects a position of the boom 22 with respect to the cabin 5 (operator section 42) based on the detection signals from the swing sensor 261 and the boom sensor 263A. That is, a position of the boom 22 with respect to the cabin 5 is detected based on a position of the swing bracket 21 with respect to the support bracket 20 and the position of the boom 22 with respect to the swing bracket 21. In other words, the swing sensor 261 and the boom sensor 263A constitute a detection sensor 285 to detect a position of the boom 22 with respect to the operator section 42.

The boom stopper unit 278 outputs, to the boom control valve 269, a command signal (a signal to return to the neutral position 269A) to stop the boom 22 before the boom 22 interferes with the cabin 5 (operator section 42) (when the boom 22 is close to the cabin 5) based on the position of the boom 22 detected by the position detector unit 283. The boom 22 stops in accordance with this command signal.

In particular, when the boom 22 is pivoted upward after the boom 22 is swung rightward at a predetermined angle or more from the position in the forward direction of the machine body, the boom stopper unit 278 judges, based on the detection result of the position detector unit 283, whether the boom 22 is coming into close proximity to the cabin 5 (operator section 42) or not. When the boom stopper unit 278 determines the boom 278 as being in close proximity to the cabin 5, the operation of raising the boom 22 is stopped so as to prevent the boom 22 from interfering with the cabin 5 (operator section 42).

Based on the position of the boom 22 detected by the position detector unit 283, the pivoting stopper unit 277 outputs a command signal to the swing control valve 268 to stop the swinging movement before the boom 22 interferes with the cabin 5 (operator section 42) (when the boom 22 is close to the cabin 5). The swinging movement is stopped in accordance with the command signal.

In particular, when the boom 22 is swung rightward from the position in the forward direction of the machine body after the boom 22 is raised at a predetermined angle or more, the pivoting stopper unit 277 judges, based on the detection result of the position detector unit 283, whether the boom 22 is coming into close proximity to the cabin 5 (operator section 42). When the pivoting stopper unit 277 determines the boom 22 as being in close proximity to the cabin 5, the swinging movement is stopped so as to prevent the boom 22 from interfering with the cabin 5 (operator section 42).

For example, a case where the boom 22 is moved upward to the uppermost position will now be discussed. Before the upward movement of the boom 22, if the swing bracket 21 is oriented in a leftwardly forward diagonal direction, the swing bracket 21 is swung rightward to be stopped at the center position, and if the swing bracket 21 is oriented in a rightwardly forward diagonal direction, the swing bracket 21 is swung leftward to be stopped at the center position. However, if the boom 22 is moved upward after the swing bracket 21 is wrongly stopped at a position slightly deviating rightward from the center position, due to the above-mentioned boom interference prevention function, the boom 22 may unexpectedly be stopped halfway. In such a case, the position of the swing bracket 21 has to be corrected. The position correcting operation is troublesome.

In consideration of the problem, the working machine 1 includes a swing center-stopping function to stop the swing bracket 21 at the center position. The swing center-stopping function will be explained.

As shown in FIG. 9, the controller U1 includes the swinging stopper unit 279 and the stopping-function release unit 280. In addition, a stopping release switch 282 is operably connected to the controller U1. The stopping release switch 282 is provided, for example, on the steering console 81. The stopping release switch 282 may be a hardware switch or a software switch.

The swinging stopper unit 279 temporarily stops the swinging movement which is defined as the swinging movement of the swing bracket, when the swung swing bracket 21 reaches the center position where the boom 22 is oriented in the forward direction of the machine body. In detail, when the swing bracket 21 is swung and is positioned at the center position where the boom 22 is oriented in the forward direction of the machine body, the swinging stopper unit 279 outputs a command signal (a signal to return to the neutral position 268A) to the swing control valve 268 to stop the swinging movement temporarily (for a predetermined time). Due to the command signal, the swing bracket 21 is kept stationary at the center position for the predetermined time. In this manner, the operator can recognize the swing bracket 21 as being positioned at the center position.

The time of stopping the swinging movement is not limited, but is, for example, about one second. That is, the swinging stopper portion 279 releases the stop of swinging movement after a predetermined time has elapsed after the stopping of the swinging movement. Accordingly, when the operator continues to operate the swinging movement tool 267 after the swinging movement is stopped, the swinging movement can be resumed after the predetermined time has elapsed, and thus the swinging movement can be continued.

When the operation of the swing operation tool 267 is released during the stopping of the swinging movement, the swing bracket 21 can be accurately positioned at the center position where the boom 22 is oriented to the forward direction of the machine body. In this manner, the boom 22 can be moved to the uppermost position without unexpected interruption due to the boom interference prevention function. That is, the work of correcting the position of the swing bracket 21 from the off-center position back to the center position can be eliminated.

In the embodiment, in both cases of pivoting the swing bracket 21 to the right and pivoting the swing bracket 21 to the left, the swinging movement is stopped once when the swing bracket 21 reaches the center position.

When the stopping release switch 282 is tuned on, the stopping-function release unit 280 restricts the stopping function (swing center-stopping function) of the swing stopper unit 279 to stop the swinging movement. That is, the swinging stopper unit 279 is not allowed to stop the swinging movement. In this manner, an operator who do not need the swing center-stopping function to use the working machine 1 comfortably. In addition, by operating the stopping release switch 282 to be turned off, the swing center-stopping function can be activated.

As shown in FIG. 4, the driver seat 6 is located at a rear portion in the cabin 5. The driver seat 6 is mounted on the floor portion 5B of the cabin 5. In detail, a seat stand 76 is mounted on a center portion of the floor portion 5B in the machine width direction K2, and the driver seat 6 is provided on the seat stand 76 via a suspension 77.

As shown in FIGS. 4 and 6, the manipulation device 41 is provided in the cabin 5. The steering device 41 is located in front of the driver seat 6, and is installed on the floor portion 5B. The driver seat 6 and the steering device 41 constitute the operator section 42 for driving (operating) the working machine 1. In the embodiment, the operator section 42 is described as being arranged inside the cabin 5, i.e., as being cabined. However, this configuration is not limitative. Alternatively, the operator section 42 may be open to the outside in the fore-and-aft direction K1 and in the machine width direction K2 and covered at its upper portion with a roof, i.e., the operator section 42 may be provided with a canopy. Further alternatively, the operator section 42 may be open to the outside in the fore-and-aft direction K1 and in the machine width direction K2 and at its upper portion.

Figure 11:
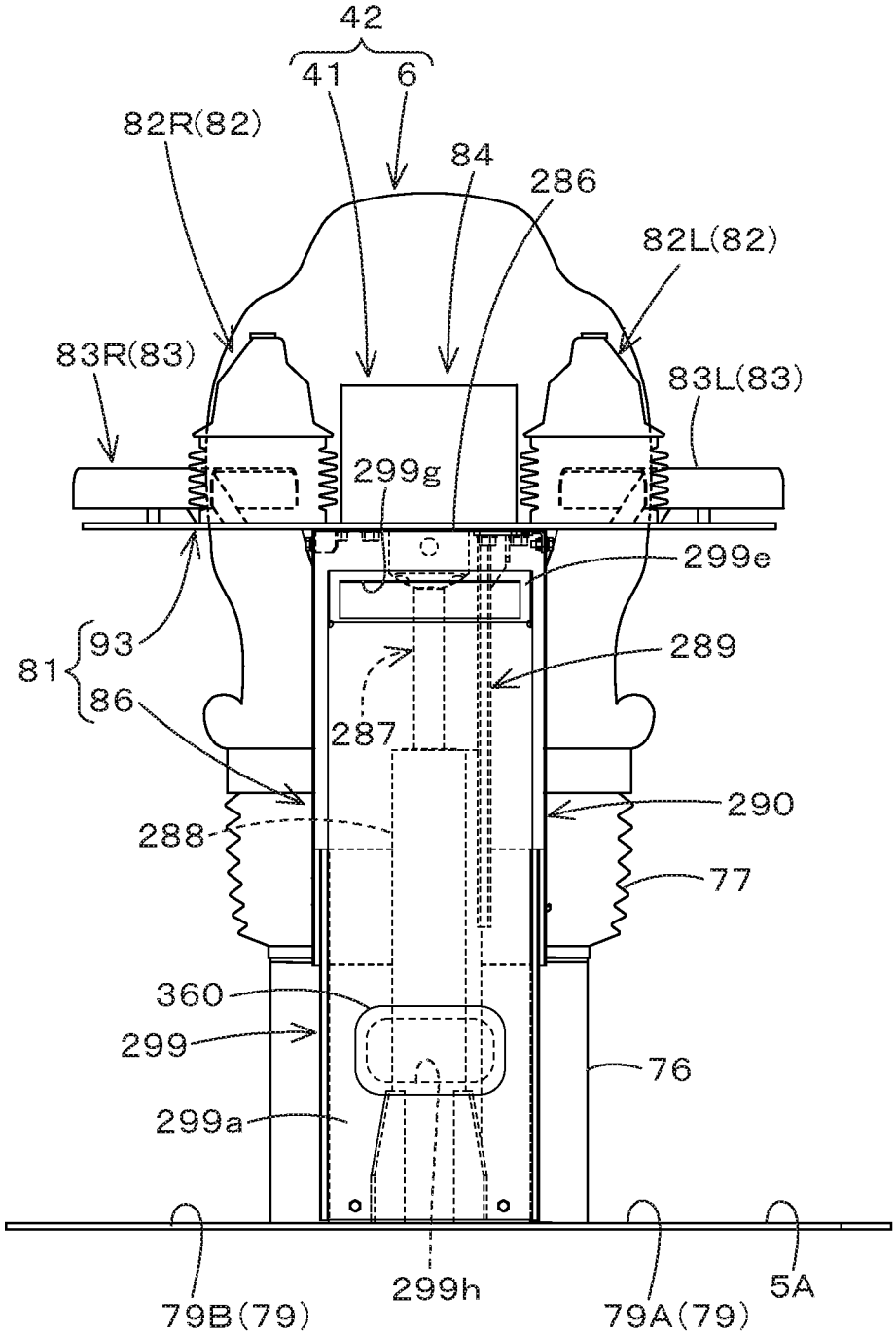
FIG. 11 is a front view of an operator section.
Figure 12:
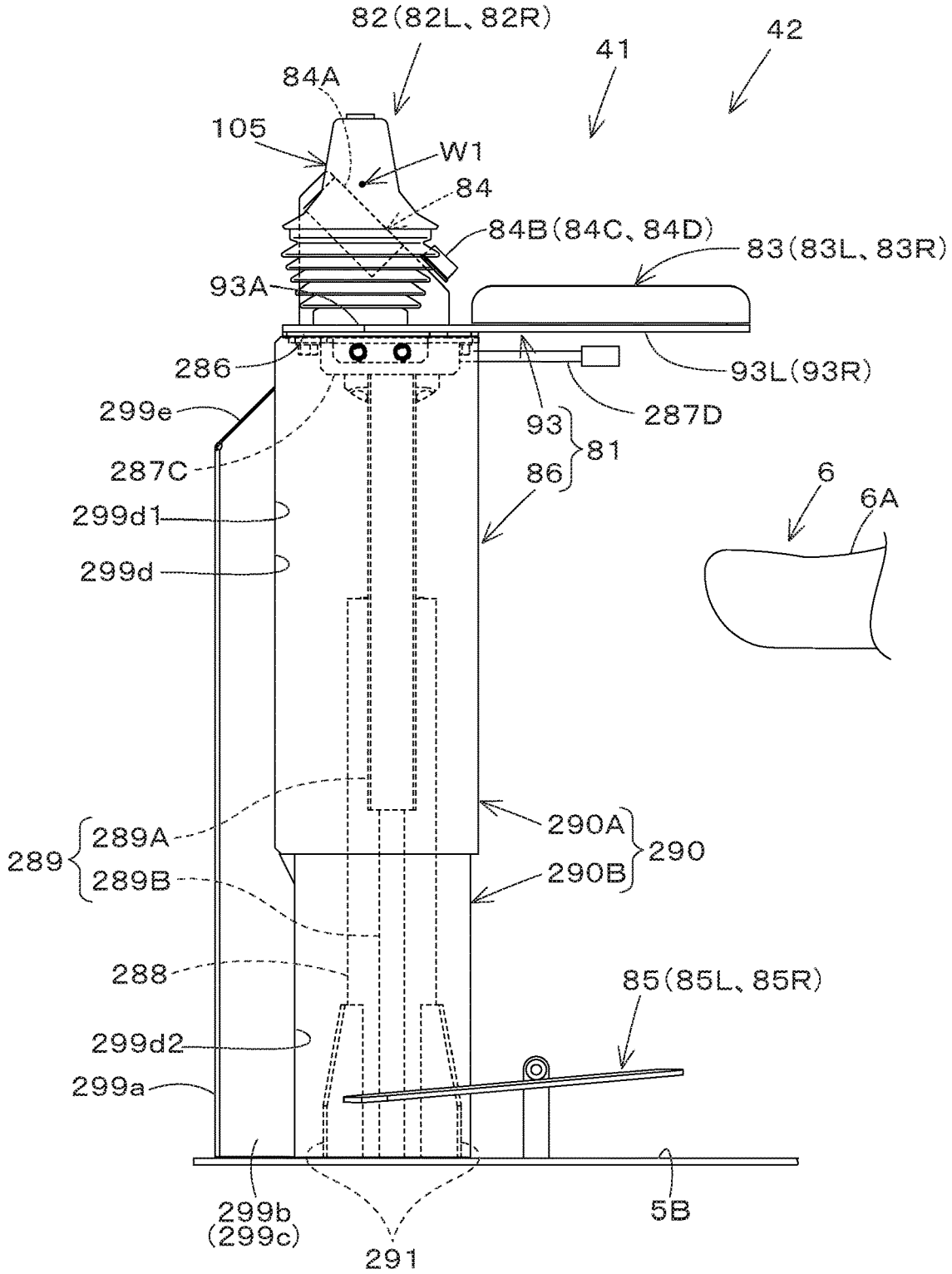
FIG. 12 is a side view of the operator section.

As shown in FIGS. 11 and 12, the manipulation device 41 includes the manipulator console 81, the manipulator 82, at least one armrest 83, a monitor 84, a traveling operation device 85, and the dozer lever 80. The manipulator console 81 is provided in front of the driver seat 6 and at the central portion of the cabin 5 in the machine width direction K2. The manipulator console 81 includes an attachment base 93 and an elevation device 86. The manipulator 82, the at least one armrest 83, the monitor 84, the dozer lever 80, and the like are attached to the attachment base 93, and the elevation device 86 supports the attachment base 93 to be capable of adjusting a vertical position of the attachment base 93.

Figure 13:
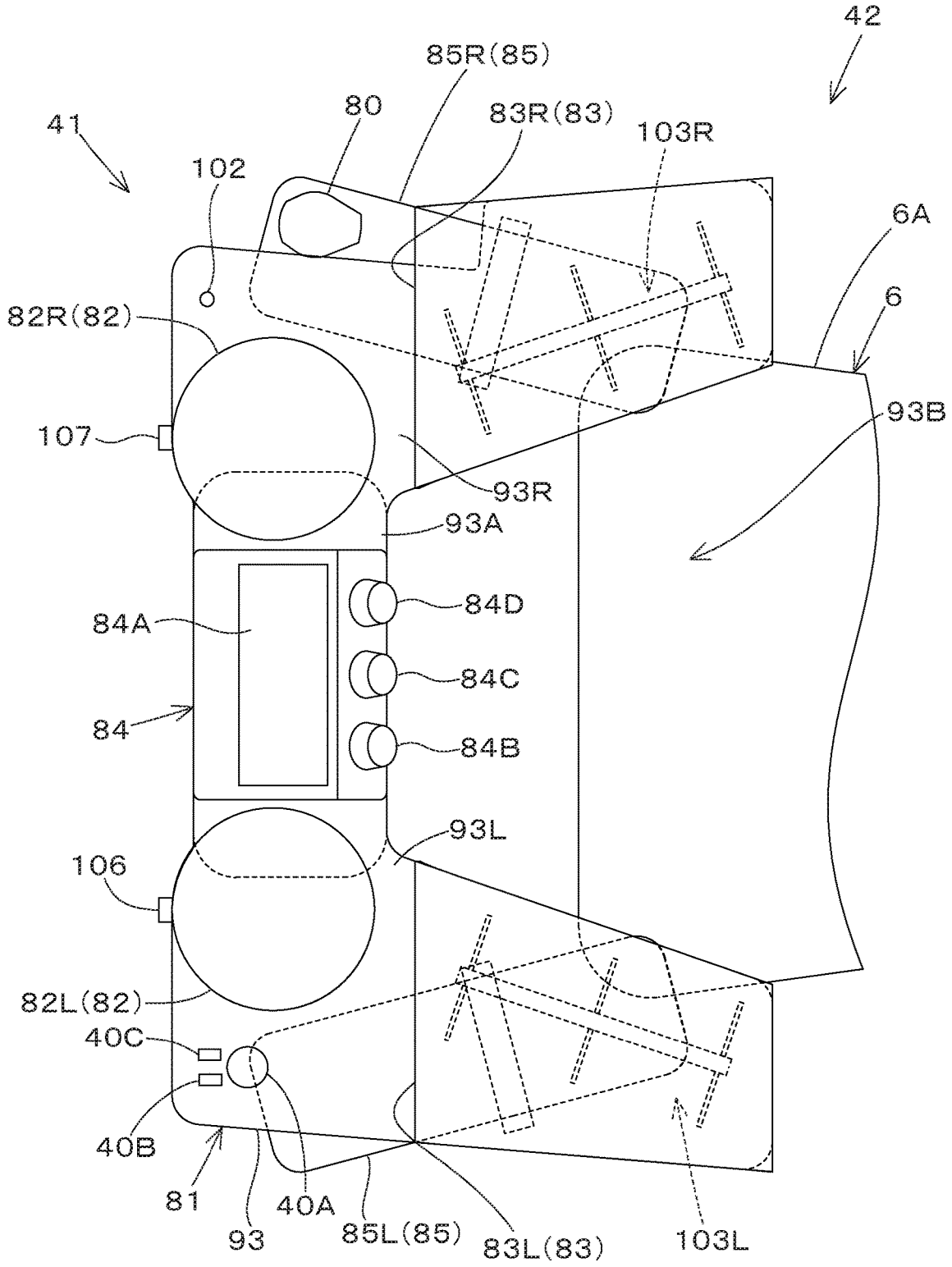
FIG. 13 is a plan view of the operator section.

As shown in FIG. 11, the attachment base 93 is provided on an upper portion of the steering console 81. The attachment base 93 is formed of a plate-shaped member, and is arranged such that its plate-shaped surface faces in the vertical direction. As shown in FIG. 13, the attachment base 93 includes a main portion 93A, a first extending portion 93L, and a second extending portion 93R. The main portion 93A is formed laterally long in the machine width direction K2. The first extending portion 93L extends rearward from one side portion of the main portion 93A in the machine width direction K2. In detail, the first extending portion 93L extends in a machine-outwardly rearward direction from a machine-outward side portion (left portion) of the main portion 93A. The second extending portion 93R extends rearward from the other side portion of the main portion 93A in the machine width direction K2. In detail, the second extending portion 93R extends in a machine-inwardly rearward direction from a machine-inward side portion (right portion) of the main portion 93A.

The attachment base 93 is formed at a rear portion thereof with a rearwardly open concave portion 93B defined by a rear edge of the center portion of the main portion 93A, a right edge of the first extending portion 93L, and a left edge of the second extending portion 93R. The concave portion 93B is gradually widened as extending rearward. As shown in FIG. 6, the concave portion 93B formed in the attachment base 93 allows an operator to easily approach the front window 5C defining the front surface of the cabin 5 and to easily open and close an upper glass 68A. In detail, as shown in FIGS. 4 and 6, the front window 5C includes a front glass 68. The front glass 68 includes the upper glass 68A which is movable linearly in the vertical direction, and a fixed lower glass 68B. The upper glass 68A is provided at an upper portion thereof with grippers 60L and 60R to be gripped by an operator moving the upper glass 68A. The gripper 60L is provided on a left portion of the upper glass 68A, and the gripper 60R is provided on a right portion of the upper glass 68A. By moving the upper glass 68A up and down, the upper front portion of the cabin 5 can be opened and closed, and the concave portion 93B makes it easy to operate the upper glass 68A.

Figure 14:
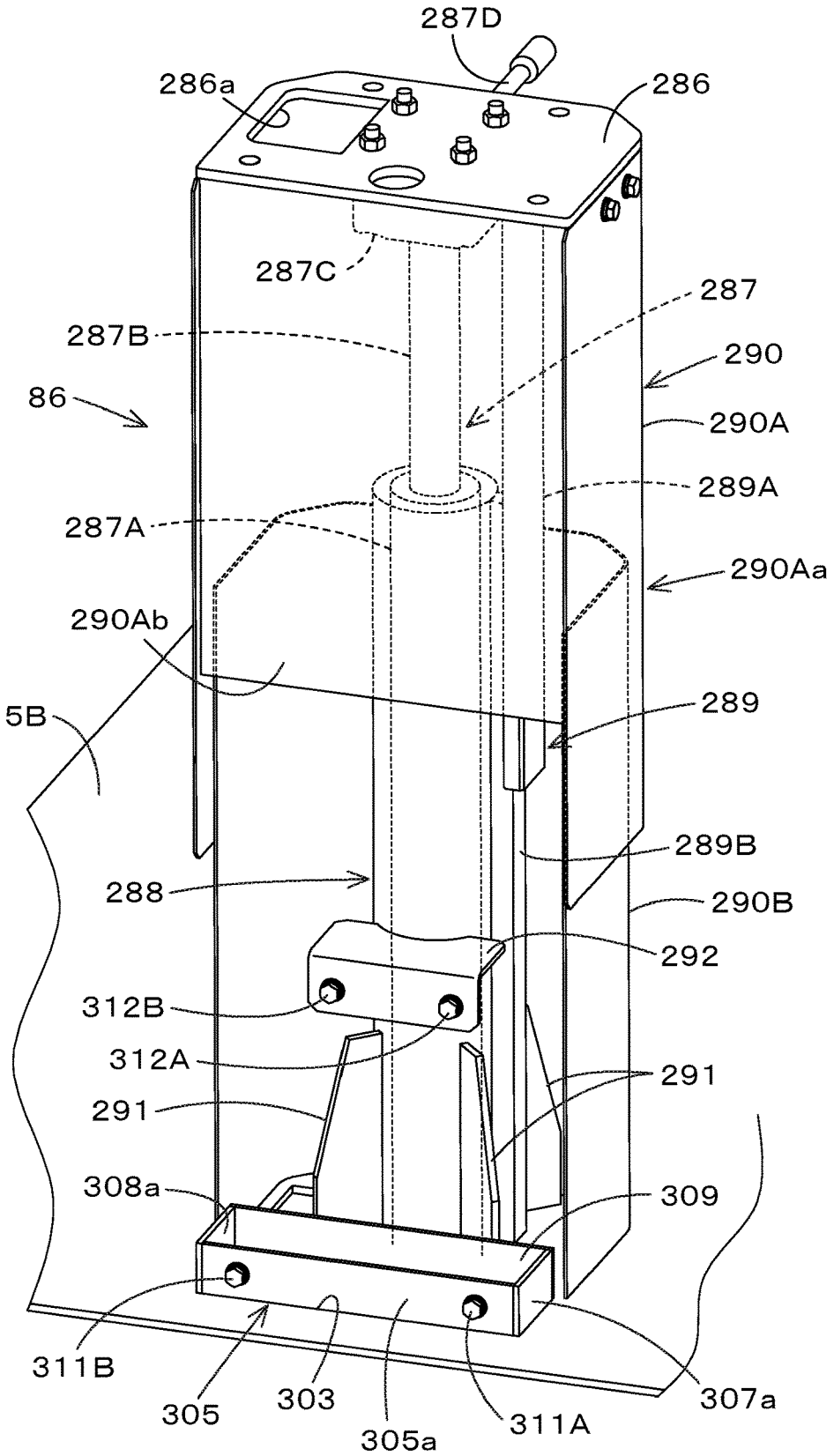
FIG. 14 is a diagonal view of an elevation device seen from the left front.

As shown in FIG. 12, the elevation device 86 is located below the attachment base 93. As shown in FIG. 14, the elevation device 86 includes an attachment plate 286, a support pipe 288, a gas cylinder 287, an anti-rotation mechanism 289, and a lifter cover 290.

Figure 15A:
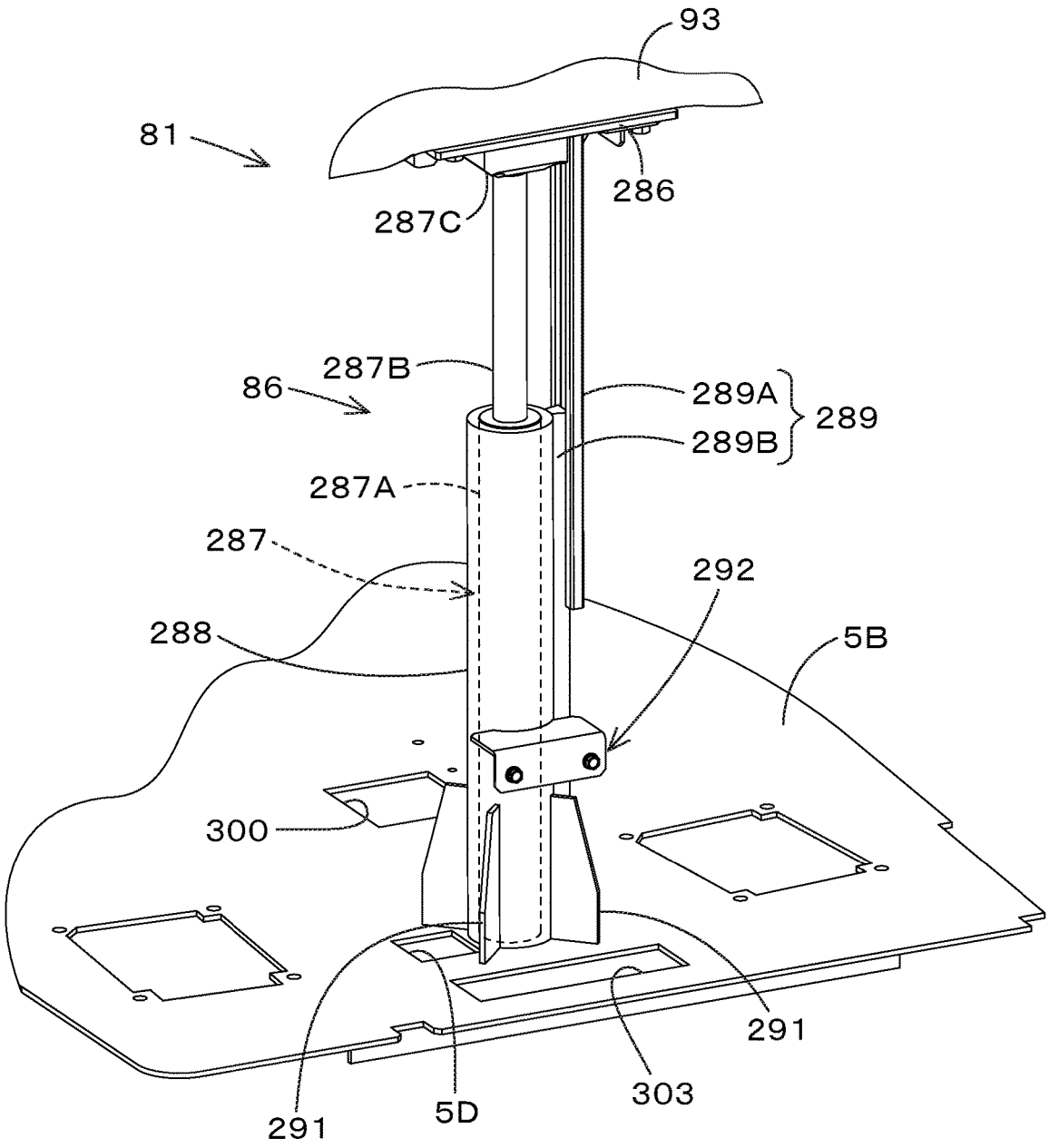
FIG. 15A is a diagonal view of the elevation device seen from the right front.

As shown in FIG. 12, the attachment plate 286 is attached to a lower surface of the main portion 93A of the attachment base 93. As shown in FIG. 14, a vertical through hole 286A is formed through a right portion of the attachment base 93. As shown in FIG. 15A, a through hole 5D is formed through the floor portion 5B below the through hole 286*a*. Harnesses to be connected to devices such as the manipulator 82, monitor 84 and switches attached to the attachment base 93 are extended through the through hole 286*a* and the through hole 5D.

As shown in FIG. 15A, the support pipe 288 has a cylindrical shape with an axis extending in the vertical direction, and stands on the floor portion 5B. The support pipe 288 is provided a lower portion thereof with reinforcing ribs 291 that are fixed to the floor portion 5B. An attachment stay 292 is fixed to a lower and front portion of the support pipe 288.

As shown in FIG. 15A, the gas cylinder 287 includes a cylinder tube 287A and a piston rod 287B. The cylinder tube 287A is inserted into the support pipe 288, and is supported by the support pipe 288 and extends in the vertical direction. The piston rod 287B includes the lower portion inserted into the cylinder tube 287A, and is supported by the cylinder tube 287A to be capable of vertically moving. That is, the gas cylinder 287 can be extended and retracted in the length direction by the vertical movement (extending and retracting movements) of the piston rod 287B with respect to the cylinder tube 287A. An upper portion of the piston rod 287B is connected to the attachment base 93.

The gas cylinder 287 is also referred to as a gas spring. For example, a non-flammable high-pressure gas such as nitrogen gas is sealed in the air-tight inside of the cylinder tube 287A, and a reaction force of the gas functions as a spring to push the piston rod 287B in the direction of extending from the cylinder tube 287A. The gas cylinder 287 is a locking gas cylinder provided with a stroke lock mechanism so that the gas cylinder 287 can be fixed at any optional length (extending and retracting of the gas cylinder 287 can be fixed at any position). That is, the piston rod 287B can be stopped at any position in the length direction with respect to the cylinder tube 287A. That is, the length of the gas cylinder 287 can be adjusted in stepless. By adjusting the length of the gas cylinder 287, the height of the attachment base 93 can be adjusted. This allows the height of the manipulator 82 to be adjusted in correspondence to the height of an operator. Adjusting the height of the manipulator 82 improves an operator's working posture and reduces fatigue of the operator.

Figure 15B:
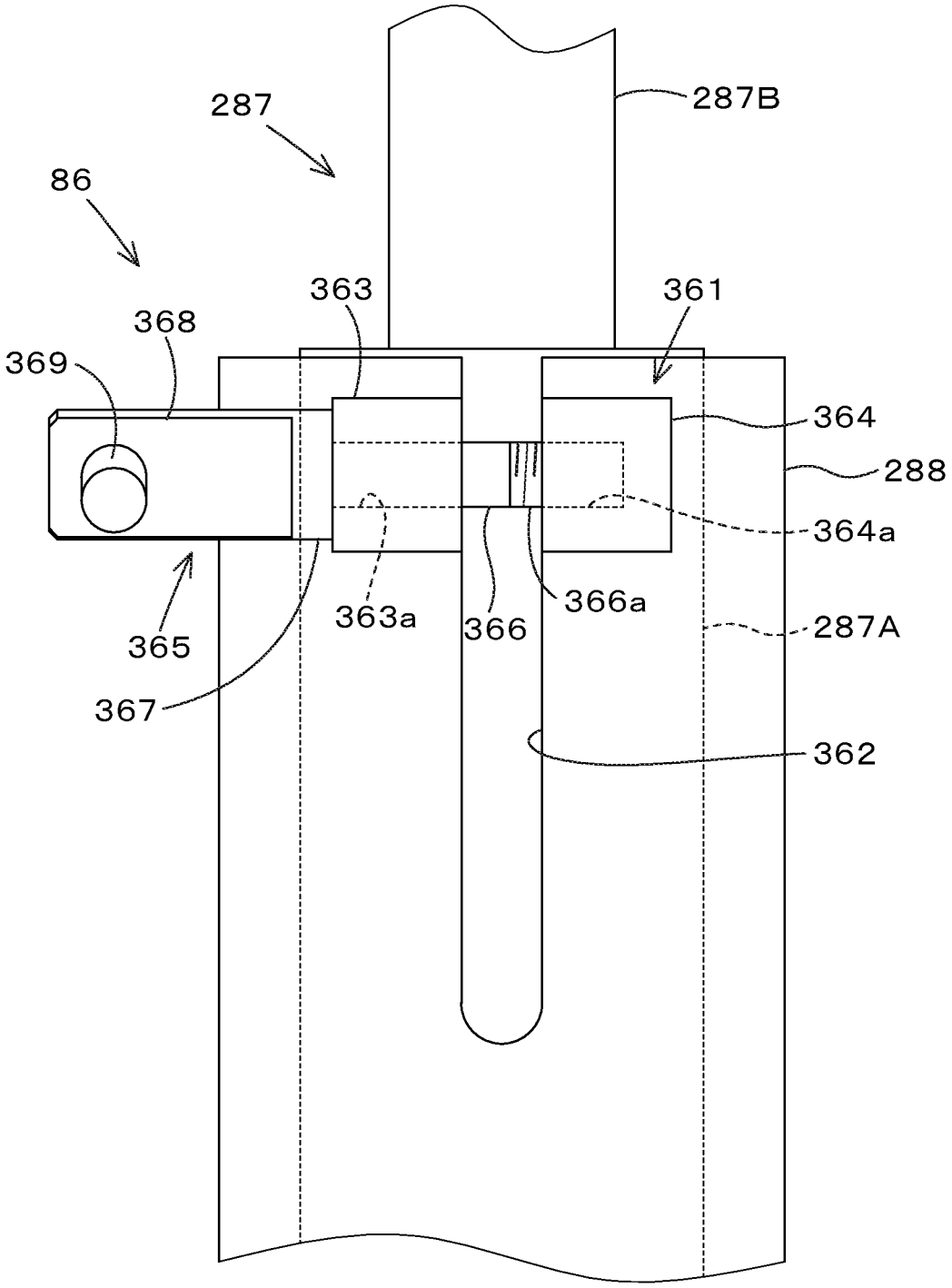
FIG. 15B is a side view illustrating a fixing portion.
Figure 15C:
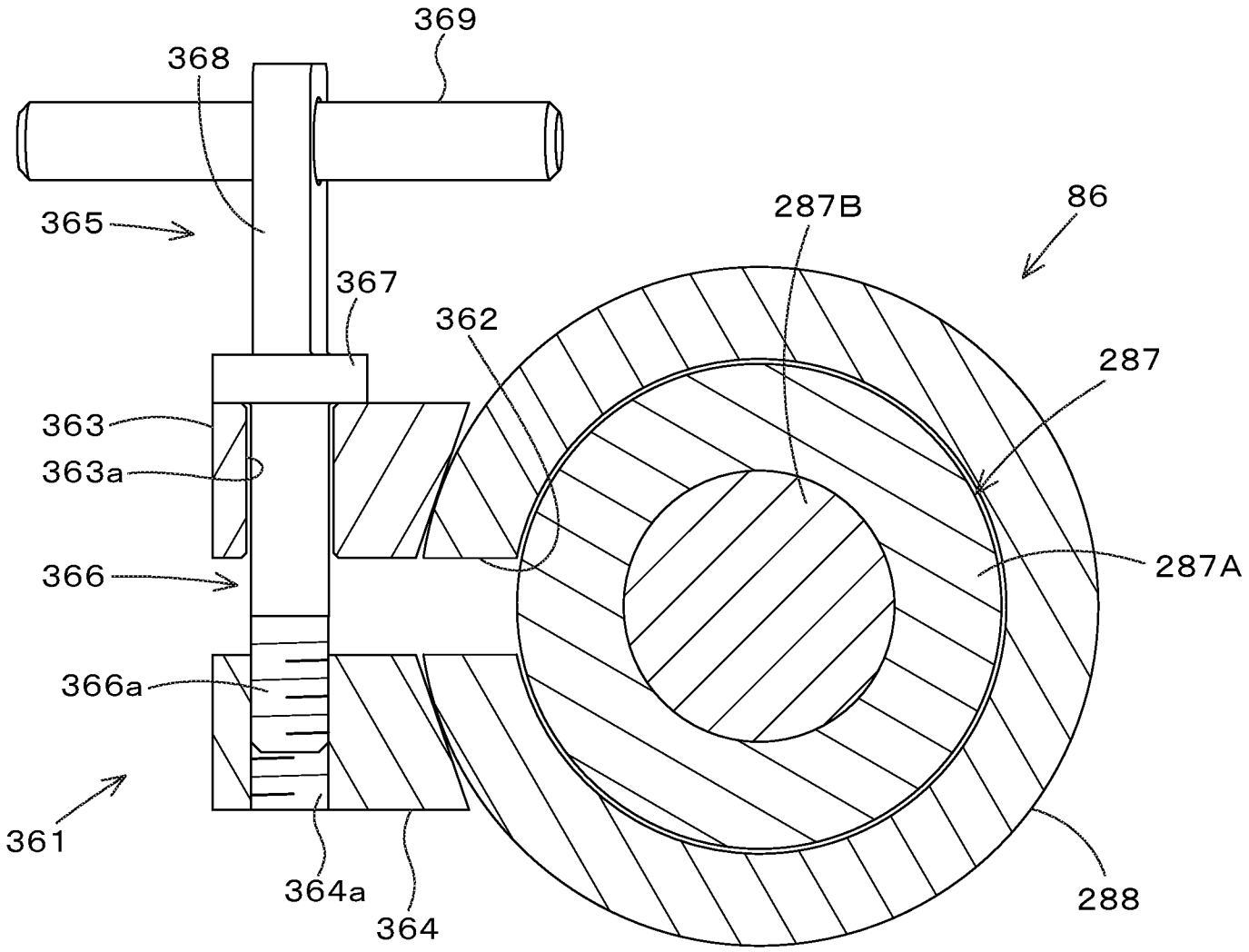
FIG. 15C is a plan cross-section view illustrating the fixing portion.

As shown in FIGS. 15B and 15C, the elevation device 86 may include a fixing portion 361 configured to fix the gas cylinder 287 (cylinder tube 287A) to the support pipe 288.

The fixing portion 361 is, for example, provided on an upper right side portion of the support pipe 288. The fixing portion 361 includes a slit 362 formed in the support pipe 288, a first member 363 adjacent to one width-directional side of the slit 362, a second member 364 adjacent to the other width-directional side of the slit 362, and a fixture tool 365 to bring the first member 363 and the second member 364 into proximity.

The slit 362 is formed to have a predetermined length extending downward from the upper end of the support pipe 288 and along the axial direction of the support pipe 288. The first member 363 and the second member 364 are arranged facing each other at the upper portion side of the slit 362 to sandwich the slit 362 and are fixed to the support pipe 288.

The first member 363 is penetrated by an insertion hole 363*a* in a direction parallel to the width direction of the slit 362. The second member 364 includes a threaded hole 364*a* in a direction parallel to the width direction of the slit 362.

The fixture tool 365 includes a threaded shaft portion 366, a contacting portion 367 formed integrally with the threaded shaft portion 366, an extending portion 368 extending from the contacting portion 367, and an operation handle 369 provided on the extending portion 368. The threaded shaft portion 366 includes a male threaded portion 366*a* that is screwed into the threaded hole 364*a*. The contacting portion 367 contacts one of opposite side surfaces of the first member 363, while the other of the opposite side surfaces of the first member 363 faces the second member 364. The extending portion 368 extends in a direction opposite to the male threaded portion 366*a*.

The fixing portion 361 can bring the first member 363 and the second member 364 into close proximity by grasping the operation handle 369 and rotating the threaded shaft portion 366 in the screwing direction around the axial center. In this manner, the gas cylinder 287 can be fixed to the support pipe 288 so as to be prevented from rattling.

Note that the fixture tool 365 is not limited to the configuration that brings the first member 363 and the second member 364 into proximity by the action of a screw. For example, the fixture tool 365 may have a structure that brings the first member 363 and the second member 364 into close proximity by the action of a cam or the like caused by turning of the operation handle 369.

Figure 16A:
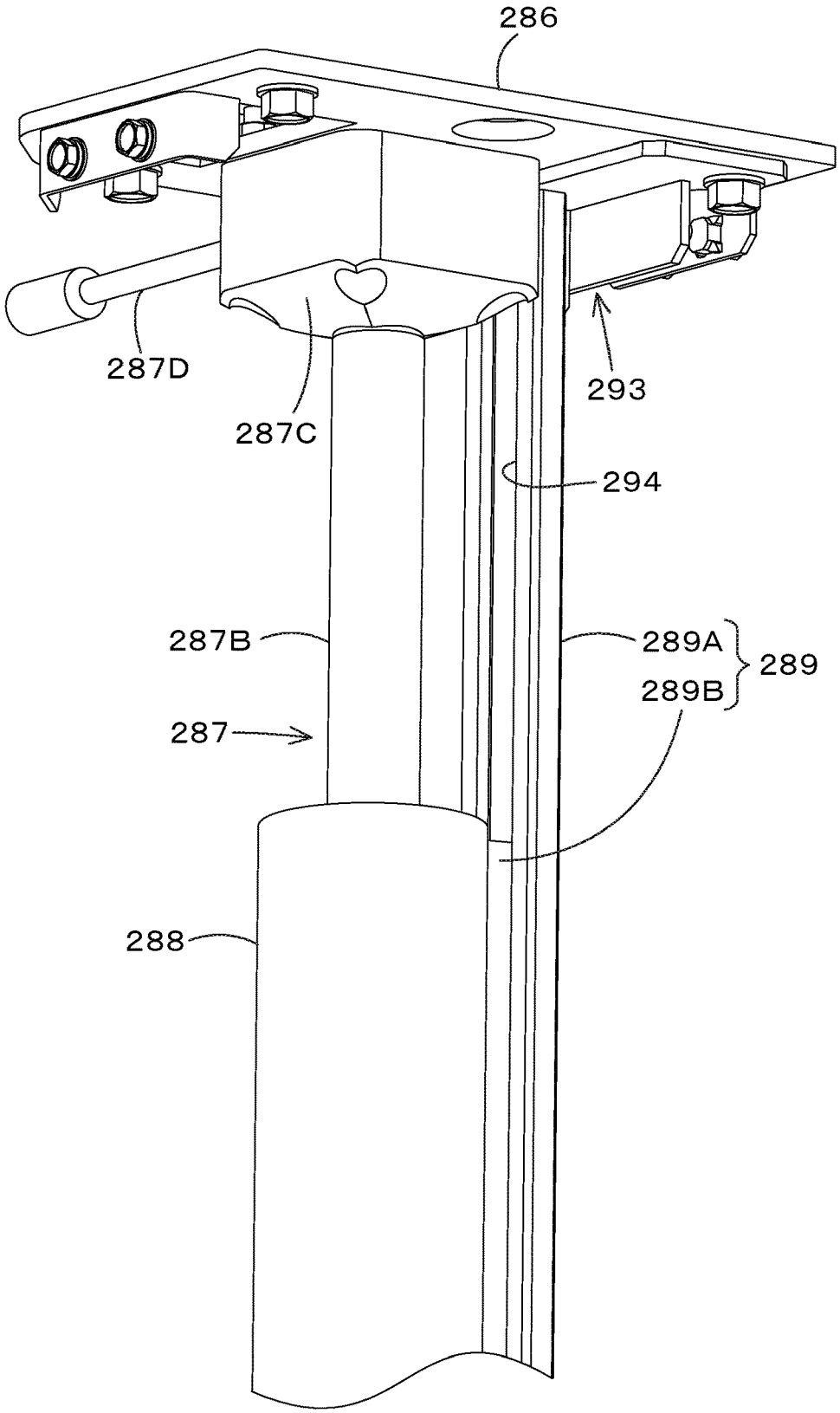
FIG. 16A is a diagonal view of the elevation device seen from the lower back.

As shown in FIG. 14, an upper portion (tip end portion) of the piston rod 287B is defined as a head 287C, and the head 287C is attached to the lower surface of the attachment plate 286. The attachment plate 286 is attached to the lower surface of the attachment base 93. Accordingly, the piston rod 287B is connected to the attachment base 93 via the head 287C and the attachment plate 286. As shown in FIG. 16A, the head 287C is provided with a lock release lever 287D. The lock release lever 287D is a member configured to release the stop of the piston rod 287B with respect to the cylinder tube 287A. In detail, the lock release lever 287D is interlockingly connected to an unlocking pin inserted in the piston rod 287B. By pulling up or pushing down the lock release lever 287D, the restraint on the movement of the piston rod 287B with respect to the cylinder tube 287A is released, so that the piston rod 287B becomes capable of moving with respect to the cylinder tube 287A. When the operating force on the lock release lever 287D is released, the lock release lever 287D returns to its original position, and the piston rod 287B becomes incapable of moving with respect to the cylinder tube 287A.

Figure 17:
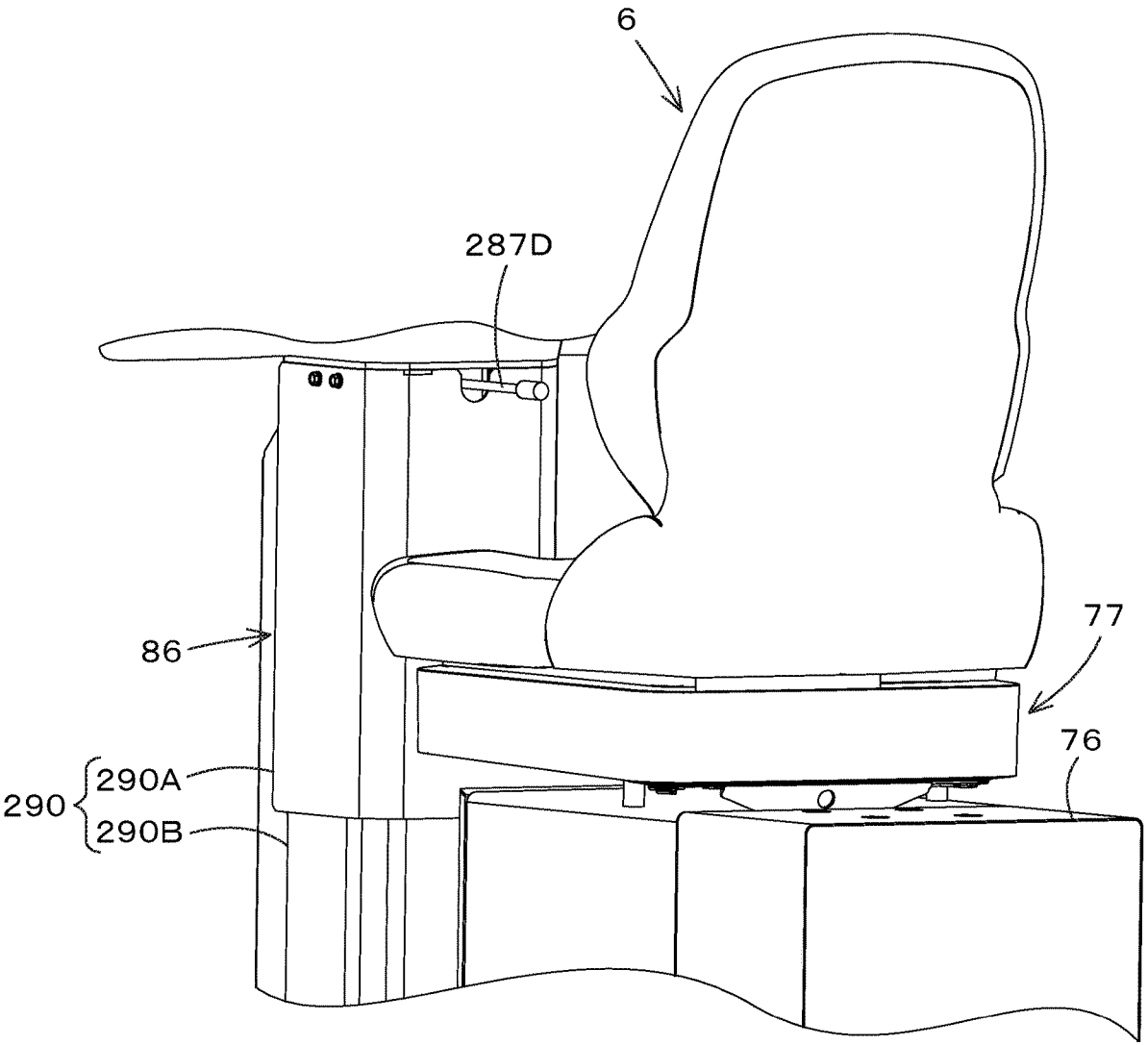
FIG. 17 is a diagonal view of the elevation device seen from the left back.

As shown in FIG. 17, the lock release lever 287D extends from the head 287C toward the driver seat 6, so that the operator sitting on the driver seat 6 can easily operate the lock release lever 287D.

As shown in FIG. 16A, the anti-rotation mechanism 289 includes a guide member 289B attached to the support pipe 288 and a slide member 289A attached to the attachment plate 286. The guide member 289B is located on the left side of the support pipe 288 to extend in the vertical direction, and is fixed to the support pipe 288. The guide member 289B extends from the upper portion to the lower portion of the support pipe 288.

The slide member 289A is located on the left side of the guide member 289B, and protrudes upward from the guide member 289B. An upper portion of the guide member 289B is attached to the lower surface of the attachment plate 286 via the attachment member 293. Accordingly, the slide member 289A is attached to the attachment base 93 via the attachment plate 286, thereby being configured to move up and down integrally with the attachment base 93. The slide member 289A is formed in a right side portion thereof with a rightwardly open engagement groove 284 extending in the vertical direction. The guide member 289B is fitted in the engagement groove 284 vertically movably relative to the slide member 289A (see FIG. 19). In this manner, the vertical movement of the slide member 289A is guided by the guide member 289B while the rotation of the attachment plate 286 and the attachment base 93 around the axis of the piston rod 287B is restricted.

As shown in FIG. 14, the lifter cover 290 includes a movable cover 290A at an upper portion thereof and a fixed cover 290B at a lower portion thereof. The movable cover 290A covers the upper portion of the gas cylinder 287, and the fixed cover 290B covers the lower portion of the gas cylinder 287. The movable cover 290A includes a main cover 290Aa covering left, right and back sides of the gas cylinder 287, and a front cover 290Ab covering a front side of the gas cylinder 287. The movable cover 290A is attached to the attachment plate 286, and moves up and down integrally with the attachment plate 286 and the attachment base 93. The fixed cover 290B stands on the floor portion 5B, and covers left, right and back sides of the gas cylinder 287. The fixed cover 290B is open at its front surface. An upper portion of the fixed cover 290B is inserted into a lower portion of the movable cover 290A, and the movable cover 290A and the fixed cover 290B overlap each other to allow their relative movement in the vertical direction.

Figure 16B:
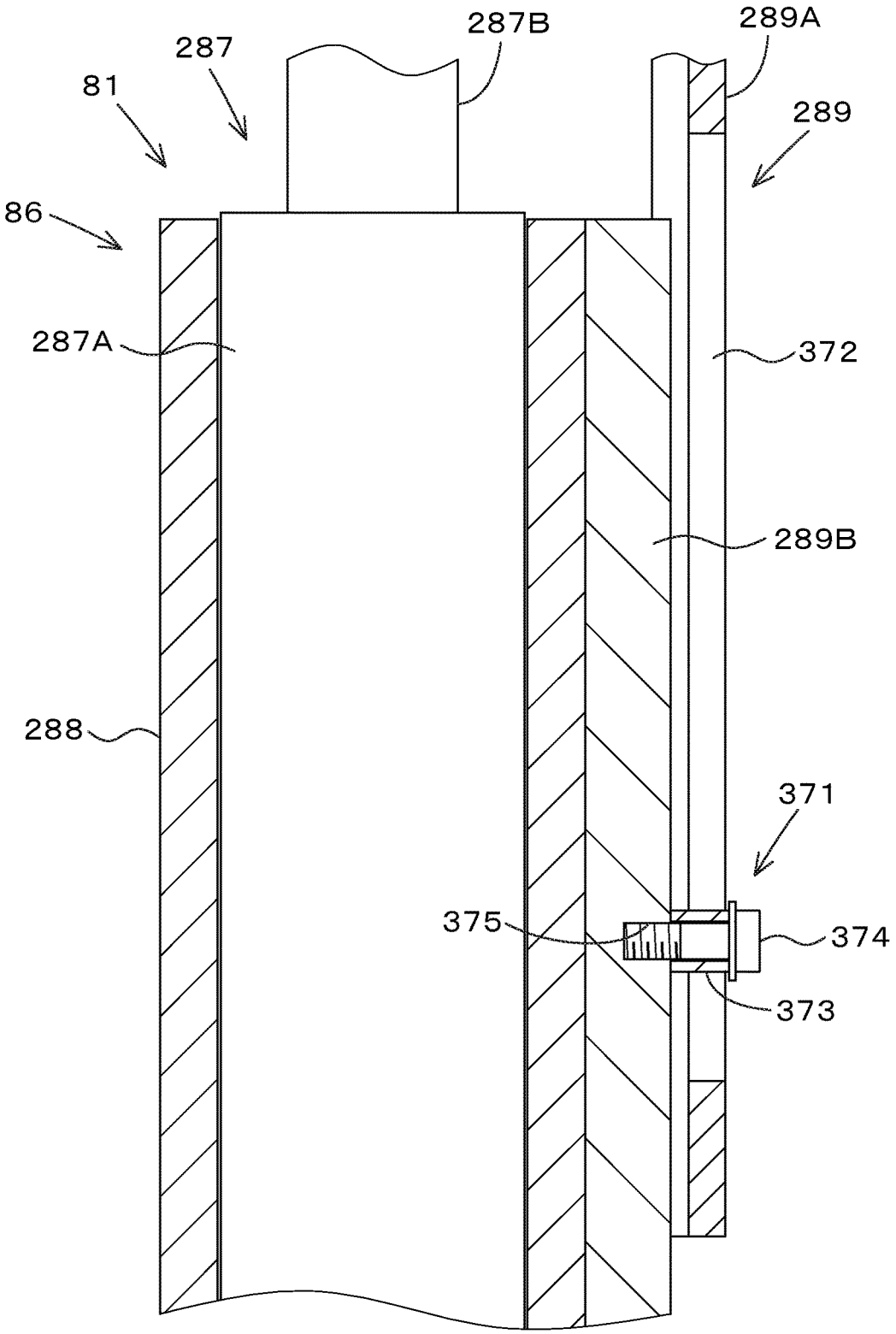
FIG. 16B is a front cross-section view illustrating a vertical movement limiter.
Figure 16C:
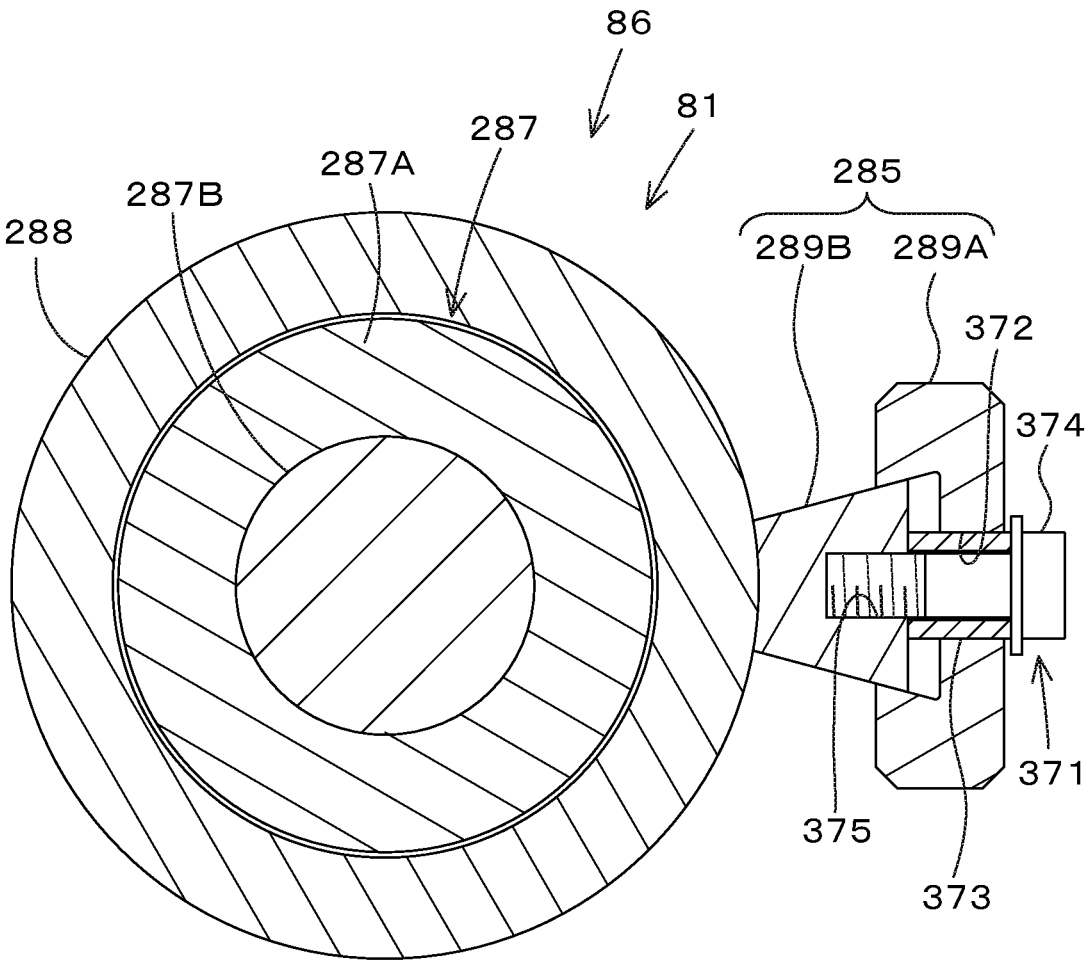
FIG. 16C is a plan cross-section view illustrating the vertical movement limiter.

As shown in FIGS. 16B and 16C, the elevation device 86 may include a vertical movement limiter 371 that defines the extending and retracting limits of the gas cylinder 287.

The vertical movement limiter 371 is provided, for example, in the anti-rotation mechanism 289. In detail, the vertical movement limiter 371 includes a long hole 372 formed in the slide member 289A and a regulation member 373 attached to the guide member 289B.

The long hole 372 is formed in a predetermined length in the length direction (vertical direction) of the slide member 289A. In addition, the long hole 372 is formed to penetrate through the slide member 289A.

The regulation member 373 is inserted through the long hole 372, and is in contact with the side surface (left side surface) of the guide member 289B. The regulation member 373 is attached to the guide member 289B with a bolt 374. The bolt 374 penetrates through the regulation member 373, and is screwed into a threaded hole 375 formed in the guide member 289A. The regulation member 373 slightly protrudes from the long hole 372 in the direction opposite to the guide member 289B, and is formed such that the fastening force of the bolt 374 does not reach the slide member 289A. The regulation member 373 may be attached to the guide member 289B by welding, riveting, or the like.

Due to the vertical movement limiter 371, the extending limit of the gas cylinder 287 is defined by a lower end of the long hole 372 when contacting a lower end of the regulation member 373, and the retracting limit of the gas cylinder 287 is defined by an upper end of the long hole 372 when contacting an upper end of the regulation member 373. The extending limit of the gas cylinder 287 defines an uppermost movement position of the attachment base 93, and the retracting limit of the gas cylinder 287 defines a lowermost movement position of the attachment base 93. Accordingly, the vertical movement limiter 371 defines the uppermost movement position and the lowermost movement position of the attachment base 93 as respective predetermined positions.

As shown in FIG. 13, the manipulator 82 includes a first manipulator handle 82L and a second manipulator handle 82R. The first manipulator handle 82L is provided on a portion (left portion) of the main portion 93A on one side of the center in the machine width direction K2. The second steering handle 82R is provided on another portion (right portion) of the main portion 93A on the other side of the center in the machine width direction K2 and sideward from the first steering handle 82L. The first manipulator handle 82L and the second manipulator handle 82R are supported on the attachment base 93 to be pivotally operable, and are configured to be operated back and forth (in the fore-and-aft direction K1), left and right (in the machine width direction K2), and in any diagonal directions between the fore-and-aft direction K1 and the machine width direction K2.

As shown in FIG. 12, the first and second manipulator handles 82L and 82R include respective pivot fulcrums W1 located inside thereof. Accordingly, a structure including the first and second manipulator handles 82L and 82R and a support mechanism to support the manipulator handles is compact with a low height. In this manner, the structure reduces hand operation amounts of the first and second manipulator handles 82L and 82R so that the first and second manipulator handles 92L and 82R can be operated stably even when the machine body 2 is shaken.

The at least one armrest 83 is a member on which an operator places his/her elbow. As shown in FIG. 13, the at least one armrest 83 is provided on the attachment base 93. The at least one armrest 83 extends from the attachment base 93 (steering console 81) toward the driver seat 6. In the present embodiment, the at least one armrest 83 extends rearward from the rear side of the manipulator 82.

The at least one armrest 83 includes a first armrest 83L and a second armrest 83R. The first armrest 83L extends rearward from a rear portion of the first manipulator handle 82L. In detail, the first armrest 83L extends in a rearwardly machine-outward (leftward) direction from the rear side of the first steering handle 82L. The first armrest 83L is located above the first extending portion 93L and along the first extending portion 93L. The first armrest 83L is attached to the first extending portion 93L via a support member 103L.

The second armrest 83R extends rearward from the rear side of the second steering handle 82R. In detail, the second armrest 83R extends in a rearwardly machine-inward (rightward) direction from a rear side of the second manipulator handle 82R. The second armrest 83R is located above the second extending portion 93R and along the second extending portion 93R. The second armrest 83R is attached to the second extending portion 93R via a support member 103R.

In the manipulation device 41 according to the embodiment, an operator places an elbow of his/her left arm on the first armrest 83L and grasps the first manipulator handle 82L with his/her left hand, and places an elbow of his/her right arm on the second armrest 83R and grasps the second steering handle 82R with his/her right hand. Accordingly, the operator operates the manipulator 82 with his/her upper body in a forward leaning posture while sitting on the driver seat 6. In this manner, the operator takes a posture to operate the first manipulator handle 83L and the second manipulator handle 83R with his/her upper body close to the front surface of the cabin 5. By positioning the manipulator 82 and the armrests 83 in front of the driver seat 6, the left and right sides of the cabin 5 are brought closer to the driver seat 6, thereby minimizing the cabin 5 in the machine width direction K2. In addition, the manipulation device 41 (manipulator console 81) and the operator seat 6 are arranged in close proximity in the fore-and-aft direction, the operator seat 6 is brought closer to the manipulation device 41, thereby minimizing the operator section 42 (cabin 5) in the fore-and-aft direction.

As shown in FIG. 13, the monitor 84 is provided between the first manipulator handle 82L and the second manipulator handle 82R on the attachment base 93. The monitor 84 is located in front of an operator who grasps the first manipulator handle 82L and the second manipulator handle 82R to operate the working machine 1 with the forward tilting posture. The monitor 84 is provided with a display (screen) 84A on its rear side (facing the operator seat 6). The display 84A is configured to display basic information of the working machine 1, images of the surroundings of the working machine 1, information necessary for making various settings of the working machine 1, and the like. The basic information includes, for example, operation statuses, mode changings, various settings, warnings, a remaining fuel level, a time (clock time), and the like. The image of the surroundings of the working machine 1 includes, for example, an image behind the working machine 1. The information required for various settings of the working machine 1 includes, for example, the information required for machine settings such as height control settings, AI control settings, arm restriction settings.

A plurality of operation switches (a first switch 84B, a second switch 84C, and a third switch 84D) are provided on a side of the display 84A of the monitor 84 facing the operator seat 6. The first switch 84B is, for example, a switch to change a revolving speed of the prime mover E1. The second switch 84C is, for example, a switch to set a working speed of the working machine 1. The working speed is, for example, pivoting speeds of the boom 22, the arm 23, the bucket 24, and the swing bracket 21, and the swiveling speed of the machine body 2. The third switch 84D is a switch to turn on and off lights provided on the working machine 1, for example, a boom light, a front light, a rear light, and the like.

As shown in FIG. 13, a plurality of operation tools (a first operation tool 40A, a second operation tool 40B, and a third operation tool 40C) for operating items to be displayed on the screen are provided on the left side of the first manipulator handle 82L (monitor 84). For example, the first operation tool 40A is rotationally operable to change a selection candidate among the plurality of selection items to be displayed on the display 84A. The selection item is determined by pressing the third control tool 40C. The second control tool 40B is pressing-operable to cancel the determined selection item. The operator can easily move his/her hand from the manipulator 82 to the monitor 84 (the display 84A, the first switch 84B, the second switch 84C, the third switch 84D, or the like) with his/her elbow placed on the armrest member 83 (centered on the elbow). Also, the display portion 84A, the first switch 84B, the second switch 84C, the third switch 84D, and the like are operable by an operator with his/her hand while placing his/her elbow on the armrest 83. A stopper switch 102 for stopping the prime mover E1 is provided on the right side of the second manipulator handle 82R (monitor 84).

The traveling operation device 85 is a foot-stepping operable pedal to operate the traveling device 3. As shown in FIG. 13, the traveling operation device 85 includes a first traveling pedal 85L located in front of one side portion of the operator seat 6 in the machine width direction K2, and a second traveling pedal 85R located in front of the other side portion of the operator seat 6 in the machine width direction K2. The first traveling pedal 85L is a pedal to operate the first traveling device 3L (i.e., the first traveling motor M1). The second traveling pedal 85R is a pedal to operate the second traveling device 3R (i.e., the second traveling motor M2). That is, the first traveling pedal 85L and the second traveling pedal 85R are pedals to operate the forward and rearward traveling of the working machine 1 and operate the steering of the working machine 1.

As shown in FIG. 13, a speed reduction switch 106 for reducing the traveling speed of the working machine 1 is provided on the first manipulator handle 82L, and the speed increasing switch 107 for increasing the traveling speed of the working machine 1 is provided on the second manipulator handle 82R.

As shown in FIGS. 4 and 6, foot rests 79 on which an operator's foot is placed are provided on the floor portion 5B on lateral sides of the operator seat 6 (and the seat stand 77). The foot rests 79 include a first rest 79L located on one lateral side (a left side) of the operator seat 6 and the seat stand 77, and a second rest 79R on the other lateral side (a right side) of the operator seat 6 and the seat stand 77.

As shown in FIG. 6, the first traveling pedal 85L is located in front of the first portion 79L, and the second traveling pedal 85R is located in front of the second portion 79R. There is no obstacle to foot movement between the first traveling pedal 85L and the first portion 79L, and the foot can move on the floor portion 5B from the first traveling pedal 85L to the first portion 79L. In addition, there is no obstacle to the foot movement between the second traveling pedal 85R and the second portion 79R, and the foot can move on the floor portion 5B from the second traveling pedal 85R to the second portion 79R.

The dozer lever 80 is an operation lever for operating the dozer 7.

As shown in FIG. 4, an air-conditioner body 63 which is a main body of an air conditioner is provided below the driver seat 6. The air conditioner body 63 is installed on the floor portion 5B. The air conditioner body 63 includes an evaporator and an air blower fan. The air-conditioned air blown from the air conditioner body 63 is distributed through a duct structure body 296, and is blown out to the inner surface of the front window 5C. The duct structure body 296 extends forward below the manipulation device 41 (or the manipulator console 81), and stands between the manipulation device 41 and the front window 5C.

Figure 18A:
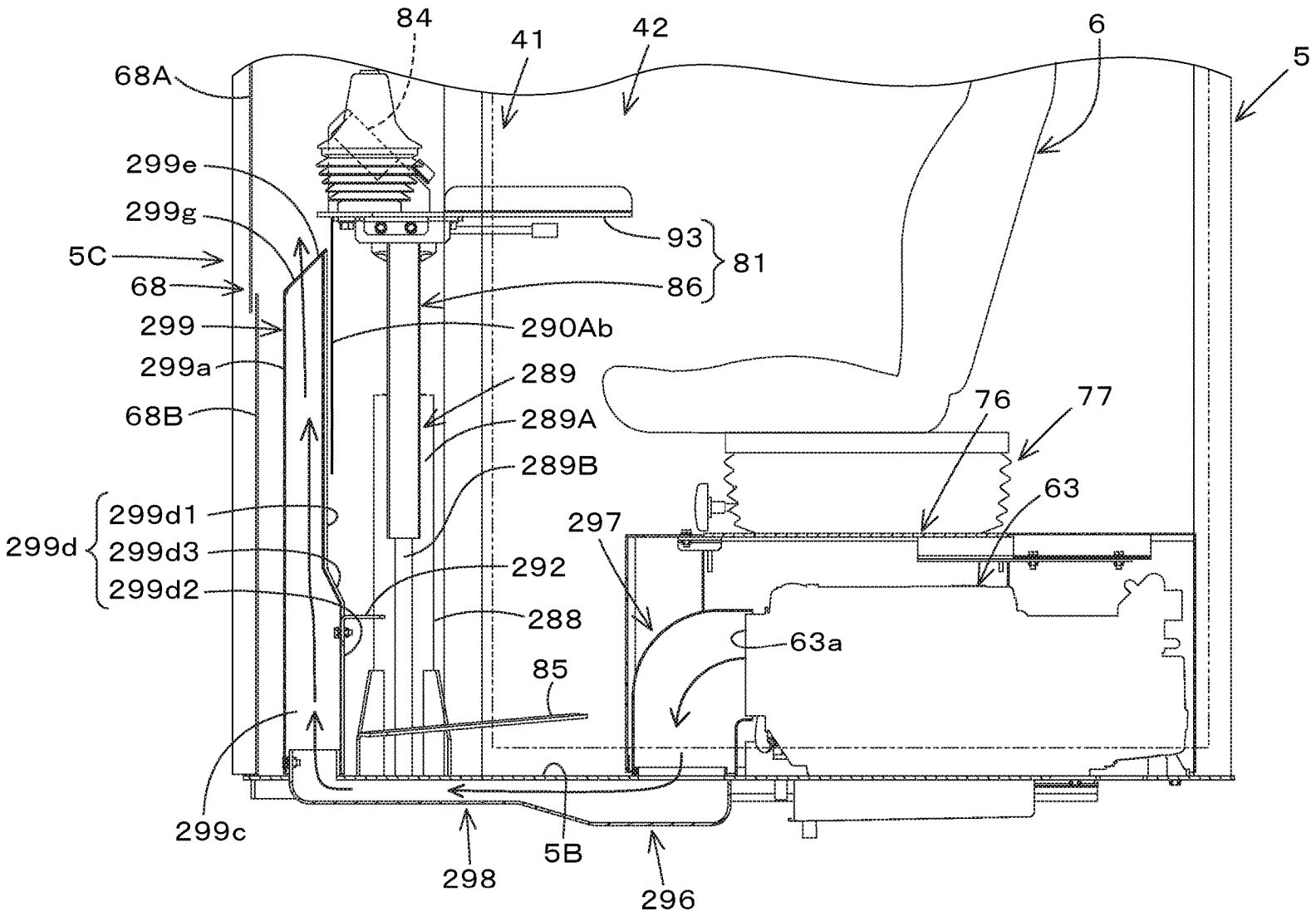
FIG. 18A is a partial cross-section side view illustrating a lower portion of the operator section.
Figure 18B:
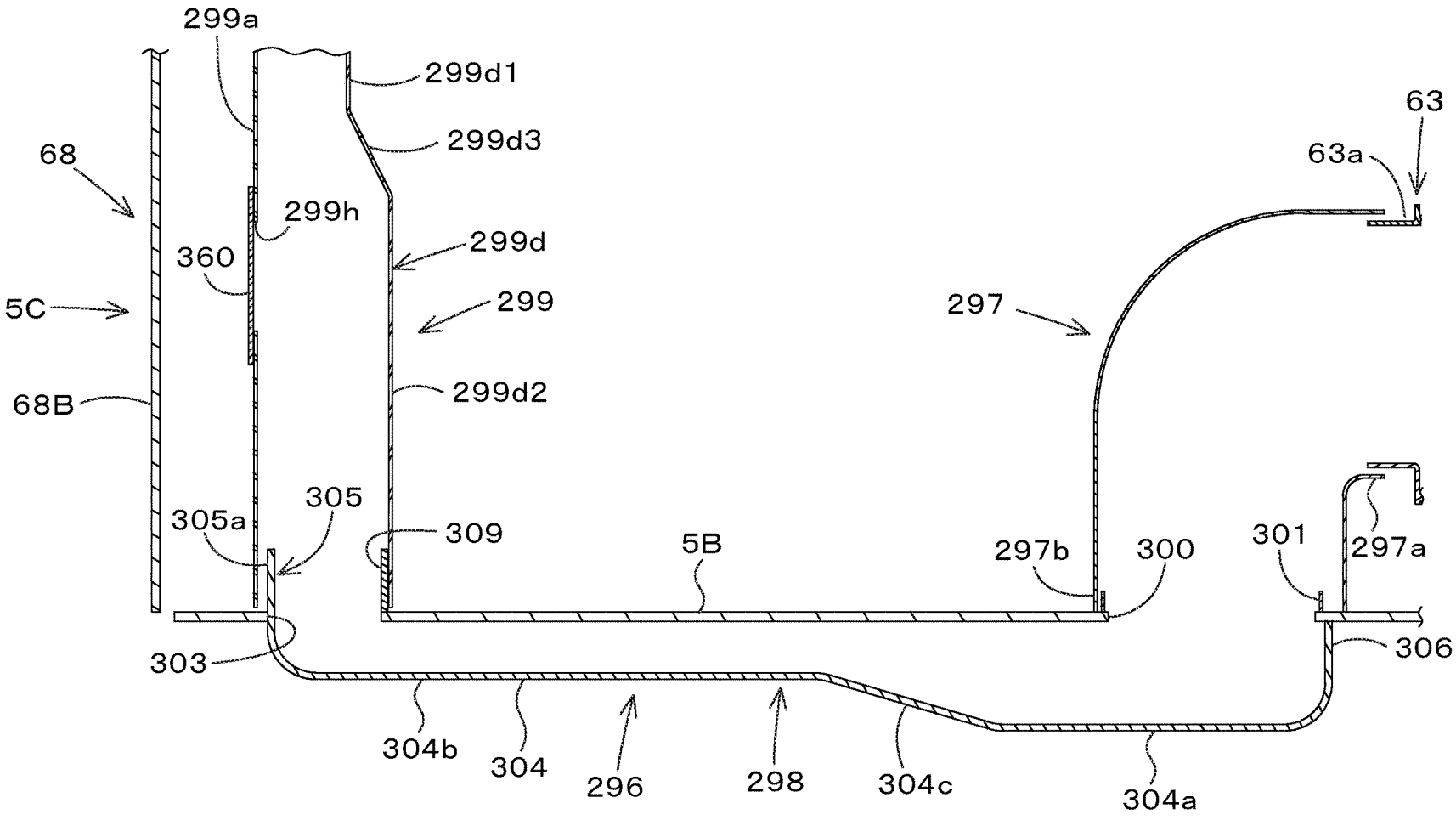
FIG. 18B is a side cross-section view of a duct structural body.

Describing the duct structure body 296 in detail, as shown in FIGS. 4, 18A, and 18B, the duct structure body 296 includes a first duct 297, a second duct 298 and a third duct 299. The first duct 297 is connected to a blowing outlet 63*a* of the air-conditioner body 63. The second duct 298 is located below the floor portion 5B and is extended forward to be connected to the first duct 297. The third duct 299 is provided between the manipulation device 41 and the front window 5C and is connected to the second duct 298. As shown by arrowed lines in FIG. 18A, the air-conditioned air blown from the air conditioner body 63 flows from the first duct 297 to the third duct 299 through the second duct 298, and is blown out to the front window 5C.

Figure 19:
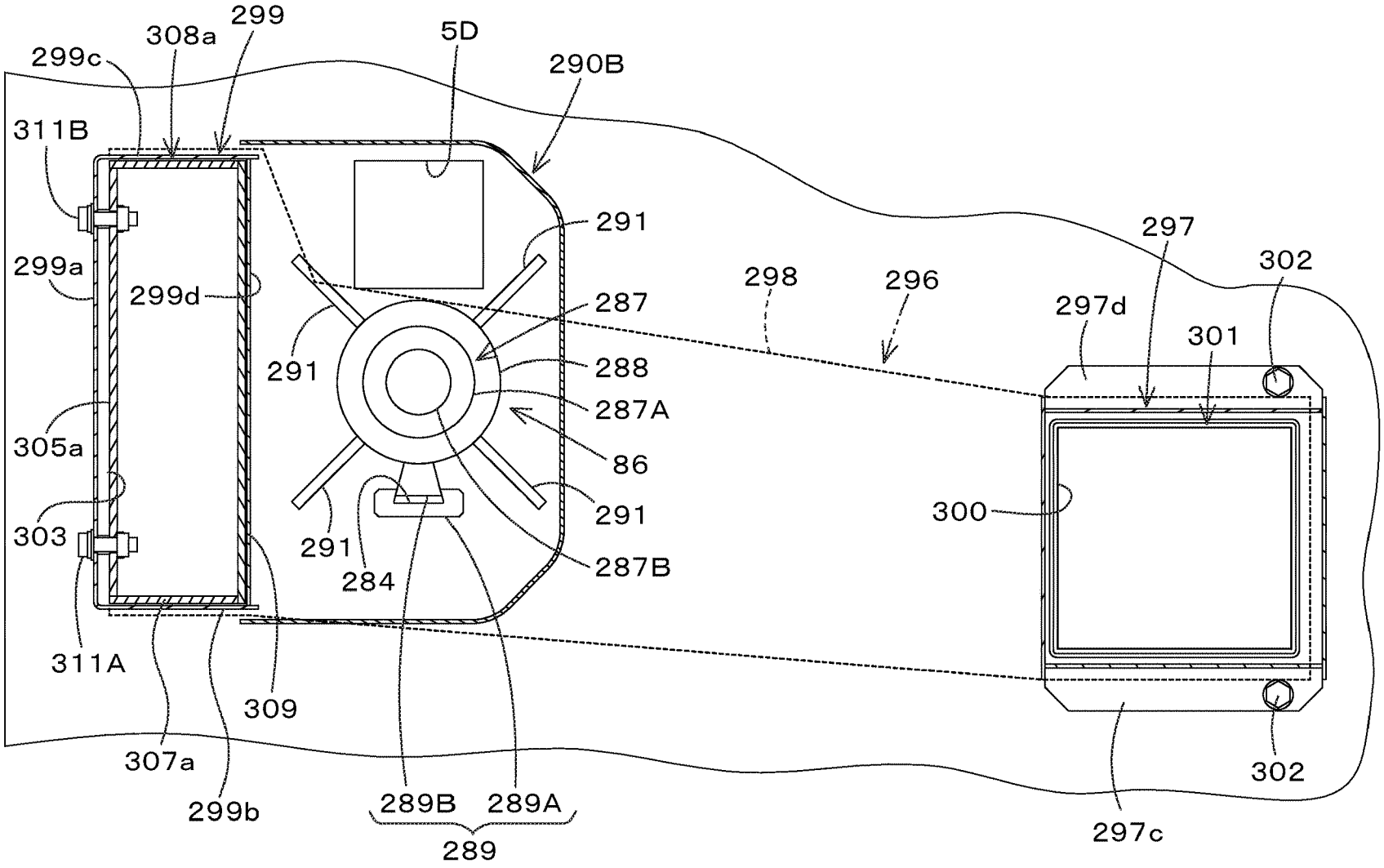
FIG. 19 is a partial cross-section view of a plane surface of the duct structural body.

As shown in FIG. 18B, the first duct 297 includes, at an upper portion thereof, a connector portion (a first connector portion) 297*a* that opens rearward and is connected to the blowing outlet 63*a*. In addition, the first duct 297 includes, at the lower portion, a connector portion (a second connector portion 297*b*) that opens downward. The second connector portion 297*b* is in contact with the floor portion 5B. As shown in FIG. 19, the first duct 297 includes a flange portion 297*c* extending leftward from the second connector portion 297*b*, and a flange portion 297*d* extending rightward from the second connector portion 297*b*. The flange portions 297*c* and 297*d* are attached to the floor portion 5B with bolts 302.

As shown in FIG. 18B, the second connector portion 297*b* is connected to a rectangular first opening 300 formed through the floor portion 5B. A rectangular and annular water-stopper member 301 surrounding the first opening 300 is provided inside the second connector portion 297*b*. The water-stopper member 301 is fixed to the floor portion 5B.

The water-stopper member 301 can prevent water from falling downward (entering the second duct 298) through the first opening 300.

As shown in FIG. 18B, the second duct 298 is located on the lower surface side of the floor portion 5B, and is fixed to the floor portion 5B. In this embodiment, the floor portion 5B also serves as the upper wall of the second duct 298. The second duct 298 connects the first opening 300 to a laterally rectangular second opening 303 formed through a front portion of the floor portion 5B. The second opening 303 is formed in front of the elevation device 86, as shown in FIG. 15. As shown in FIG. 18A, the second duct 298 extends forward from the air conditioner body 63 side below the manipulation device 41. The shape of the second duct 298 in a cross-section perpendicular to its extending direction is a wide rectangular shape in which the direction along the bottom surface of the floor portion 5B is longer than the direction perpendicular to the bottom surface of the floor portion 5B.

Figure 20:
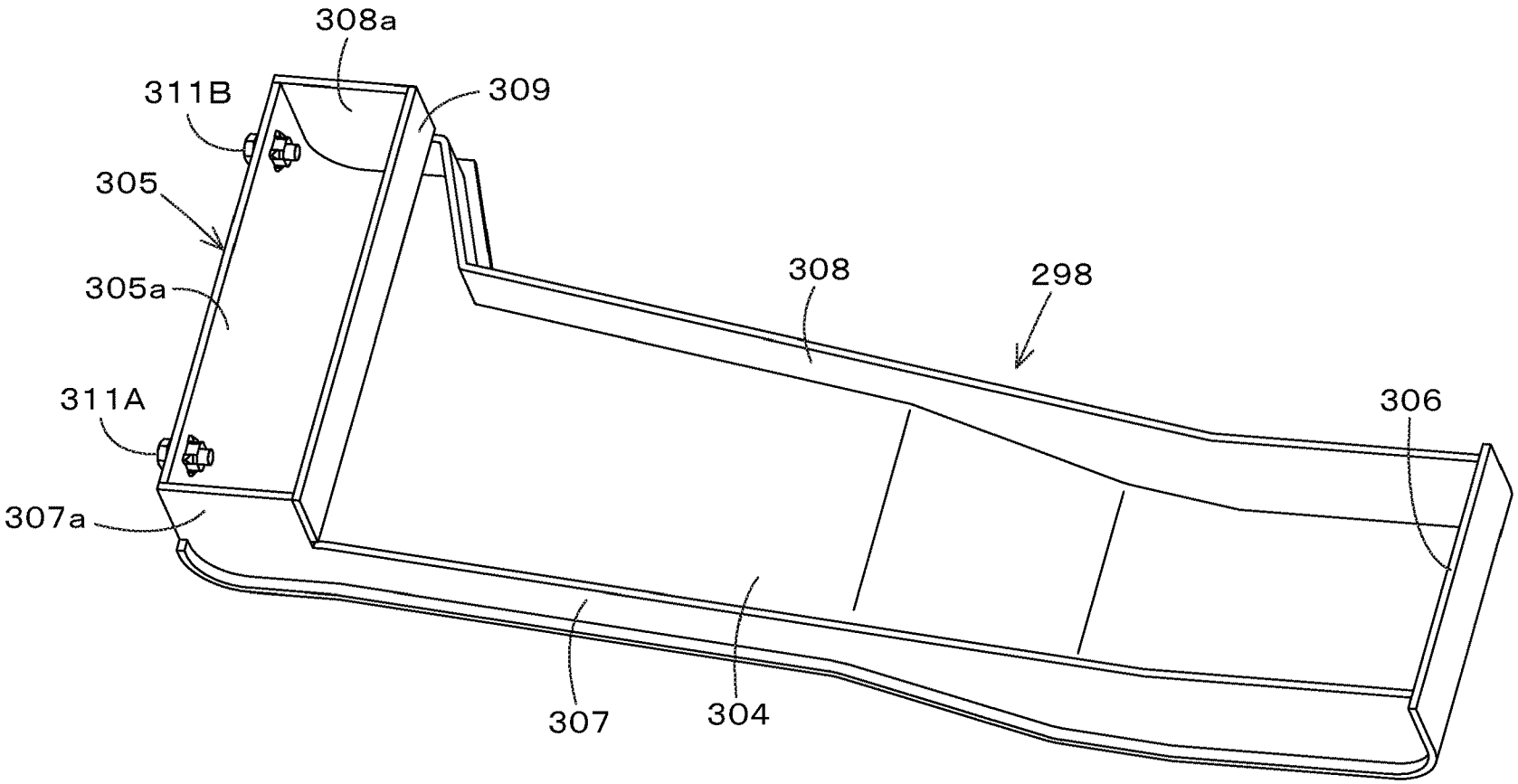
FIG. 20 is a diagonal view of a second duct.

As shown in FIG. 20, the second duct 298 include a bottom plate portion 304, a front plate portion 305, a rear plate portion 306, a first side plate portion 307, and a second side plate portion 308, and is open upward. As shown in FIG. 18B, the bottom plate portion 304 extends from below the first opening 300 to below the second opening 303. The bottom plate portion 304 includes a front portion 304*b*, and a rear portion 304*a* located below the front portion 304*b*. The bottom plate portion 304 includes a forwardly upward inclined wall 304*c* which connects the rear portion 304*a* to the front portion 304*b*.

As shown in FIG. 18B, the front plate portion 305 is integrated with the bottom plate portion 304 so as to extend upward from a front end of the bottom plate portion 304. The front plate portion 305 includes a protruding portion (referred to as a first protruding portion) 305*a* that is fixed in contact with a front edge of the second opening 303 and protrudes upward from the second opening 305. The rear plate portion 306 is integrated with the bottom plate portion 304 so as to extend upward from a rear end of the bottom plate portion 304. An upper end of the rear plate portion 306 is fixed in contact with the lower surface of the floor portion 5B rearward from a rear edge of the first opening 300.

As shown in FIG. 20, the first side plate portion 307 is fixed to the bottom plate portion 304 so as to extend upward from a left end portion of the bottom plate portion 304. The first side plate portion 307 is fixed at a front end portion thereof to the front plate portion 305, and at a rear end portion thereof to the rear plate portion 306. As shown in FIG. 14, the first side plate portion 307 includes a front portion defined as a protruding portion (referred to as a second protruding portion) 307*a* that protrudes above the second opening 303. An upper end of the first side plate portion 307 is fixed in contact with the lower surface of the floor portion 5B rearward from the second protruding portion 307*a*.

The second side plate portion 308 is fixed to the bottom plate portion 304 so as to extend upward from a right end portion of the bottom plate portion 304. The second side plate portion 308 is fixed at a front end portion thereof to the front plate portion 305, and at a rear end portion thereof to the rear plate portion 306. As shown in FIG. 14, the second side plate portion 308 includes a front portion defined as a protruding portion (referred to as a third protruding portion) 308*a* that protrudes above the second opening 303. An upper end of the second side plate portion 308 is fixed in contact with the lower surface of the floor portion 5B rearward from the third protruding portion 308*a*.

As described above, the second duct 298 includes the front portion extended through the second opening 303 and the rear portion extended through the first opening 300, and includes the upper end opening that is located forward of the first opening 300 and rearward of the second opening 303 and is closed by the floor portion 5B.

Figure 21:
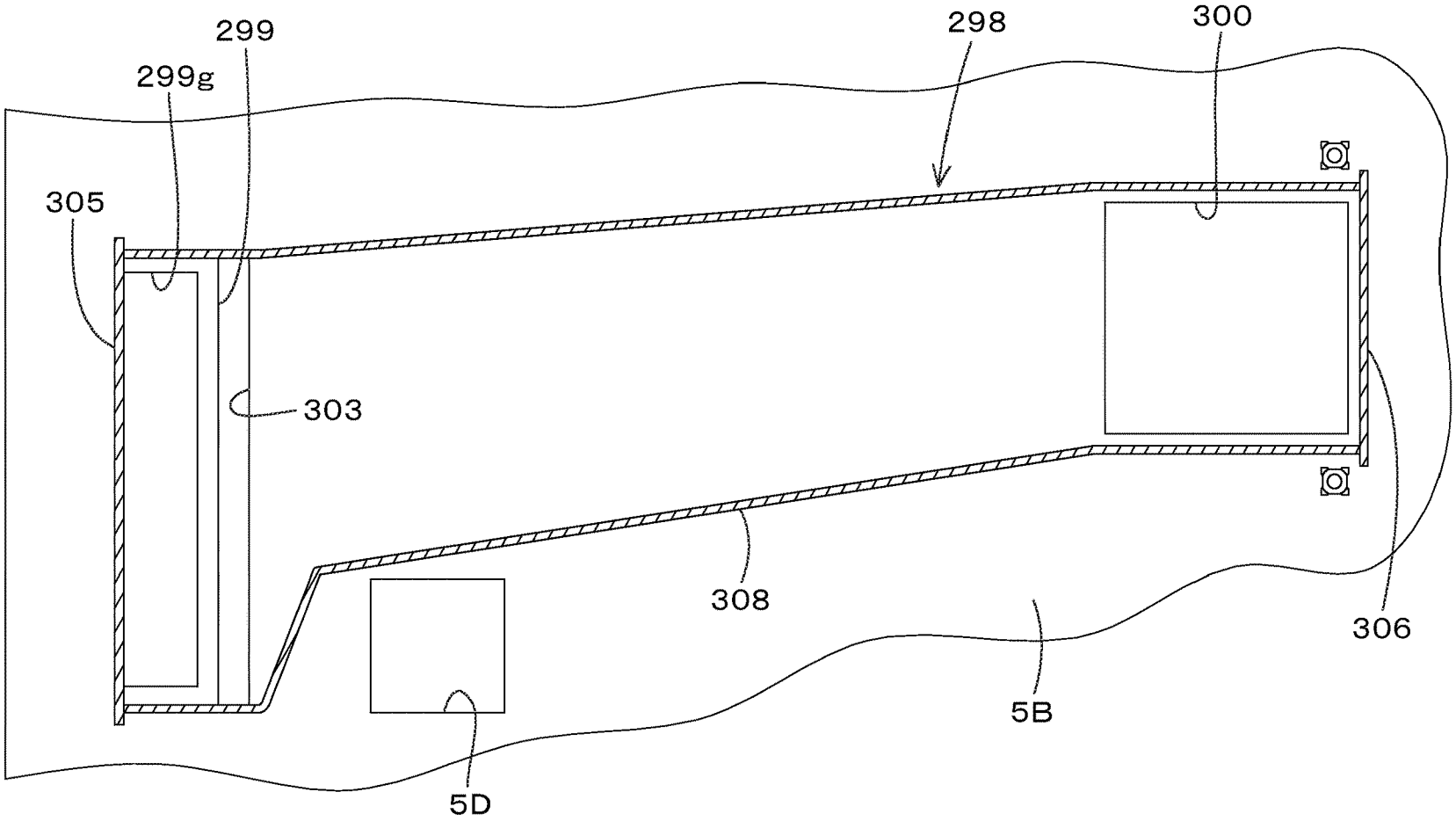
FIG. 21 is a bottom cross-section view illustrating the second duct.

As shown in FIG. 21, a span between the first side plate portion 307 and the second side plate portion 308 gradually becomes wider as extending forward from the front end of the first opening 300, and also widens sharply in front of the through hole SD.

As shown in FIG. 19, a connecting plate 309 is provided on the upper surface of the floor portion 5B and on a rear edge side of the second opening 303 to connect the second protruding portion 307*a* and the third protruding portion 308*a* to each other. As shown in FIG. 14, the first protruding portion 305*a*, the second protruding portion 307*a*, the third protruding portion 308*a*, and the connecting plate 309 define a water-stopper portion having a rectangular ring-shape. This water-stopper portion prevents water from falling downward (entering the second duct 298) through the second opening 303.

Figure 22:
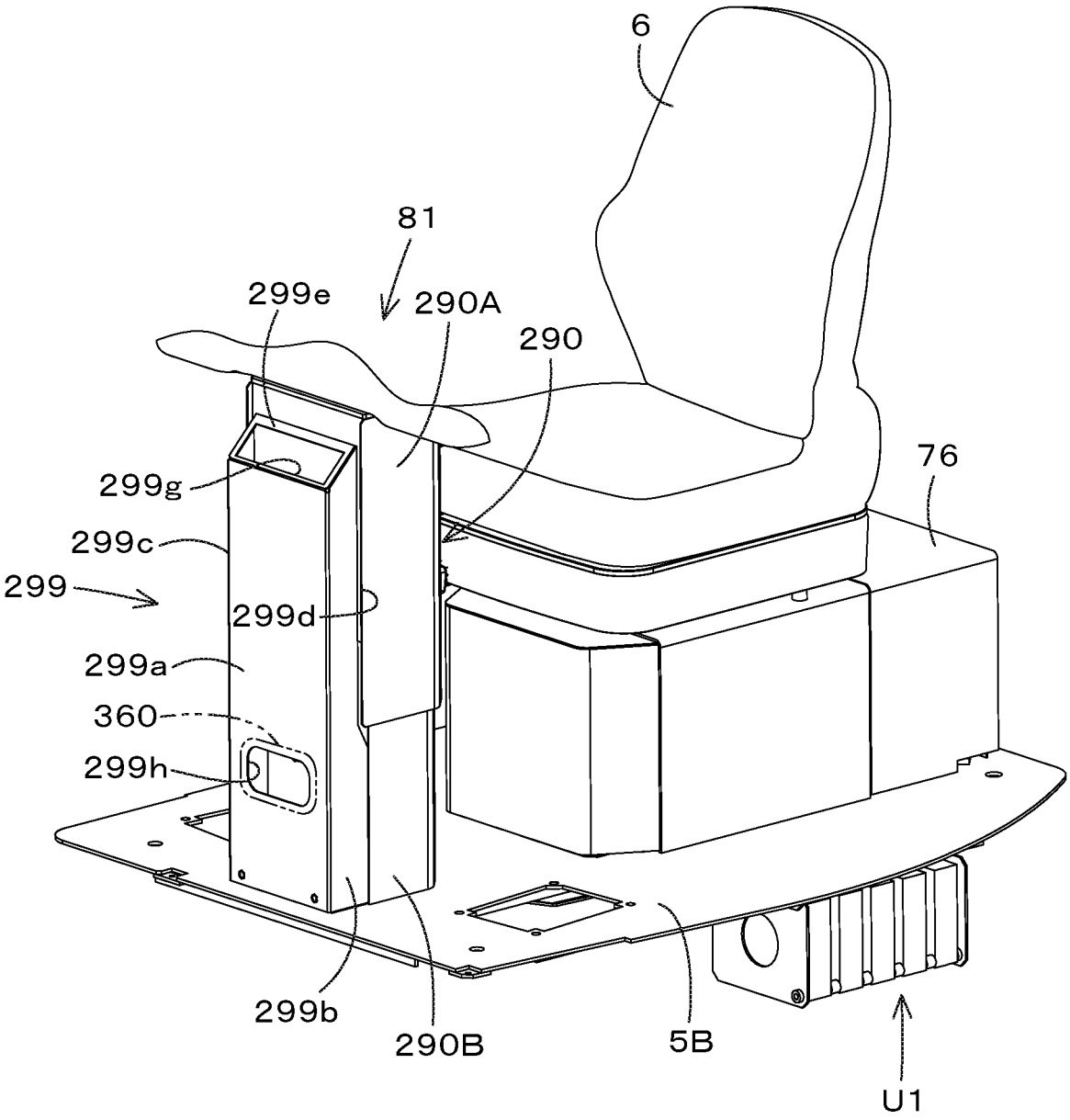
FIG. 22 is a front diagonal view of an attachment portion of a third duct.

As shown in FIG. 22, the third duct 299 is provided adjacently forward of the steering console 81 (or the lifter cover 290). In addition, the third duct 299 is located in proximity to the front window 5C as shown in FIG. 18A. That is, the third duct 299 is located between the manipulation device 41 and the front window 5C.

Figure 23:
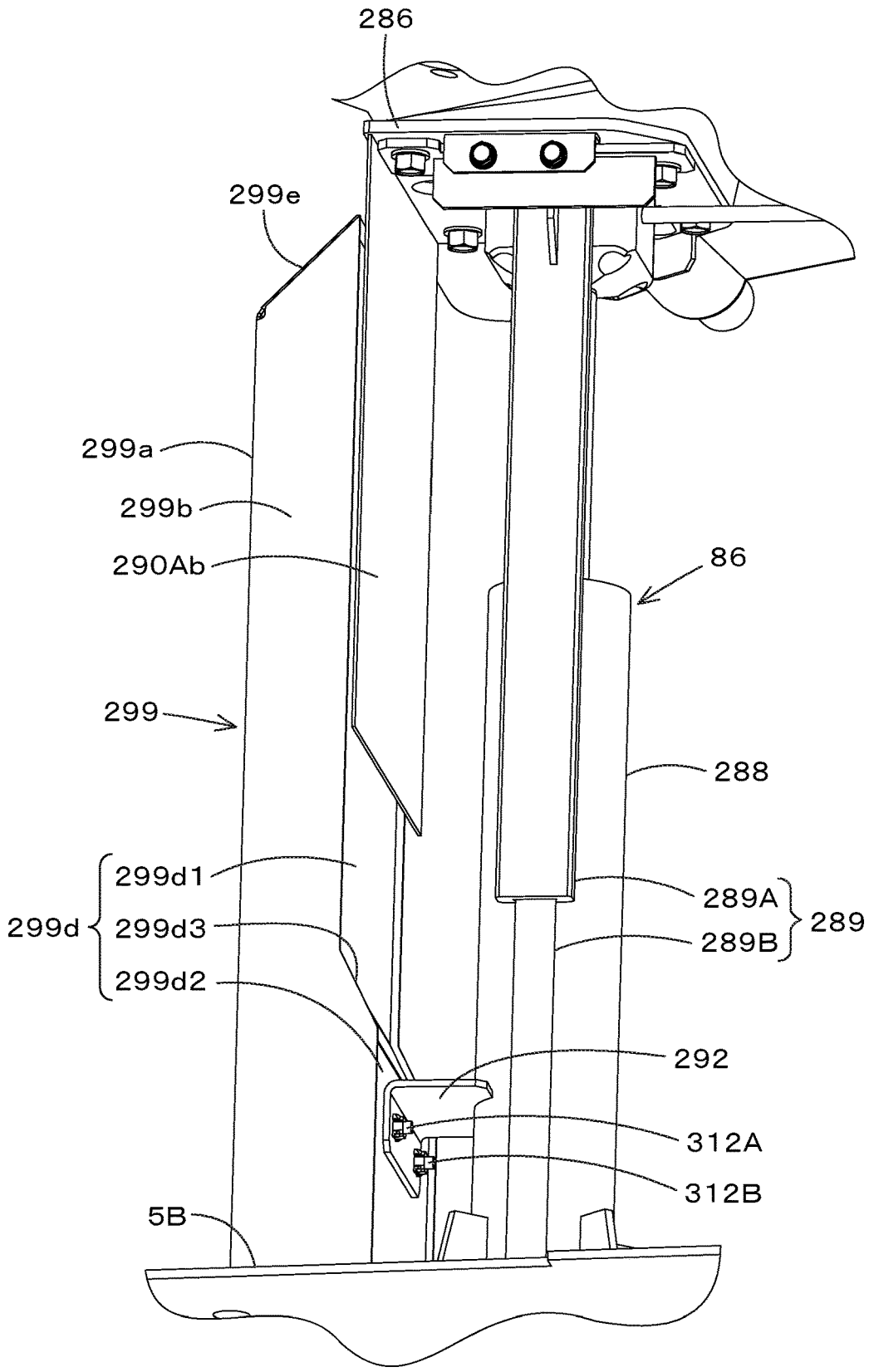
FIG. 23 is a diagonal view of the elevation device seen from the left back.

As shown in FIG. 22, the third duct 299 includes a front wall portion 299*a*, a rear wall portion 299*b*, a first side wall portion 299*c*, a second side wall portion 299*d*, and an upper wall portion 299*e*, and is open at a bottom end thereof. As shown in FIG. 19, a lower portion of the third duct 299 is arranged to surround the first protruding portion 305*a*, the second protruding portion 307*a*, the third protruding portion 308*a*, and the connecting portion 309, and is in contact with the floor portion 5B. A lower portion of the front wall portion 299*a* is fixed to the first protruding portion 305*a* with bolts 311A and 311B. As shown in FIG. 23, a lower portion of the rear wall portion 292*d* is fixed to the attachment stay 292 with bolts 312A and 312B, and is supported by the support pipe 288. As shown in FIG. 18B and FIG. 22, the front wall portion 299*a* includes a lower portion having an opening 299*h* formed therethrough, so that the bolts 312A and 312B can be tightened through the opening 299*h*. The opening 299*h* is closed by a lid plate 360 after the rear wall portion 292*d* is fixed with the bolts to the attachment stay 292.

As shown in FIG. 18A, the upper wall portion 299*e* is inclined rearwardly upward. The upper wall portion 299*e* is formed therethrough with a rectangular opening defined as a blower portion (referred to as the first blower portion) 299*g* (see FIG. 22). The air-conditioned air circulating through the third duct 299 is blown out from the first blower portion 299*g* to the front glass 68 (with the upper glass 68A).

Since the duct structure body 296 can blow the air-conditioned air from the position close to the front window 5C, the visibility of the front window 5C can be secured quickly during the demisting and defrosting.

As shown in FIG. 18A, in the rear wall portion 299*d*, an upper portion 299*d*1 is positioned forward of a lower portion 299*d*2, and the upper portion 299*d*1 and the lower portion 299*d*2 are connected to each other by an inclined intermediate wall portion 299*d*3 extending forwardly upward. As shown in FIG. 22, the front wall portion 299*a* is formed in a flat plate shape. Accordingly, the third duct 299 is configured so that a longitudinal width, in the fore-and-aft direction K1, of its upper portion is less than that of its lower portion. In addition, as shown in FIG. 22, the third duct 299 has a lateral width, in the machine width direction K2, which is constant from its upper portion to its lower portion.

Since the third duct 299 is configured so that the longitudinal width of its upper portion is less than that of its lower portion, the flow velocity of the air-conditioned air blown out from the first outlet 299*g* can be prevented from slowing down.

In addition, as shown in FIG. 18A, the front cover 290Ab of the movable cover 290A is located on the rear side of the upper portion 299*d*1 of the rear wall portion 299*d*. In this manner, the third duct 299 can be disposed close to the manipulator console 81, and the third duct 299 can be compactly disposed between the steering console 81 and the front window 5C.

Figure 24:
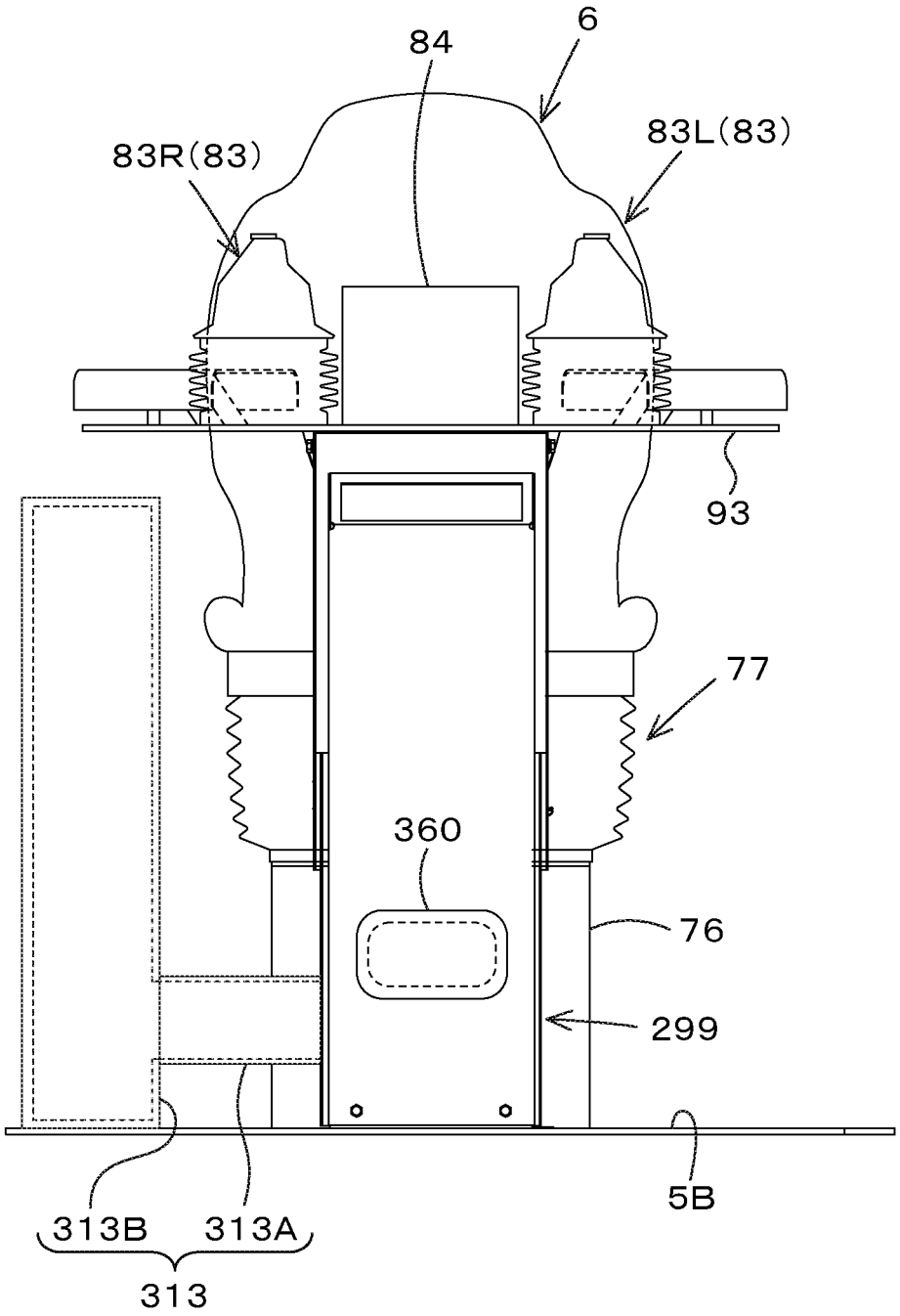
FIG. 24 is a front view illustrating a modified example of the duct structural body.
Figure 25:
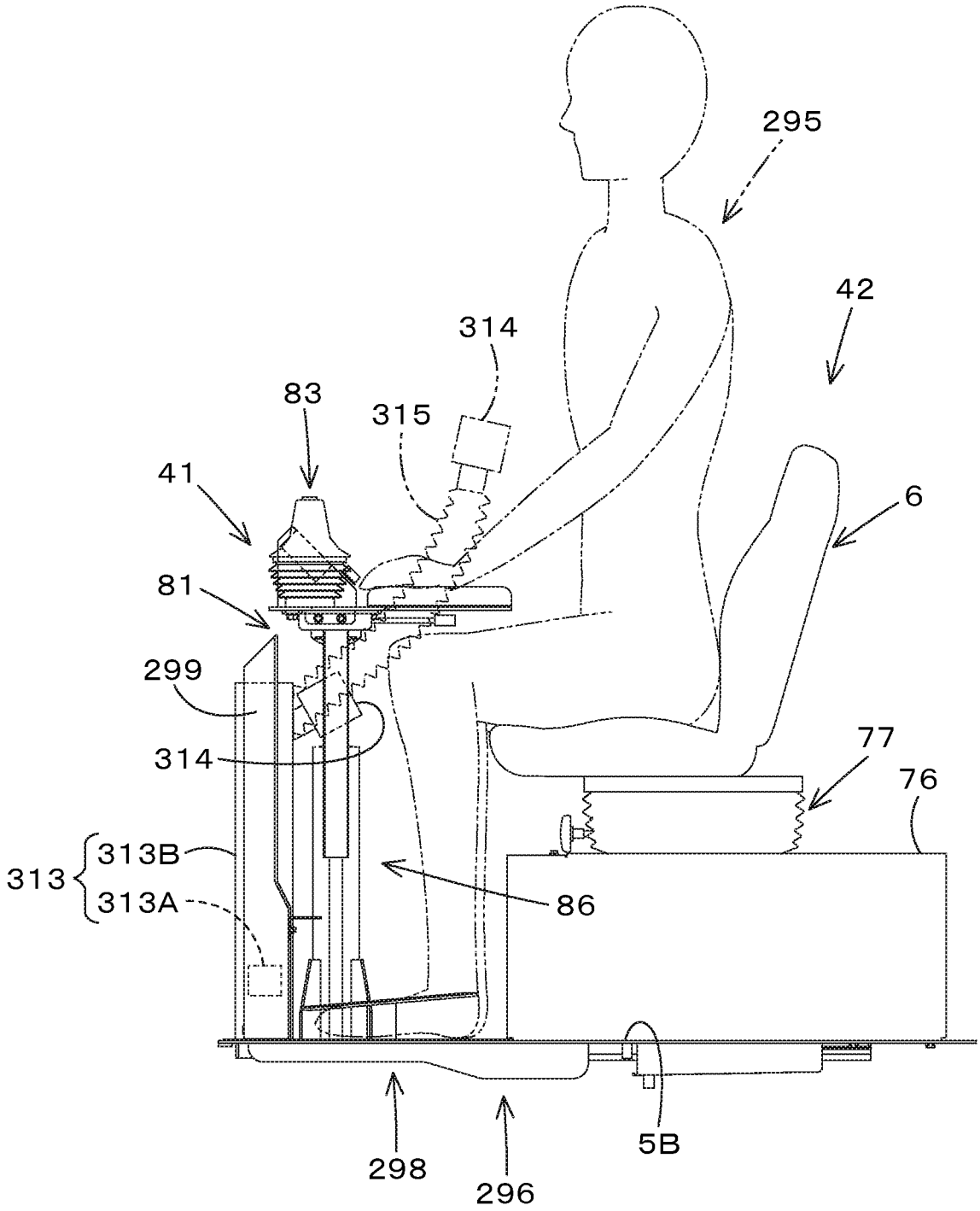
FIG. 25 is a side view illustrating the modified example of the duct structural body.
Figure 26:
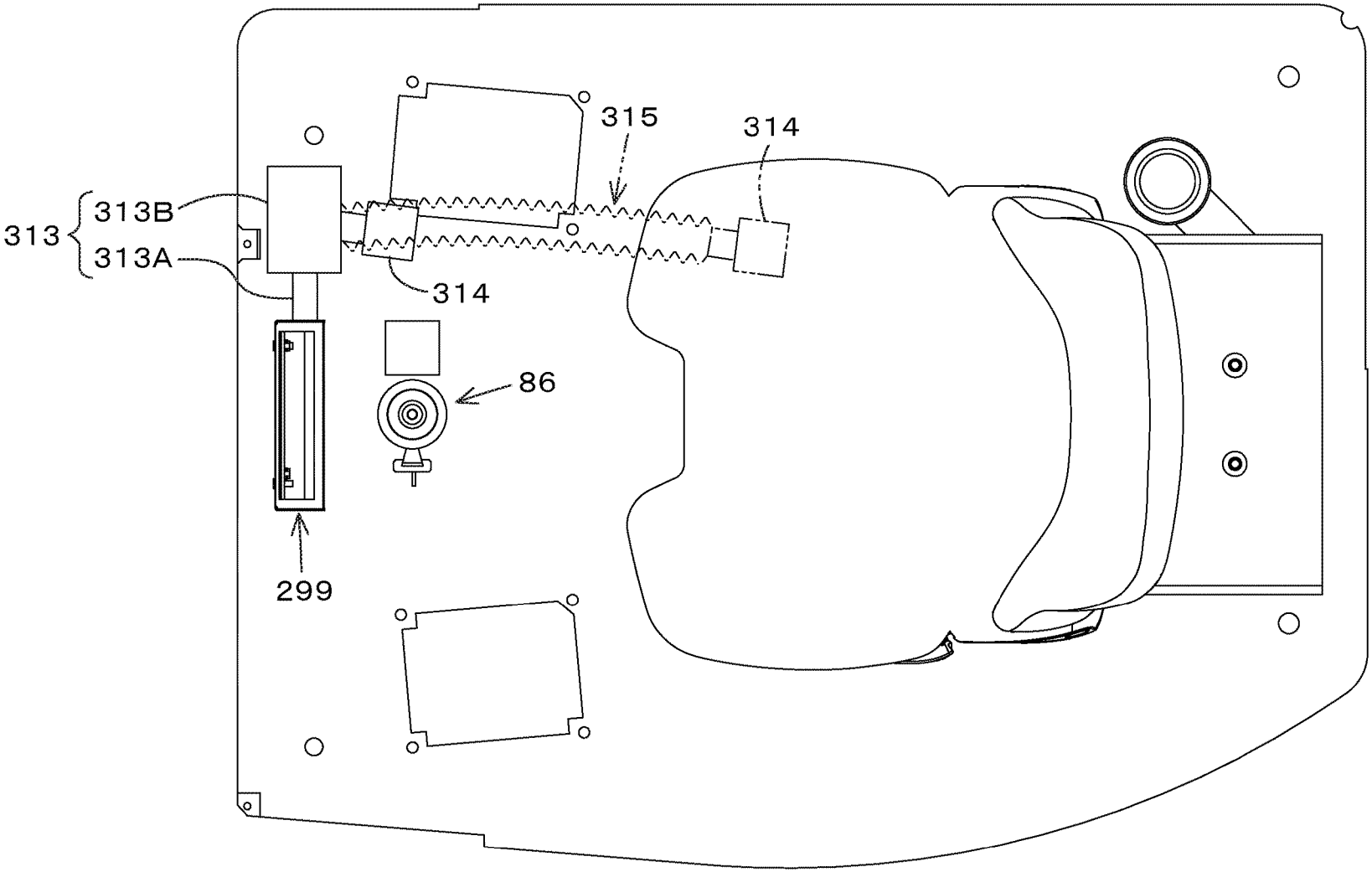
FIG. 26 is a plan view illustrating the modified example of the duct structural body.

FIGS. 24, 25, and 26 show modified examples of the duct structure body 296.

As shown in FIGS. 24 to 26, the duct structure body 296 includes a fourth duct 313 branched from the third duct 299 and a blower portion (referred to as a second blower portion) 314 provided in the fourth duct 313. The fourth duct 313 includes a first component body 313A and a second component body 313B. The first component body 313A is connected to a right side of a lower portion of the third duct 299. The first component body 313A protrudes to the right from the third duct 299. The second component body 313B extends upright at a position rightward of the third duct 299. The second blower portion 314 is capable of blowing out the air-conditioned air distributed through the fourth duct 313 toward the driver seat 6 side. The second blower portion 314 is connected to the second component body 313B (fourth duct 313) with a telescopic tube 315. In this manner, the second blower portion 314 can be removed from the second component body 313B, and moved to be placed in close proximity to an operator 295. The telescopic tube 315 can be telescoped and curved to arbitrarily change the position and orientation of the second blower portion 314. In this manner, the operator 295 is capable of sending the air-conditioned air to any desired area.

Figure 27:
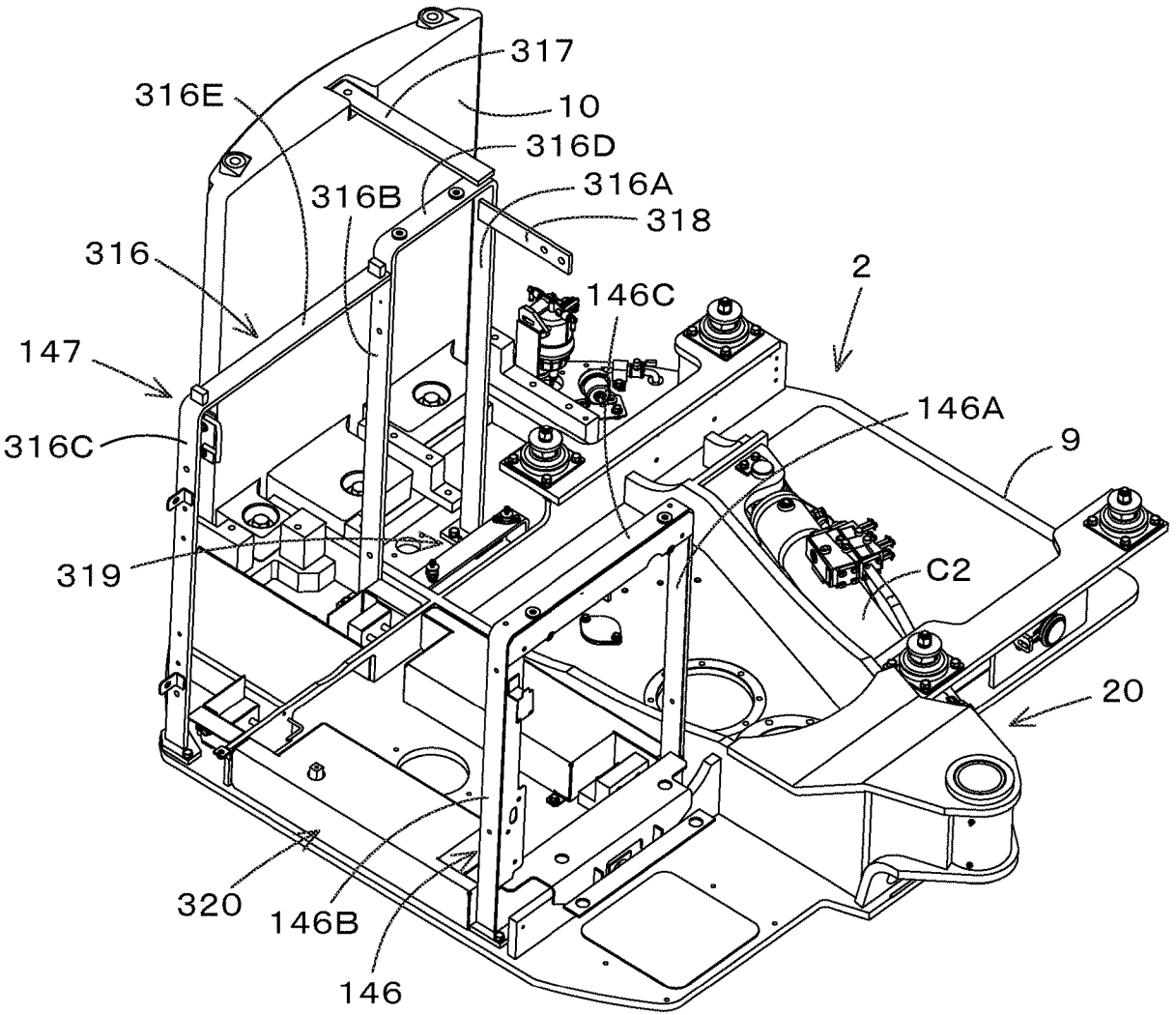
FIG. 27 is a diagonal view of a swivel frame.

FIG. 27 is a perspective view of a swivel frame that constitutes a framework of the machine body 2. As shown in FIG. 27, a front support frame (or a support frame) 146 and a rear support frame (or a support frame) 147 are provided on the other lateral side portion (a right portion), in the machine width direction K2, of the swiveling base plate 9. The front support frame 146 is provided on a front half portion of the swiveling base plate 9, and the rear support frame 147 is provided on a rear half portion of the swiveling base plate 9. The cover device 14 and the like are supported on the front support frame 146 and the rear support frame 147.

The front support frame 146 includes a first front pillar 146A and a second front pillar 146B located side by side in the machine width direction K2, and a front beam 146C connecting upper portions of the first front pillar 146A and the second front pillar 146B to each other.

The rear support frame 147 includes an upright frame 316 erected on the machine body 2, a connecting frame 317 connecting the upright frame 316 to the weight 10, and a protruding frame 318 protruding forward from the upright frame 316. The upright frame 316 includes a first vertical member 316A, a second vertical member 316B, a third vertical member 316C, a first lateral member 316D, and a second lateral member 316E.

The first vertical member 316A, the second vertical member 316B and the third vertical member 316C are arranged side by side in the machine width direction K2, and stand on the swiveling base plate 9. The first vertical member 316A is located in front of the center portion of the weight 10 in the machine width direction K2. The second vertical member 316B is spaced rightward from the first vertical member 316A. The third vertical member 316C is spaced rightward from the second vertical member 316B.

The first lateral member 316D connects upper portions of the first vertical member 316A and the second vertical member 316B to each other. The second lateral member 316E connects upper portions of the second vertical member 316B and the third vertical member 316C to each other. The connecting frame 317 connects a left portion of the first lateral member 316D to a center portion, in the machine width direction K2, of an upper end of the weight 10. The protruding frame 318 protrudes upward from the upper portion of the first vertical member 316A to above a valve receiving base 319.

A space between the front support frame 146 and a right portion of the rear support frame 147 (defined as a frame body constituted of the second vertical member 316B, the third vertical member 316C, and the second lateral member 316E) is a prime mover arrangement section 320 where the prime mover E1 is mounted.

Figure 28:
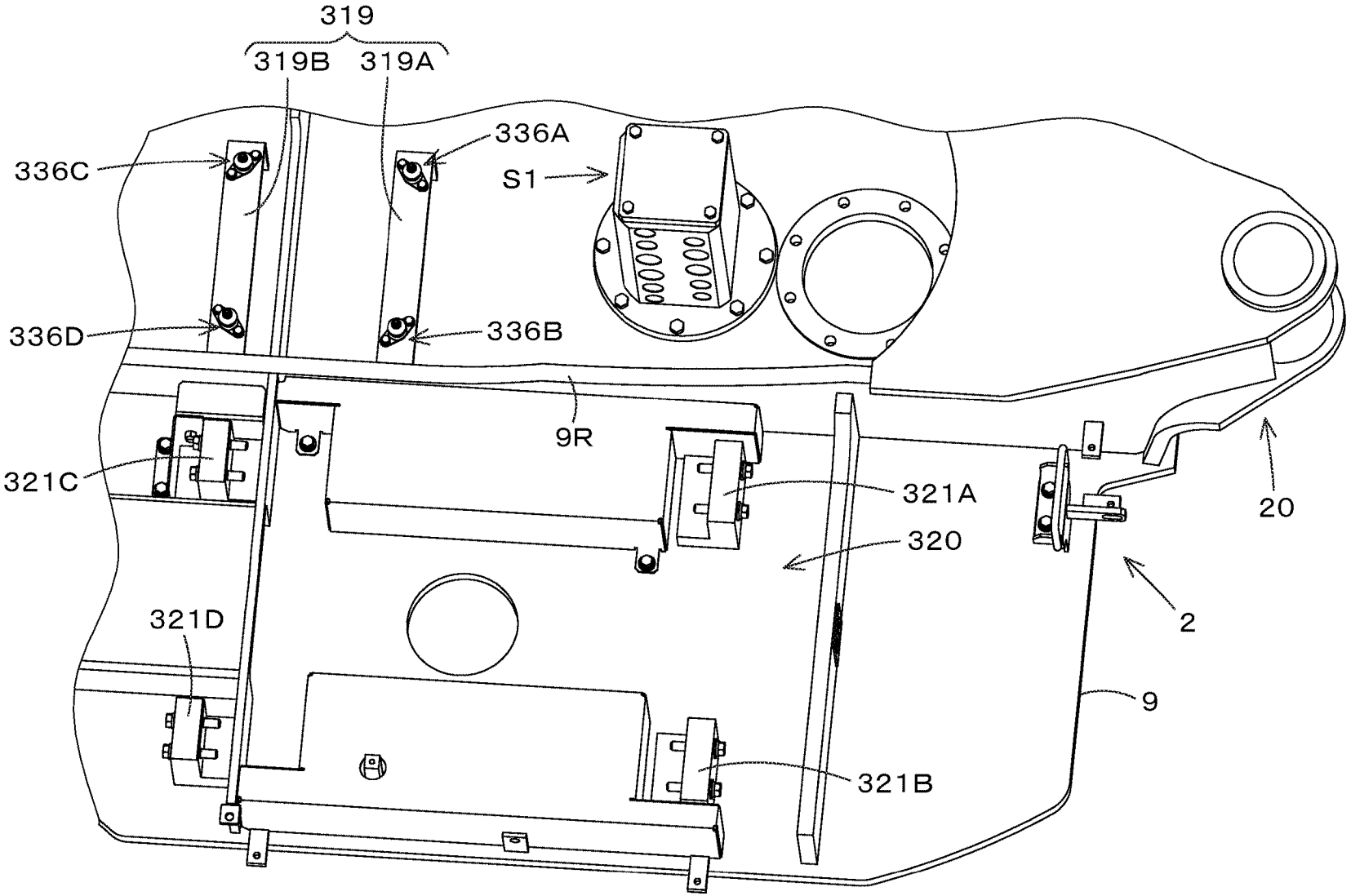
FIG. 28 is a diagonal view of an arrangement portion of a prime mover and a control valve.

As shown in FIG. 28, a plurality of attachment members (i.e., first to fourth attachment members 321A to 321D) are provided in the prime mover arrangement portion 320. The first attachment member 321A and the second attachment member 321B are spaced from each other in the machine width direction K2 and are provided at a front portion of the prime mover arrangement portion 320. The third attachment member 321C and the fourth attachment member 321D are spaced from each other in the machine width direction K2 and are provided at a rear portion of the prime mover arrangement portion 320.

Respective mount support bases are attached to the first to fourth attachment members 321A to 321D, and the prime mover E1 is vibro-isolatedly supported on the respective mount support bases.

Figure 29:
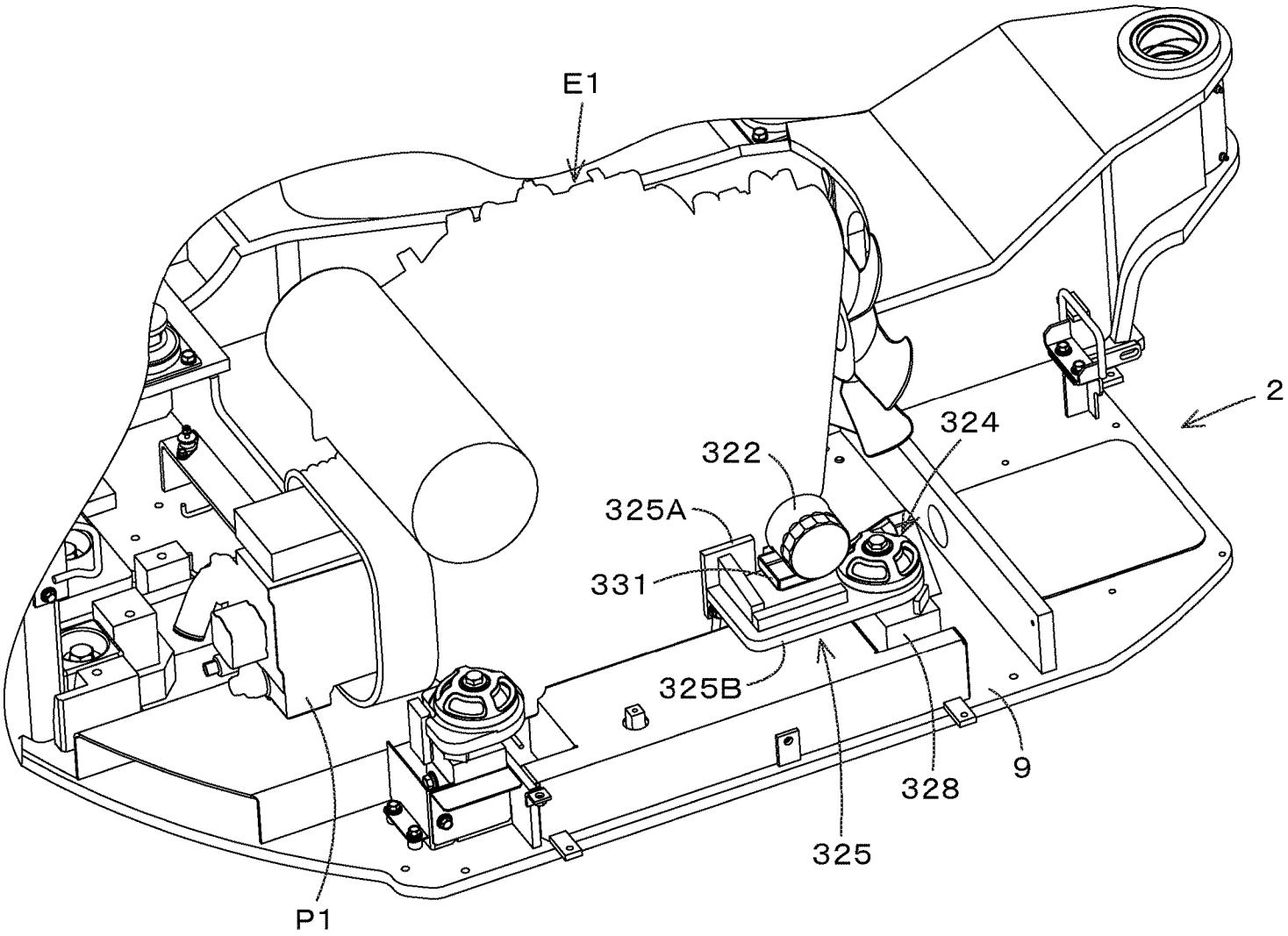
FIG. 29 is a diagonal view illustrating an attachment portion of an oil filter.

As shown in FIG. 29, an oil filter 322 is attached to a front right side portion of the prime mover E1. The oil filter 322 is a filter that removes impurities from prime mover oil (engine oil) which is lubrication oil of the prime mover E1.

Figure 30:
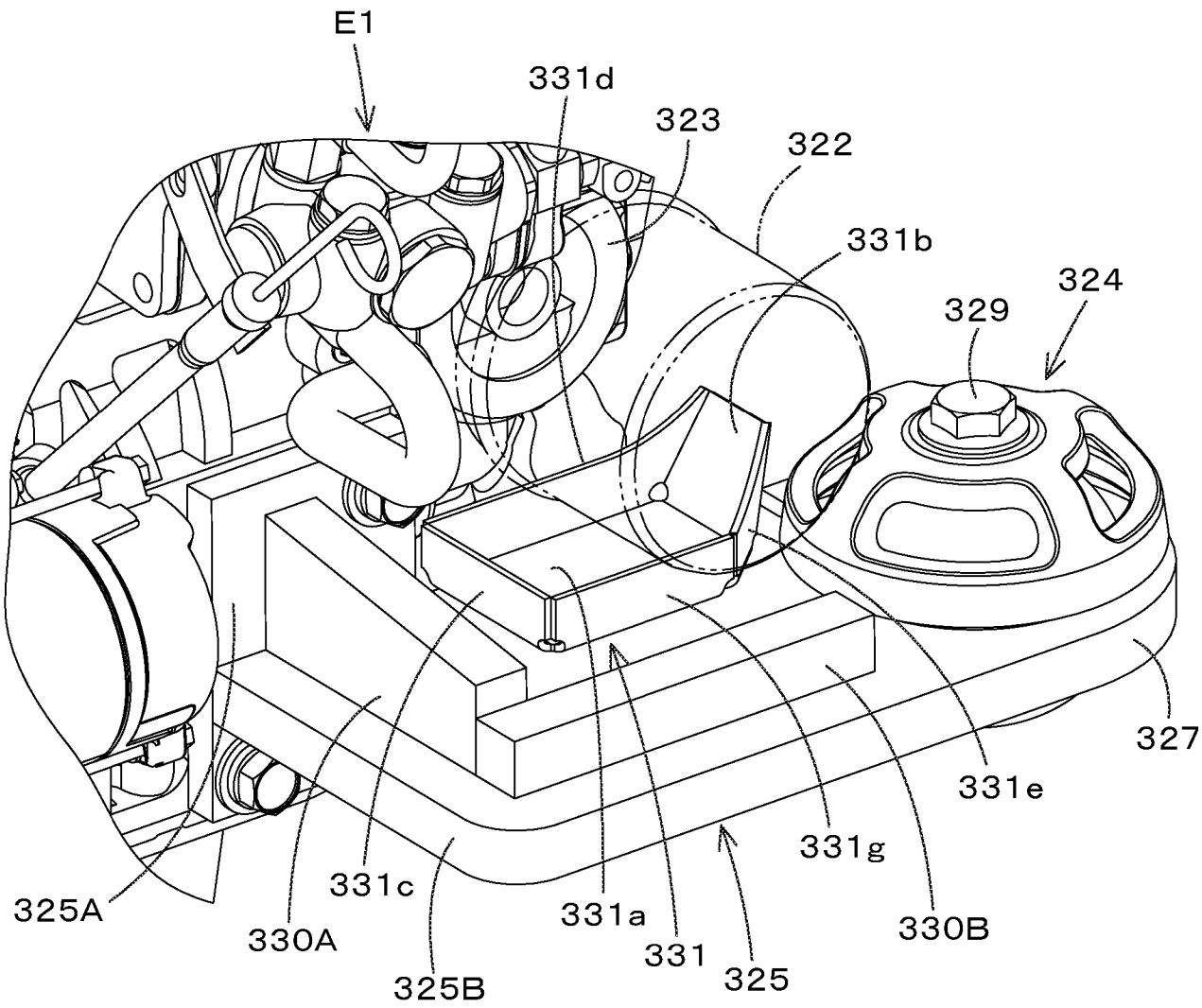
FIG. 30 is an enlarged diagonal view illustrating the attachment portion of the oil filter.

As shown in FIG. 30, a filter joint portion 323 is provided on the front right side portion of the prime mover E1. A base portion 322*a* of the oil filter 322 is detachably attached to the filter joint portion 323. A support base 325 is provided below the filter joint portion 323 and the oil filter 322. An anti-vibration prime mover mount (mount member) 324 is attached to the support base 325 to support the front right side portion of the prime mover E1.

Figure 31:
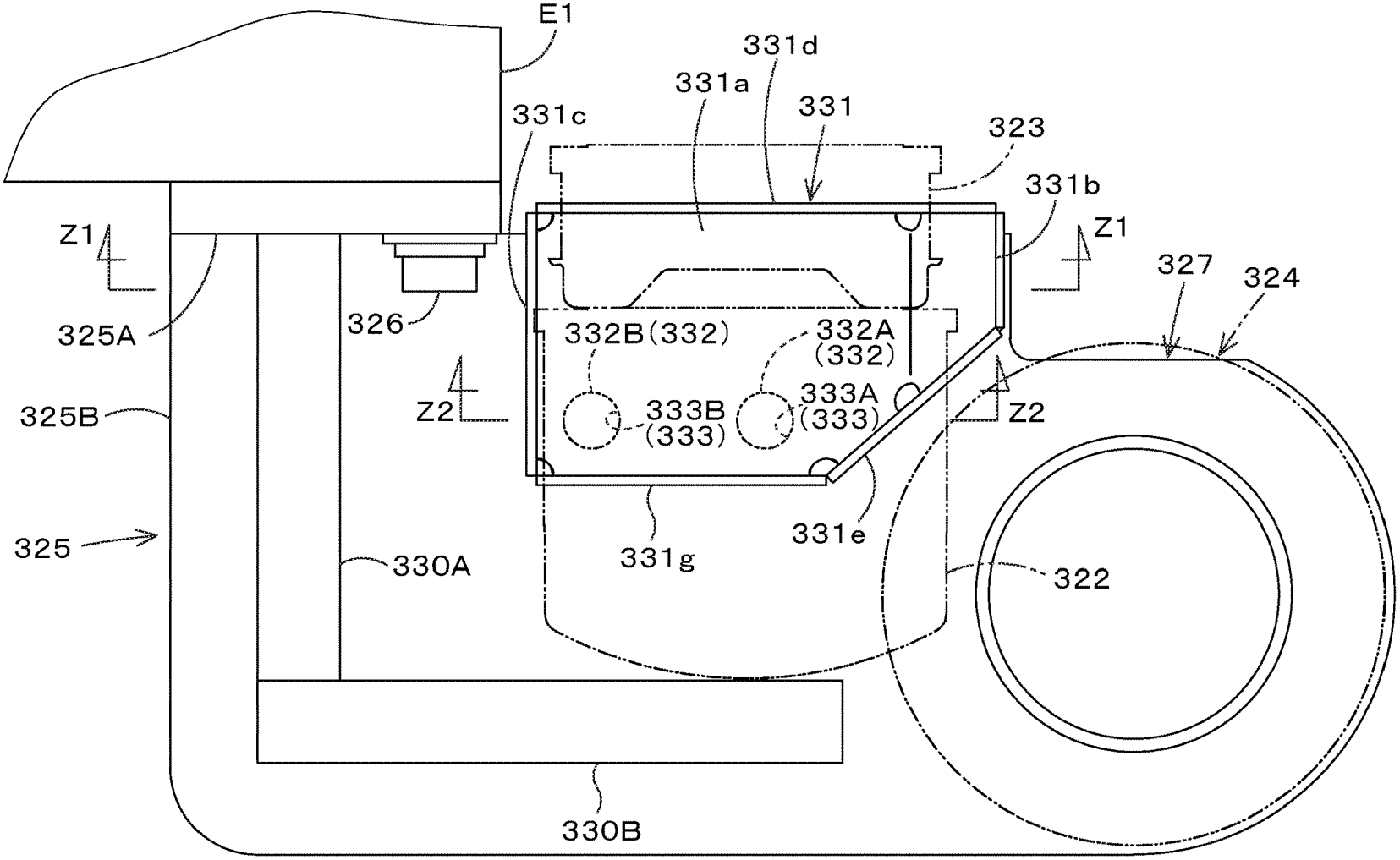
FIG. 31 is a plan view of the attachment portion of the oil filter.
Figure 32:
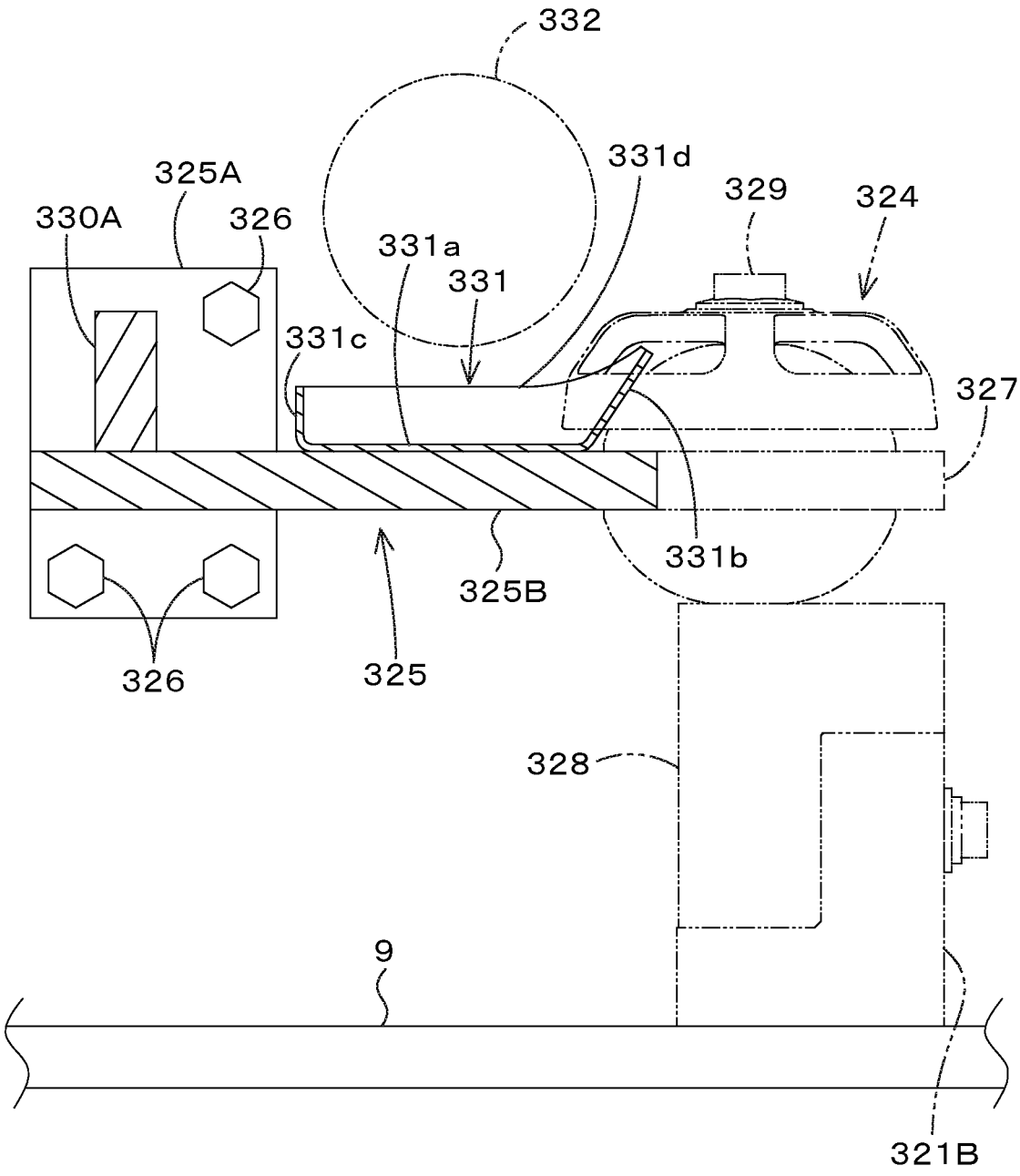
FIG. 32 is a cross-section view in a Z1-Z1 arrowed line of FIG. 31.

As shown in FIG. 30, FIG. 31, and FIG. 32, the support base 325 includes a first plate 325A and a second plate 325B. The first plate 325A is extended vertically with its plate surface facing in the machine width direction K2, and is attached to a right side face of the prime mover E1 with bolts 326. In addition, the first plate 325A is attached to the prime mover E1 rearward of the filter joint portion 323.

The second plate 325B is extended laterally with its plate surface facing vertically, and includes a rear portion fixed to a vertically intermediate portion of the first plate 325A. Accordingly, the second plate 325B protrudes forward from the first plate 325A. In addition, the second plate 325B is located below the filter joint portion 323 and the oil filter 322. The first reinforcing portion 330A and the second reinforcing member 330B are fixed to a rear upper surface of the second plate 325B. The first reinforcing portion 330A protrudes rightward from the first plate 325A. The second reinforcing member 330B protrudes forward from a right end of the first reinforcing portion 330A.

The second plate 325B includes a front portion defined as a mount attachment portion 327 to which the prime mover mount (mount member) 324 is attached. As shown in FIG. 32, a mount support base 328 is attached to the second attachment member 321B, and the prime mover mount 324 attached to the support base 325 is attached to the mount support base 328 with a vertical bolt 329 penetrating therethrough.

As shown in FIG. 30, below the filter joint portion 323 and the oil filter 322, a receptacle 331 is provided to receive oil that flows down from the oil filter 322 when removed.

Figure 33:
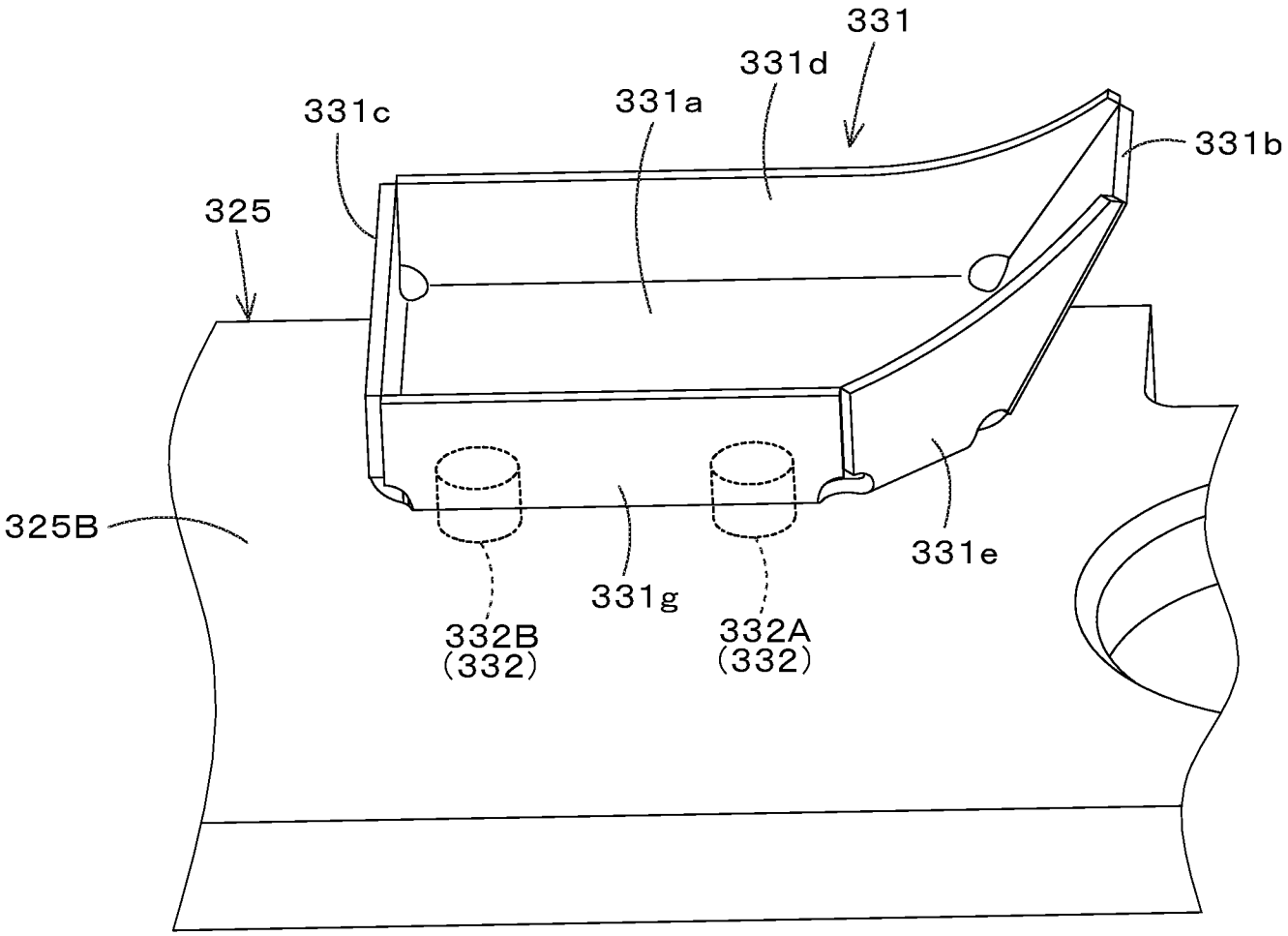
FIG. 33 is a diagonal view of a receptacle.

As shown in FIGS. 31 and 33, the receptacle 331 includes a bottom wall 331*a*, a front wall 331*b* extended upward from a front end of the bottom wall 331*a*, a rear wall 331*c* extended upward from a rear end of the bottom wall 331*a*, a first side wall 331*d* extended upward from a left end of the bottom wall 331*a*, a second side wall 331*e* extended upward from a front portion of the right end of the bottom wall 331*a*, and a third side wall 331*g* extended upward from a rear portion of the right end of the bottom wall 331*a*.

Figure 34:
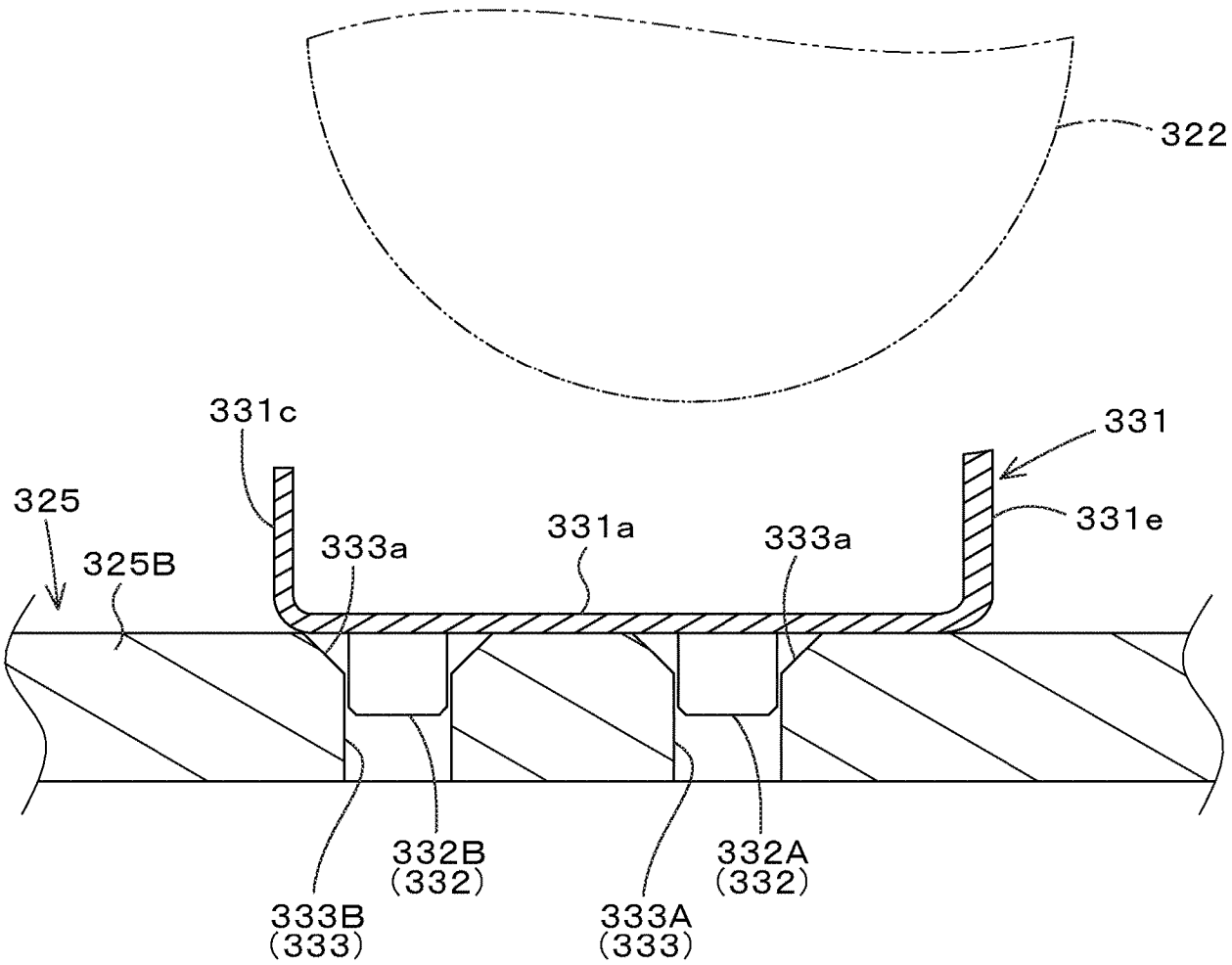
FIG. 34 is a cross-section view in a Z2-Z2 arrowed line of FIG. 31.
Figure 35:
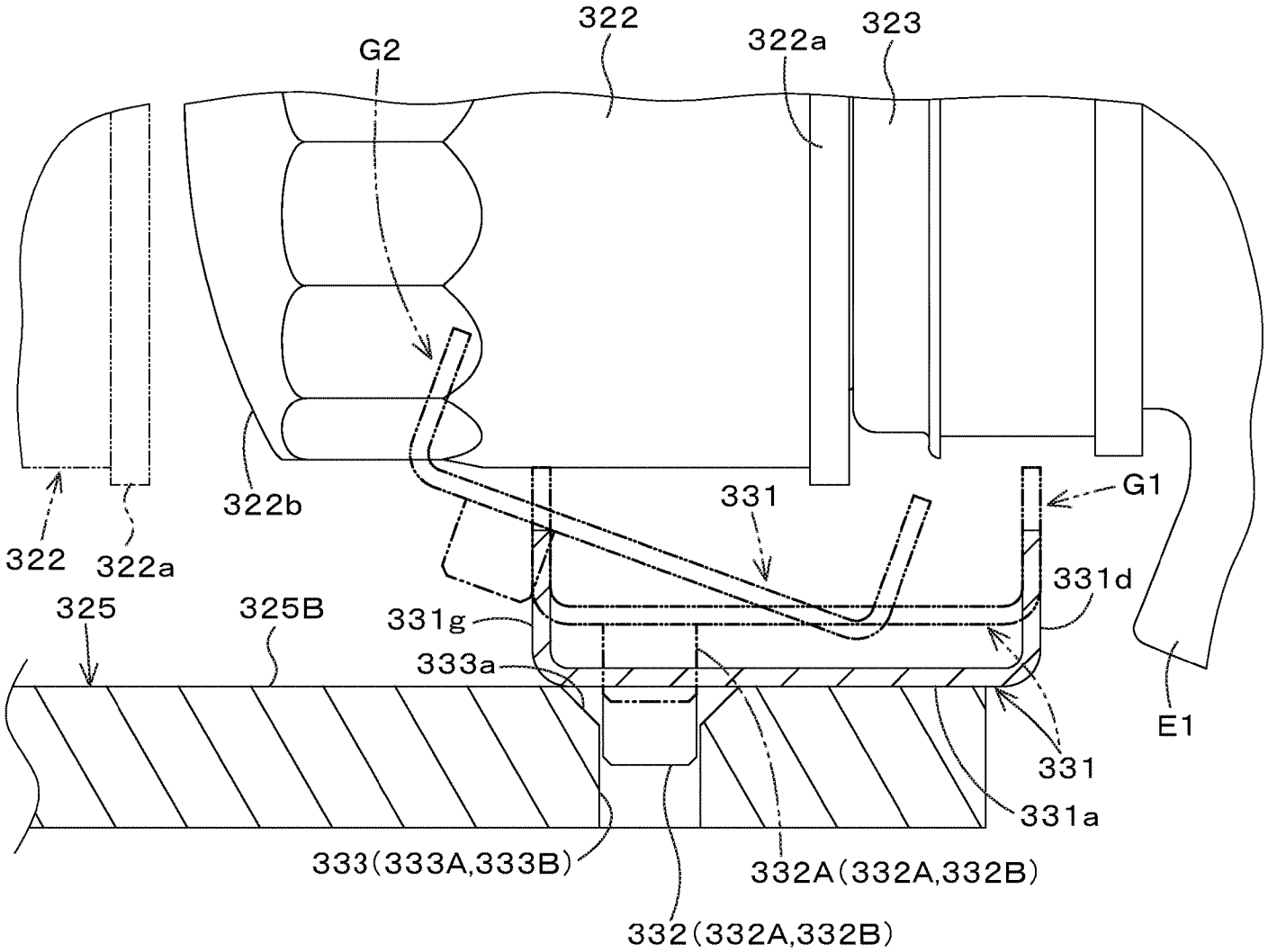
FIG. 35 is a front partial cross-section view illustrating a relationship between the receptacle and the oil filter.

As shown in FIG. 32, the front wall 331*b* extends upwardly forward from the bottom wall 331*a*. The rear wall 331*c* extends in a normal direction from the bottom wall 331*a*. As shown in FIG. 35, the first side wall 331*d* extends in a normal direction from the bottom wall 331*a*. As shown in FIG. 34, the second side wall 331*e* extends in a normal direction from the bottom wall 331*a*. As shown in FIG. 35, the third side wall 331*g* extends in a normal direction from the bottom wall 331*a*.

The front wall 331*b* is joined respectively to the first side wall 331*d* and the second side wall 331*e* by welding, the rear wall 331*c* is joined respectively to the first side wall 331*d* and the third side wall 331*g* by welding, and the second side wall 331*e* is joined to the third side wall 331*g* by welding. In this way, the walls constituting the receptacle 331 are joined to each other by welding to eliminate gaps therebetween. Accordingly, the receptacle 331 surely holds oil received therein.

As shown in FIG. 34, a plurality of engagement pins (i.e., a first engagement pin 332A and a second engagement pin 332B) are fixed to a lower surface of the bottom wall 331A and protrude downward therefrom. The first engagement pins 332A and the second engagement pins 332B are arranged side by side with an interval therebetween in the fore-and-aft direction K1.

As shown in FIG. 35, the first engagement pin 332A and the second engagement pin 332B are provided on the bottom wall 331A eccentrically in a machine-outward direction (rightward) from the center portion of the bottom wall 331A. In other words, the first engagement pin 332A and the second engagement pin 332B are more distant from the prime mover E1 than the width directional (in the machine width direction K2) center of the receptacle 331. Furthermore, in other words, the first engagement pin 332A and the second engagement pin 332B are provided closer to a head portion 322*b* of the oil filter 322 (i.e., a filter head) than the filter joint portion 323. The filter head portion 322*b* is a portion of the oil filter 322 opposite to the base portion 322*a*.

In the following description, the first engagement pin 332A and the second engagement pin 332B are collectively referred to as an engagement pin 332.

As shown in FIG. 34, a plurality of insertion holes (i.e., a first insertion hole 333A and a second insertion hole 333B) are formed in the second plate 325B (of the support base 325). The first insertion hole 333A and the second insertion hole 333B are formed to penetrate through the second plate 325B. The first insertion hole 333A is a hole through which the first engagement pin 332A is inserted. The second insertion hole 333B is a hole through which the second engagement pin 332B is inserted.

In the following description, the first insertion hole 333A and the second insertion hole 333B are collectively referred to as an insertion hole 333.

By inserting the engagement pin 332 into the insertion hole 333, the receptacle 331 is attached to the support base 325. That is, the receptacle 331 is removably installed on the support base 325. In addition, the receptacle 331 can be easily installed or removed by simply moving the receptacle 331 in the vertical direction.

As shown in FIG. 35, while the oil filter 322 remains attached to the filter joint portion 323, when the receptacle 331 is moved upward, the receptacle 331 interferes with (abuts against) the oil filter 322 as shown by virtual lines G1, so that the engagement pin 332 cannot be removed (detached) from the insertion hole 333. That is, the oil filter 322 remaining attached hinders the receptacle 331 from being removed from the support base 325. In this manner, the receptacle 331 is easy to be installed and removed, but is hard to be detached from the support base 325.

In addition, after the oil filter 322 is removed, the receptacle 331 can be lifted to a position where the engagement pin 332 can be removed entirely from the insertion hole 333. Accordingly, by removing the oil filter 322, the receptacle 331 can be removed from the support base 325. That is, the receptacle 331 can be removed (at need) when the oil filter 322 is replaced with a new one. When the oil filter 322 is replaced with a new one, the receptacle 331 receives oil flowing down from the oil filter 322 and the filter joint portion 323, and the receptacle 331 can be removed to discharge the oil therefrom.

In addition, since the engagement pin 332 is provided closer to the filter head portion 322*b* than the filter joint portion 323, the receptacle 331 can be easily attached. That is, in attaching the receptacle 331, the engagement pin 332 and the insertion hole 333 can be easily watched, and thus the engagement pin 332 can be easily inserted into the insertion hole 333 while looking at the engagement pin 332 and the insertion hole 333. In addition, as shown by virtual lines G2 in FIG. 35, when the receptacle 331 is moved to be attached, the receptacle 331 may be tilted such that one half portion (closer to a person) thereof with the engagement pin 332 is higher than the other half portion (farther from a person) thereof to be inserted to below the filter joint portion 323, (back surface side) and moved in attaching the receptacle 331, thereby making it easily to watch the engagement pin 332 and the insertion hole 333.

As shown in FIG. 34, a guide surface 333*a* is formed at an upper portion of each of the first insertion hole 333A and the second insertion hole 333B. The guide surface 333*a* is formed to have a tapered shape (conical shape) that becomes narrower as extending downward from the upper end of the insertion hole 333. In this manner, in inserting the engagement pin 332 into the insertion hole 333, the engagement pin 332 is guided by the guide surface 333*a*, so that the engagement pin 332 can be easily inserted into the insertion hole 333.

In addition, since the support base 325 for mounting the prime mover mount 324 thereon is also used for mounting the receptacle 331 thereon, cost reduction can be achieved through the dual use of the component.

The hood 16 includes an openable cover on an machine-outward side surface thereof, such that, when the cover is opened, the oil filter 322 and the receptacle 331 can be easily accessed.

As shown in FIG. 28, a valve receiving base 319 to support the control valve V1 is provided rearward of the swivel joint S1. The valve receiving base 319 includes a first pedestal 319A and a second pedestal 319B located rearward of the first pedestal 319A. A right end of the valve receiving base 319 is fixed to a side surface of the vertical rib 9R, and a left portion of the valve receiving base 319 is bent downward and fixed to the swiveling base plate 9. A plurality of valve mounts (i.e., first to fourth valve mounts 336A to 336D) are provided on the valve receiving base 319. The first valve mount 336A is attached to a left portion of the first pedestal 319A, and the second valve mount 336B is attached to a right portion of the first pedestal 319A. The third valve mount 336C is attached to a left portion of the second pedestal 319B, and the fourth valve mount 336D is attached to a right portion of the second pedestal 319B. Each of the first to fourth valve mounts 336A to 336D includes an anti-vibration rubber (elastic member) to vibro-isolatedly support the control valve V1.

As shown in FIG. 37, the control valve V1 is a composite control valve of a sectional type (separation type) as described above, and is constituted of a lot of sections (i.e., first to fourteenth sections VS1 to VS14) stacked one on another in the vertical direction. The first to fourth sections VS1 to VS14 are arranged in the order from the top. Accordingly, the first section VS1 is the topmost section, and the fourteenth section VS14 is the bottommost section. The sections between the first section VS1 and the fourteenth section VS14 are the control valves. The first section VS1 to the fourteenth section VS14 are coupled by a plurality of bolts 334 (see FIG. 39) that pass through the sections in the vertical direction.

Figure 36:
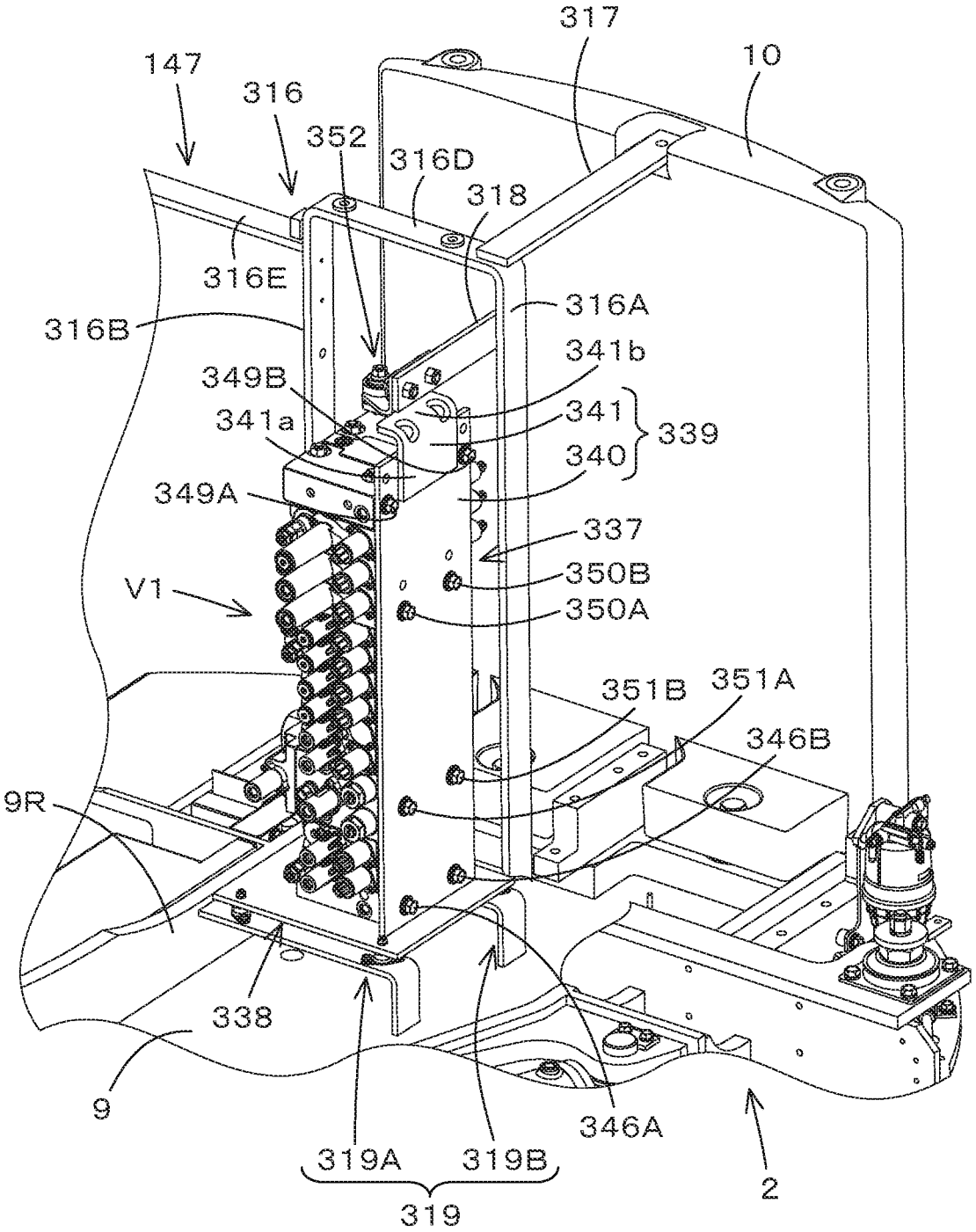
FIG. 36 is a diagonal view illustrating an attachment condition of the control valve.

As shown in FIGS. 36 and 37, a valve base 337 is attached to the valve receiving base 319, and the control valve V1 is attached to the valve base 337. The valve base 337 includes a base plate 338 and a vertical plate 339.

As shown in FIG. 37, the base plate 338 is formed of a rectangular plate, and is arranged to have a vertically facing plate surface which is placed on the first to fourth valve mounts 336A to 336D so as to be attached to the valve receiving base 319 via the first to fourth valve mounts 336A to 336D. As a result, the base plate 338 is attached to the machine body 2.

As shown in FIG. 37, the vertical plate 339 includes a main plate 340 and a connecting plate 341. The main plate 340 is formed of a vertically elongated rectangular plate, and is located above a left portion of the base plate 338 with a clearance from the base plate 338 such that a plate surface of the main plate 340 faces in the machine width direction K2 (see FIG. 38).

Figure 40:
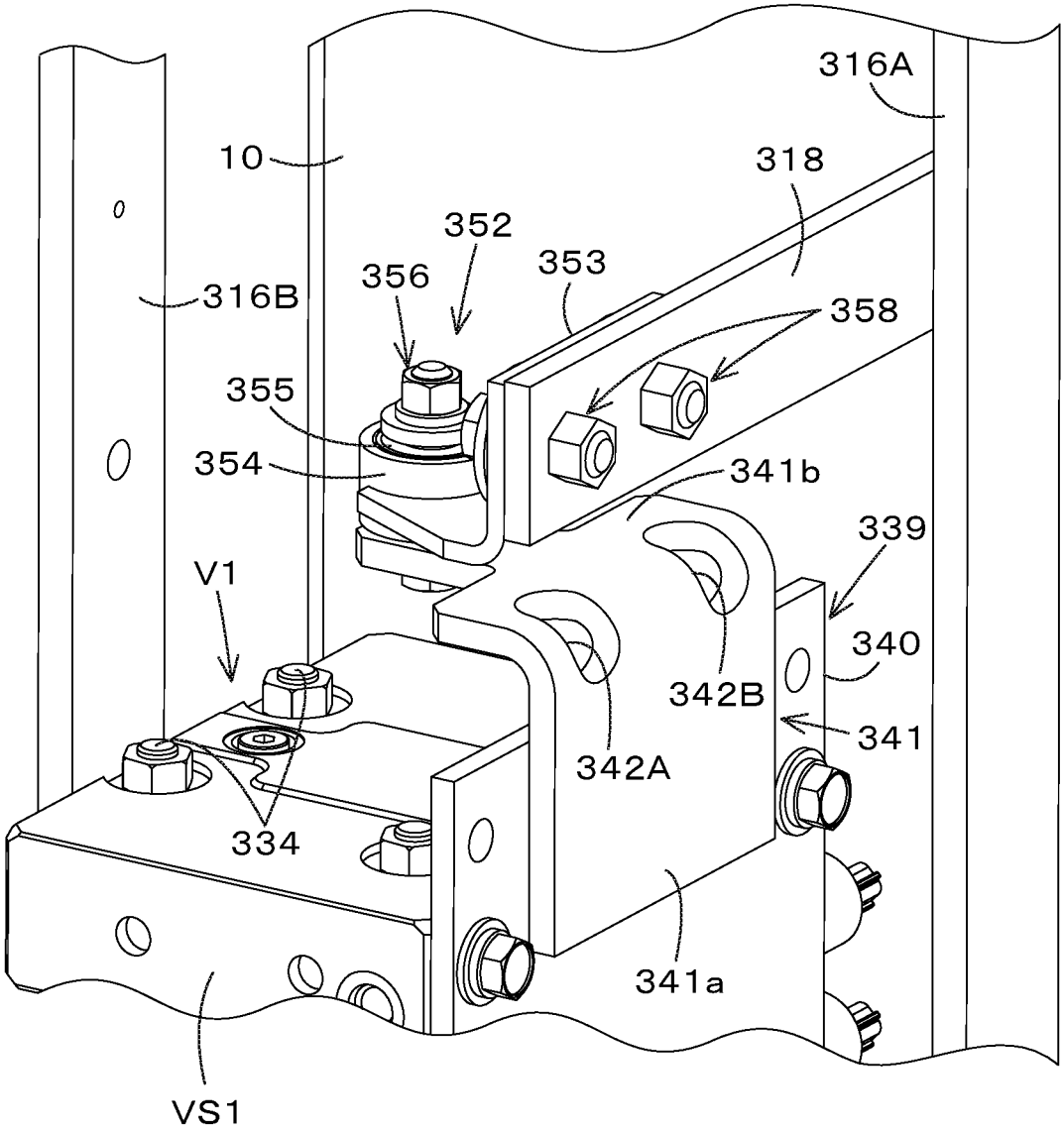
FIG. 40 is a diagonal view illustrating the support structure of the upper portion of the control valve.

As shown in FIG. 37, the connecting plate 341 includes a first plate portion 341*a* and a second plate portion 341*b*. The first plate portion 341*a* is fixed to a left side surface of an upper portion of the main plate 340, and the second plate portion 341*b* extends from an upper end of the first plate portion 341*a* so as to protrude rightward from the main plate 340. As shown in FIG. 40, a plurality of engagement portions (i.e., a first engagement portion 342A and a second engagement portion 342B) are formed in a corner portion between the first plate portion 341A and the second plate portion 341B with an interval therebetween in the fore-and-aft direction K1. Holes formed through the connecting plate 341 are defined as the first engagement portion 342A and the second engagement portion 342B.

Figure 38:
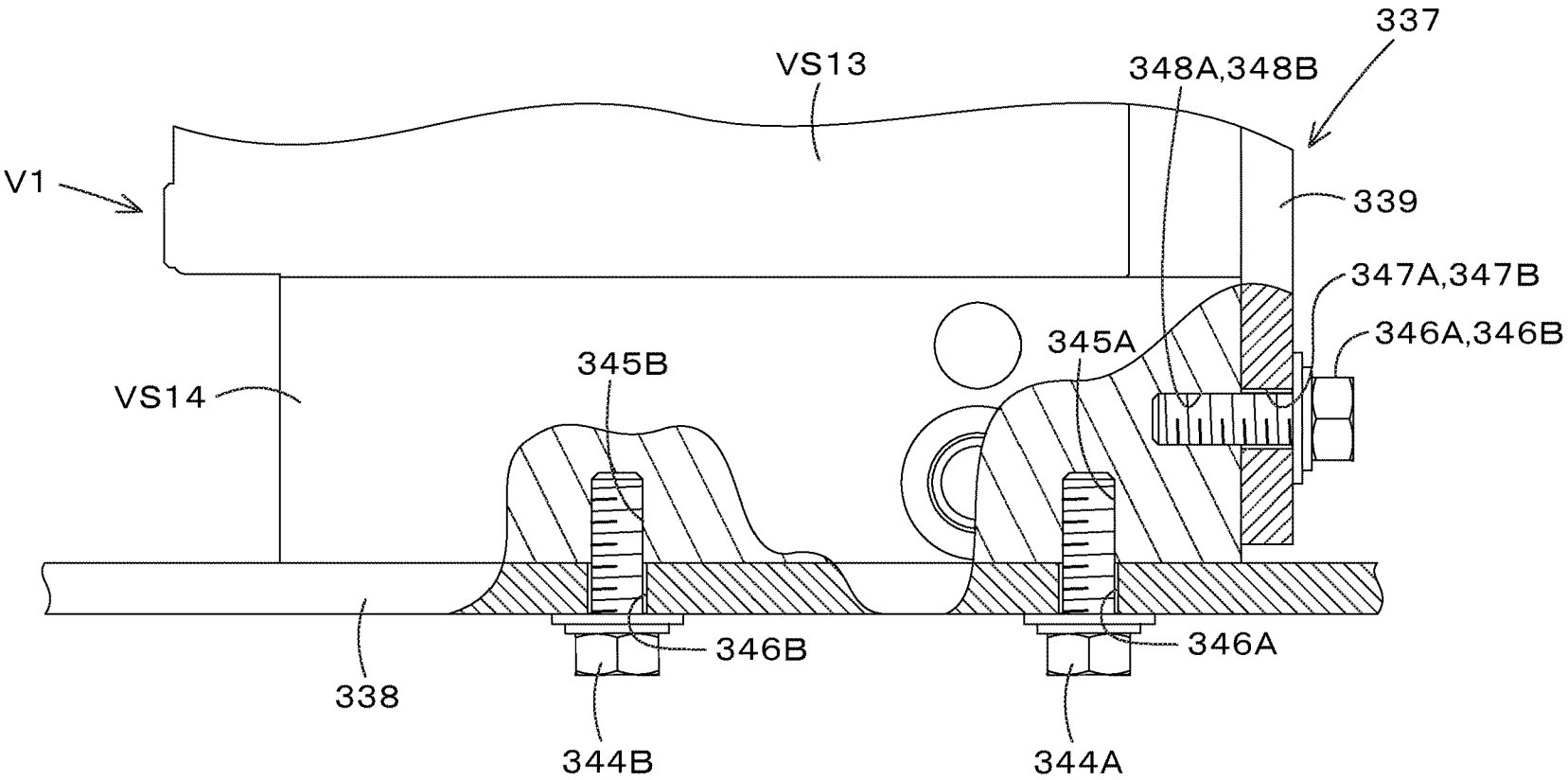
FIG. 38 is a front partial cross-section view illustrating attachment of the control valve.

As shown in FIG. 38, the fourteenth section VS14 (the bottommost section) is placed on the base plate 338. In this manner, a load from the control valve V1 is received by the base plate 338. In addition, a force acting on the control valve V1 acts on the base plate 338 through the fourteenth section VS14.

As shown in FIG. 38, the fourteenth section VS14 is joined to the base plate 338 with bolts 344A and 344B which are arranged side by side with an interval therebetween in the machine width direction K2. An insertion hole 346A is formed through the base plate 338, and the bolt 344A is inserted through the insertion hole 346A from below the base plate 338, and is screwed into a threaded hole 346A formed in the fourteenth section VS14. An insertion hole 346B is formed through the base plate 338, and the bolt 344B is inserted through insertion hole 346B from below the base plate 338, and is screwed a threaded hole 346B formed in the fourteenth section VS14.

As shown in FIG. 38, the fourteenth section VS14 is joined to the main plate 340 (of the vertical plate 339) with bolts 346A and 346B which are arranged side by side with an interval therebetween in the fore-and-aft direction K1 (see FIG. 36). An insertion hole 347A is formed through the main plate 340, and the bolt 346A is inserted through the insertion hole 347A from the left side of the main plate 340, and is screwed into a threaded hole 348A formed in the fourteenth section VS14. An insertion hole 347B is formed through the main plate 340, and the bolt 346B is inserted through the insertion hole 347B from the right side of the main plate 340, and is screwed into a threaded hole 348B formed in the fourteenth section VS14. The threaded hole is a hole with a female thread formed on the inner circumference.

As shown in FIGS. 36 and 37, the first section VS1 is joined to the main plate 340 with bolts 349A and 349B which are arranged side by side with an interval therebetween in the fore-and-aft direction K1. The fourth section VS4 is joined to the main plate 340 with bolts 350A and 350B arranged side by side with an interval therebetween in the fore-and-aft direction K1. The eleventh section VS11 is joined to the main plate 340 with bolts 351A and 351B which are arranged side by side with an interval therebetween in the fore-and-aft direction K1.

The bottommost section (i.e., the fourteenth section VS14) of the control valve V1 is joined to the base plate 338 and the main plate 340, and some (i.e., the first section VS1, fourth section VS4, and eleventh section VS11) of the sections constituting the control valve V1 are joined to the main plate 340 (of the vertical plate 339), thereby guarding the sections of the control valve V1 against a force causing a positional displacement of the sections. In addition, since the load from the control valve V1 is received by the base plate 338, a large load does not act on the vertical plate 339, thereby lightening the valve base 337. That is, the vertical plate 339 requires only a strength that is enough to prevent the control valve V1 from being twisted, so that the thickness of the vertical plate 339 does not have to be increased to support the control valve V1, thereby lightening the valve base 337 can be made lighter.

For example, when the vertical plate 339 (or the main plate 340) is fixed to the base plate 338 by welding, it is difficult to fix the vertical plate 339 accurately (perpendicular) to the base plate 338 because distortion (deformation) occurs in their welded portions. If the vertical plate 339 is not accurately fixed to the base plate 338, a stress (strain)

will act on the fourteenth section VS14 in tightening the bolts to fix the fourteenth section VS14 to the base plate 338 and the vertical plate 339. In contrast, in the embodiment, the vertical plate 339 is not welded to the base plate 338 and separated from the base plate 338, thereby preventing a stress from acting on the fourteenth section VS14.

As shown in FIGS. 36 and 37, an upper portion of the vertical plate 339 (of the valve base 337) is connected to the protruding frame 318 (of the support frame 147) by an anti-sway member 352. The anti-sway member 352 prevents the valve base 337 from swaying in the horizontal direction.

Figure 39:
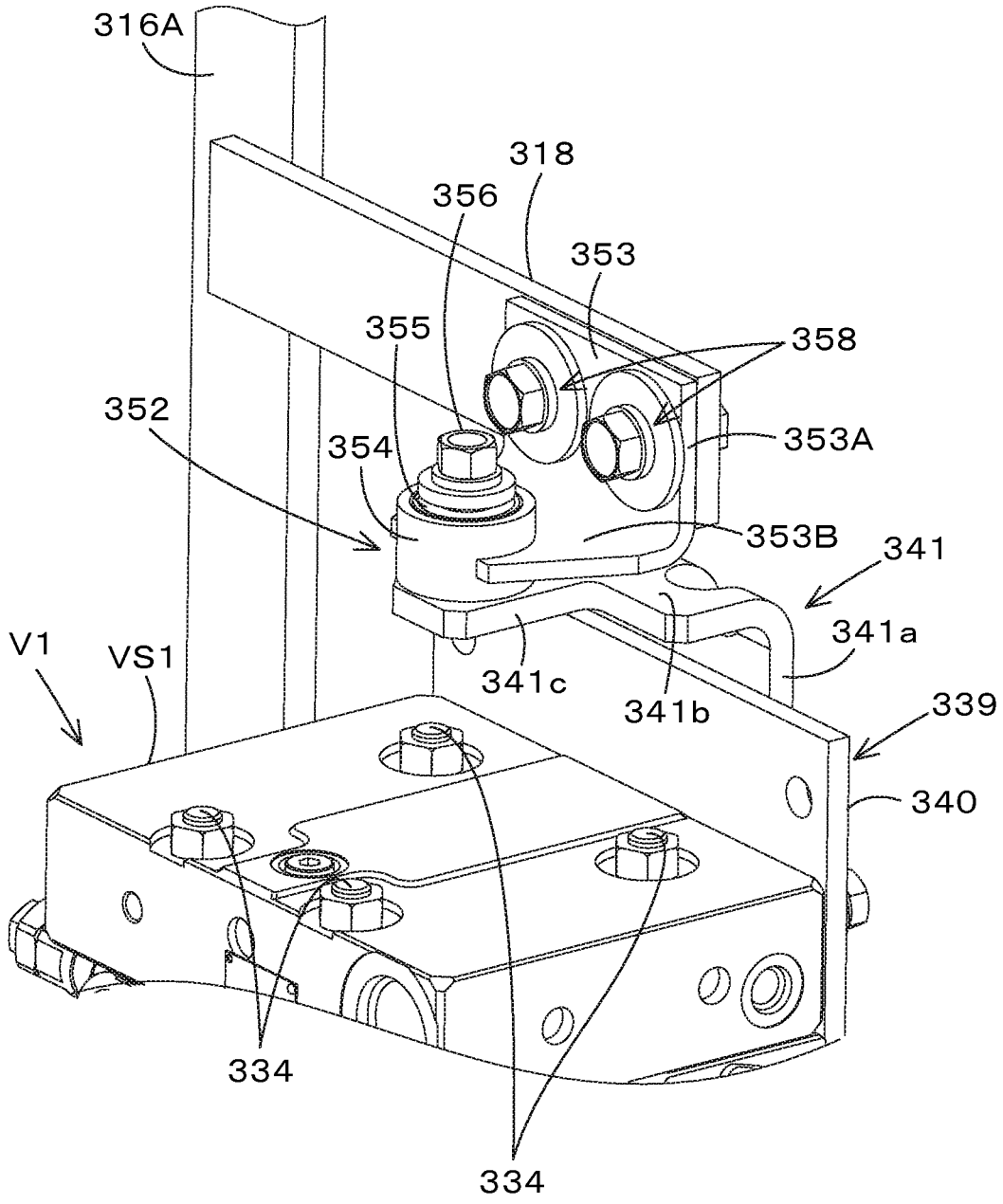
FIG. 39 is a diagonal view illustrating a support structure of an upper portion of the control valve.
Figure 41:
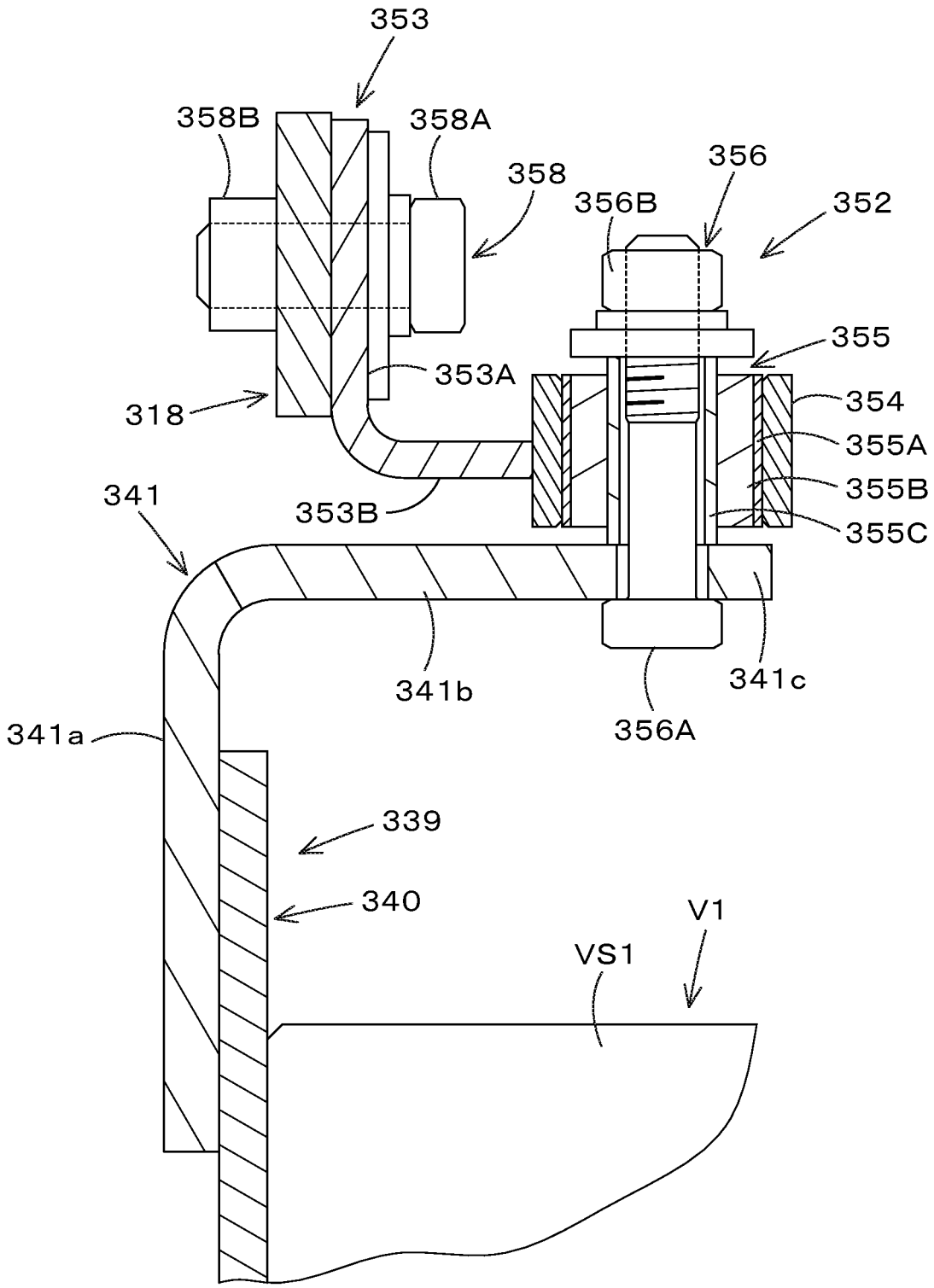
FIG. 41 is a cross-section view of the support structure of the upper portion of the control valve.

As shown in FIGS. 39, 40, and 41, the anti-sway member 352 includes an attachment stay 353, a retaining cylinder 354, an anti-vibration bushing 355, and an attachment tool 356.

As shown in FIG. 41, the attachment stay 353 is attached to the protruding frame 318. In detail, the attachment stay 353 includes an attachment wall 353A and a support wall 353B. The attachment wall 353A is overlaid on the protruding frame 318 and is joined to the protruding frame 318 by a fastener 358. The support wall 353B extends rightward from a lower end of the attachment wall 353A. The fastener 358 includes a bolt 358A inserted through the attachment wall 353A and the protruding frame 318, and a nut 358B screwed onto the bolt 358A.

As shown in FIG. 41, a retaining cylinder 354 is formed to have a vertically axial cylindrical shape, and is fixed to the supporting wall 353B. The anti-vibration bushing 355 includes an outer cylinder 355A, a cylindrical elastic member 355B adhered inside the outer cylinder 355A, and a sleeve 355C adhered inside the elastic member 355B.

As shown in FIG. 41, the second plate portion 341*b* includes an attachment wall 341*c*, and a fastener 356 includes a bolt 356A and a nut 356B. The bolt 356A is inserted through the attachment wall 341*c* from below the second plate portion 341*b*, and is also inserted through the sleeve 355C, and the nut 356B is screwed onto the bolt 356A.

The anti-sway member 352 suppresses a horizontal swaying of the valve base 337 and the control valve V1 while absorbing horizontal vibrations of the valve base 337 and the control valve V1 by the anti-vibration bushing 355.

Figure 42:
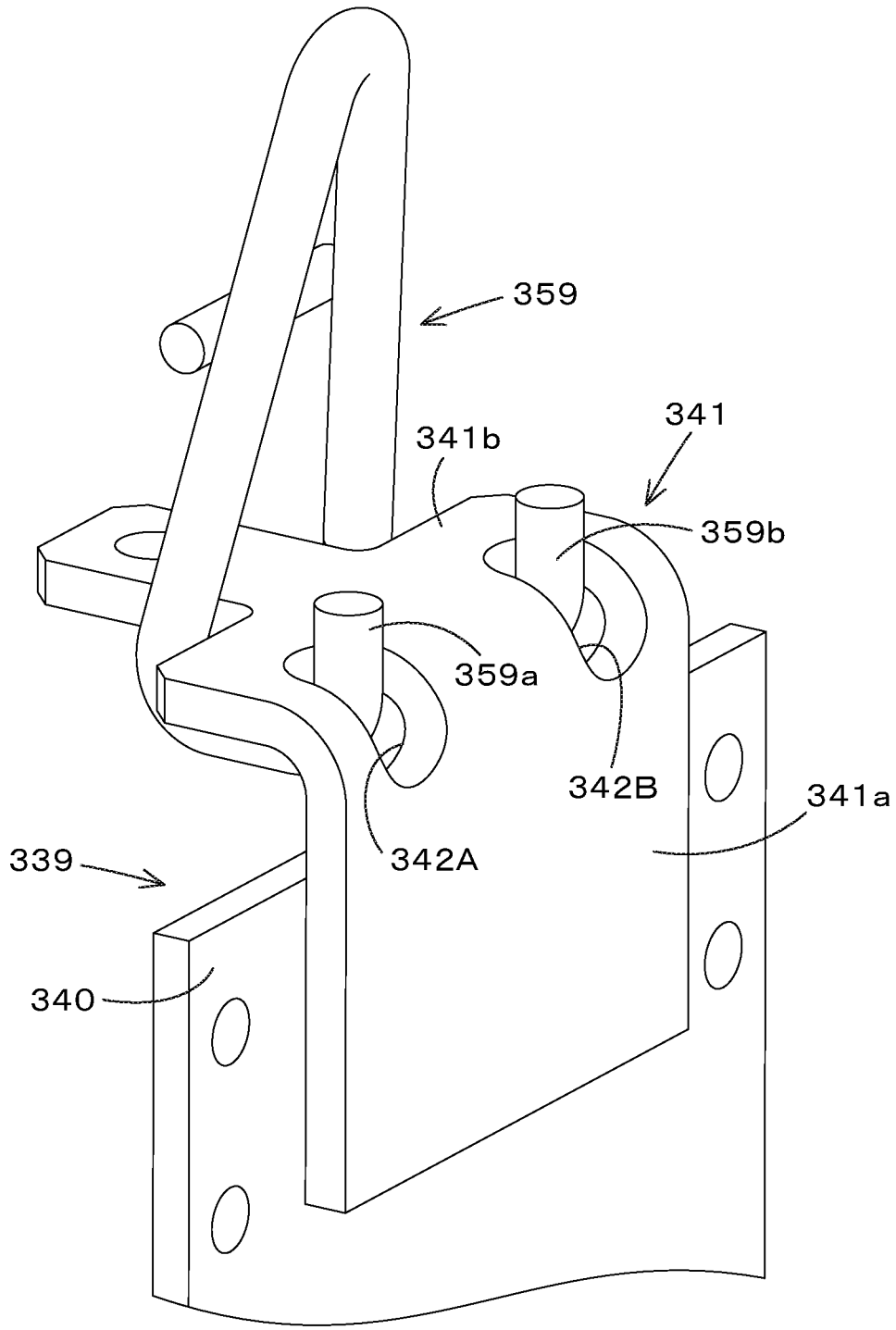
FIG. 42 is a diagonal view of a suspending tool.
Figure 43:
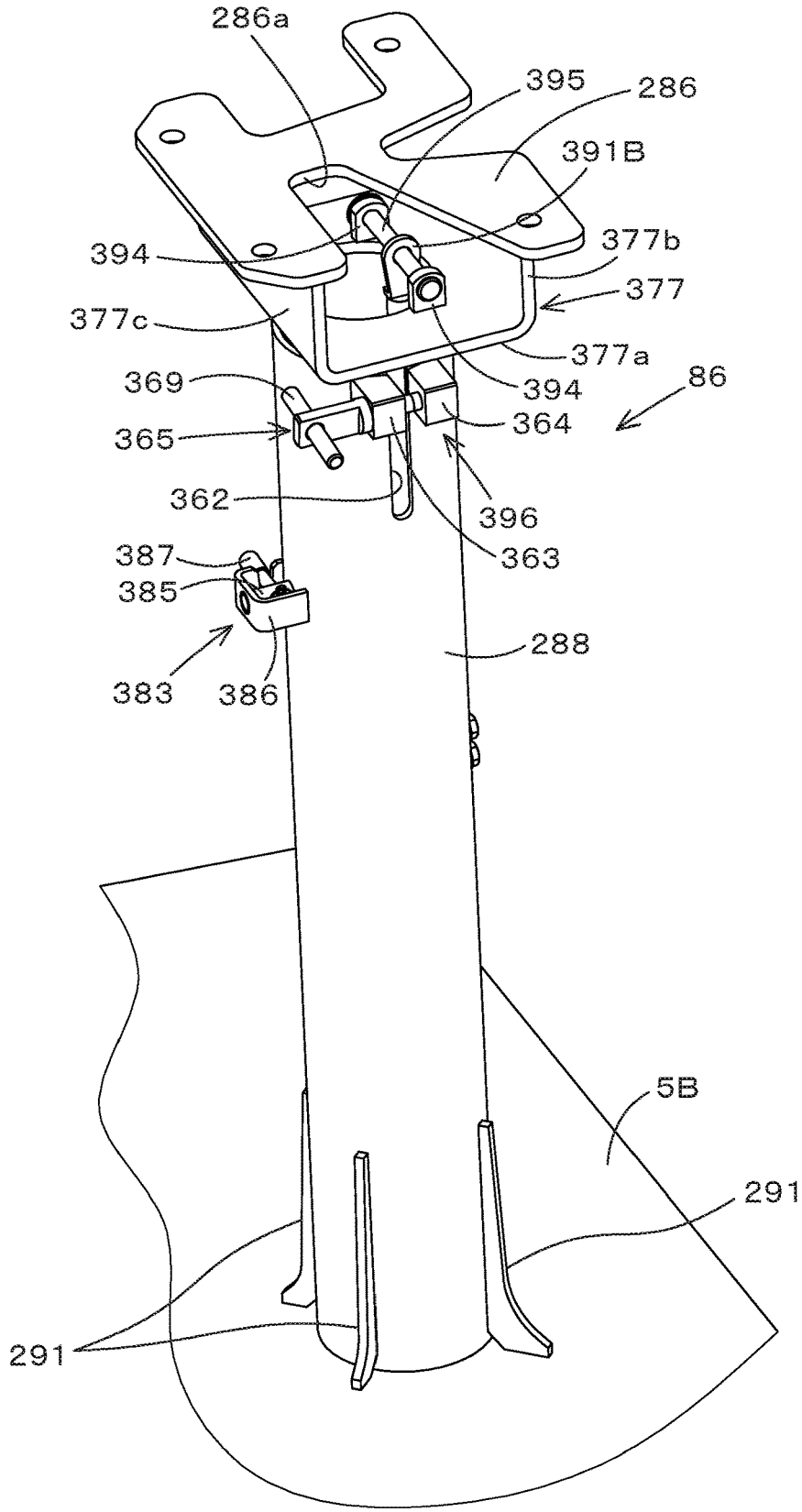
FIG. 43 is a diagonal view of an elevation device seen from the right back according to an alternative embodiment.

As shown in FIG. 42, the first engagement portion 342A and the second engagement portion 342B formed in the connecting plate 341 are portions to which a suspension tool 359 for suspending the valve base 337 is engaged. The suspension tool 359 includes a first hooking portion 359A inserted into the first engagement portion 342A and a second hooking portion 359B inserted into the second engagement portion 342B. Since the connecting plate 341 is formed with both the engagement portions 342A and 342B to which the suspension tool 359 is engaged, the structure can be simplified through the dual use of the component.

FIGS. 43 to 60 show alternative embodiments.

FIGS. 43 to 48 show an alternative embodiment of the elevation device 86.

Figure 45:
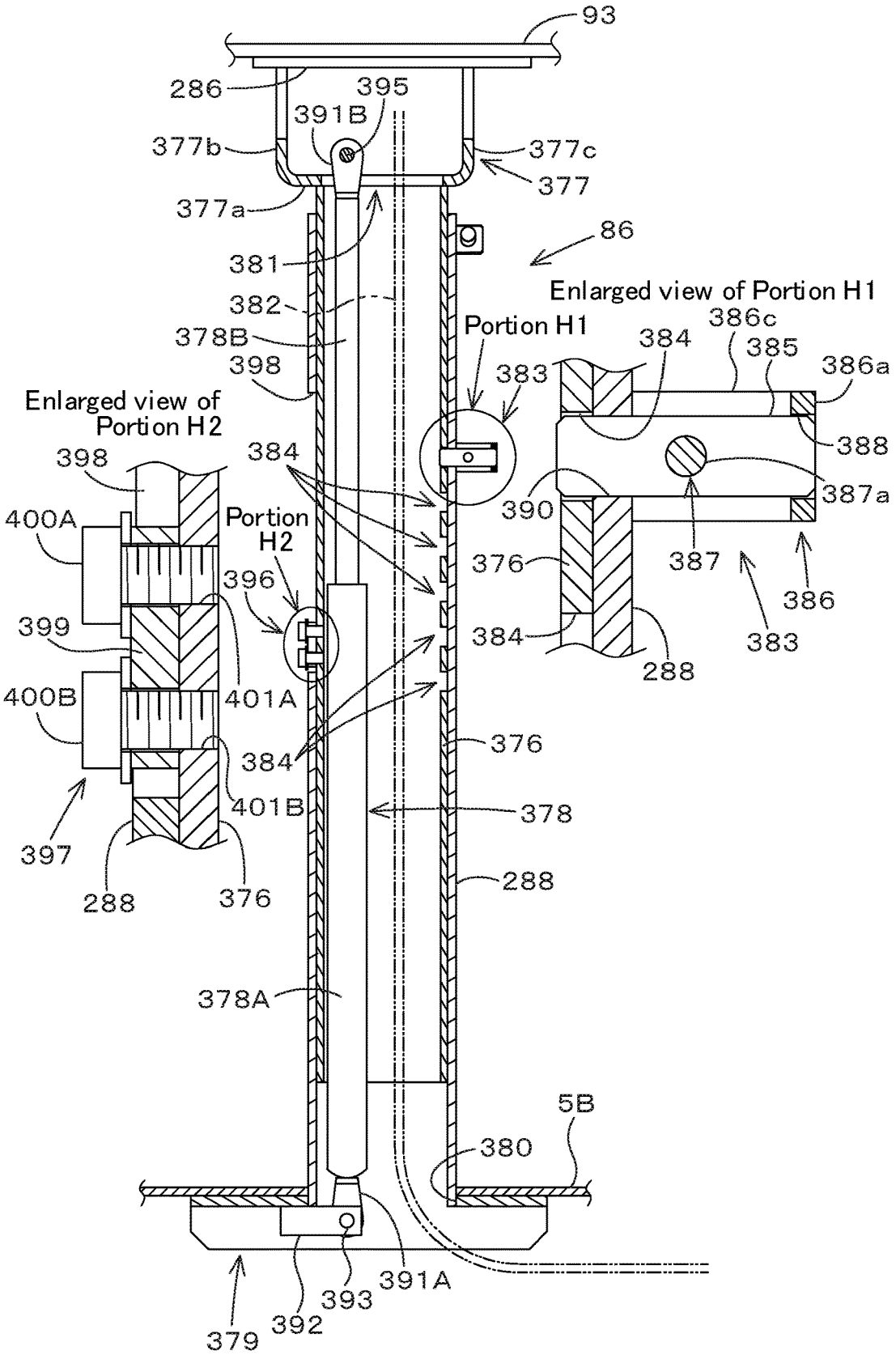
FIG. 45 is a side cross-section view of the elevation device according to the alternative embodiment.
Figure 46:
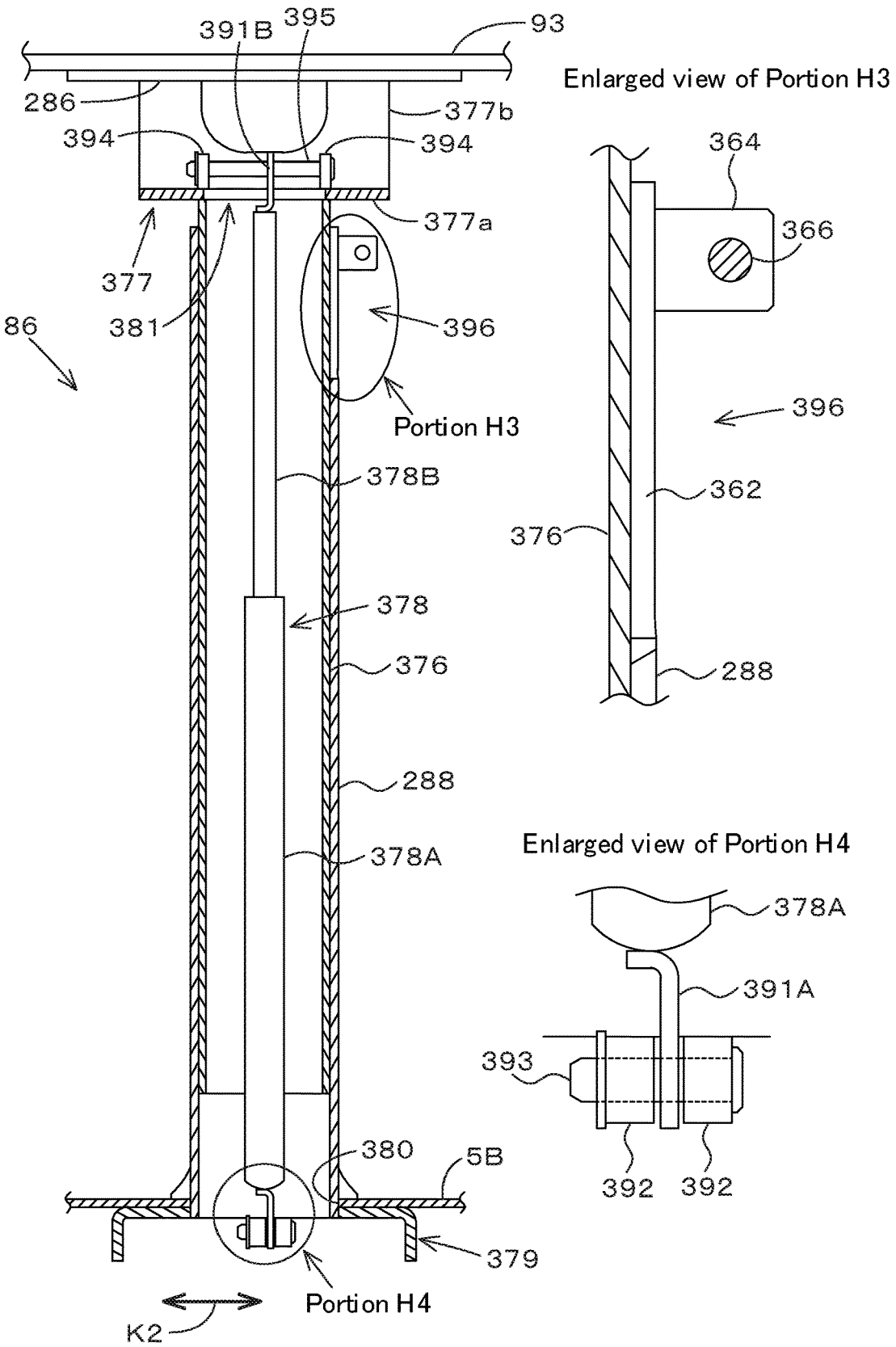
FIG. 46 is a back cross-section view of the elevation device according to the alternative embodiment.

As shown in FIGS. 45 and 46, the elevation device 86 includes the attachment plate 286, the support pipe 288, an elevation cylinder 376, a connecting member 377, and a gas spring 378. The attachment plate 286 is attached to the attachment base 93. The support pipe 288 has a vertically axial cylindrical shape, is provided with openings at upper and lower ends thereof, and is extended upward from the floor portion 5B. The support pipe 288 is provided on the lower portion thereof with reinforcing ribs 291 (see FIG. 43) which are fixed to the floor portion 5B.

Figure 47:
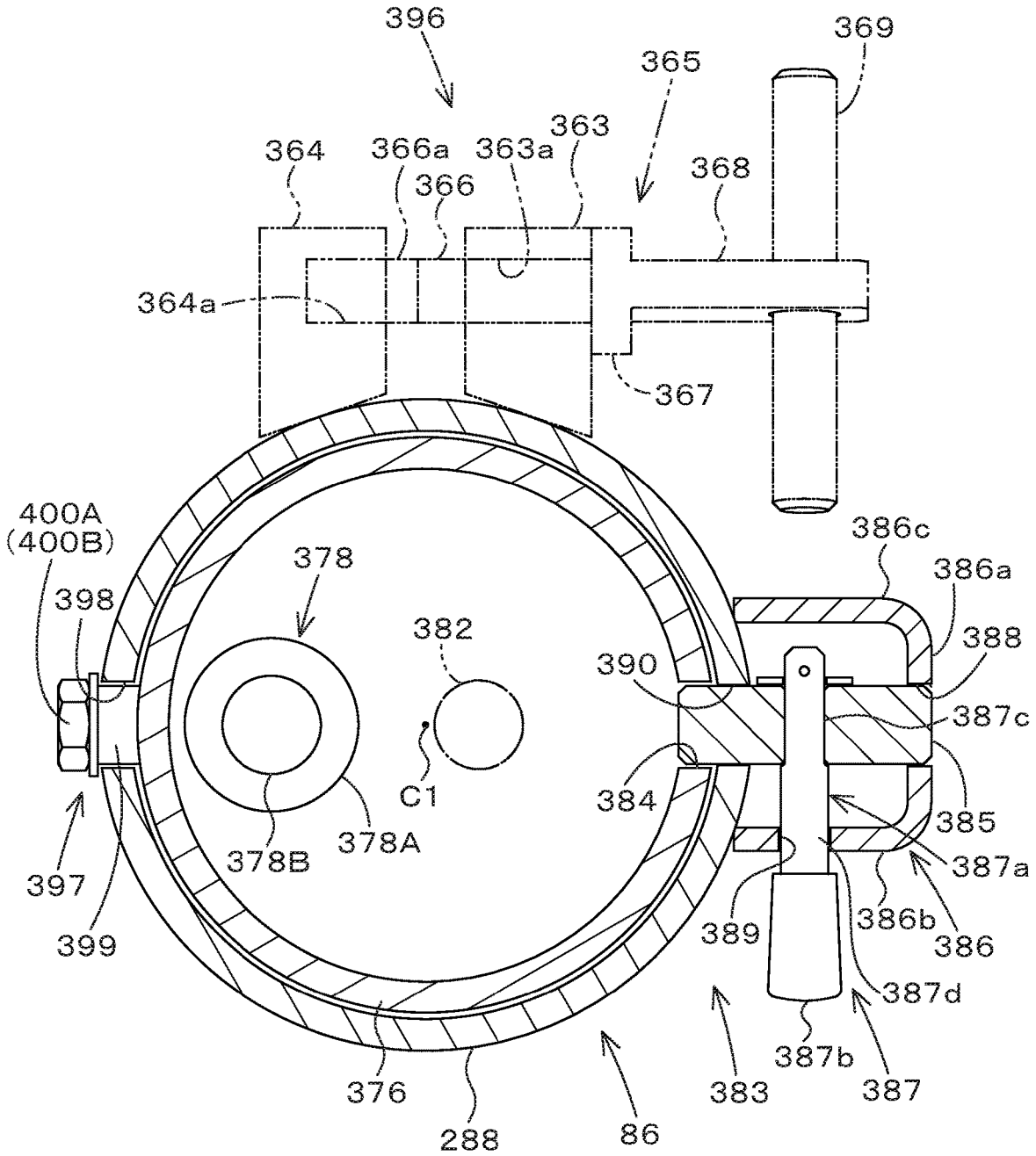
FIG. 47 is a plan cross-section view of the elevation device according to the alternative embodiment.

As shown in FIGS. 46 and 47, a reinforcing plate 379 is fixed to a lower surface of the floor portion 5B, a through hole 380 penetrates through the floor portion 5B and the reinforcing plate 379, and a lower portion of the support pipe 288 is inserted through the through hole 380. Accordingly, the lower end opening of the support pipe 288 is communicated with a space below the floor portion 5B.

As shown in FIGS. 45 to 47, the elevation cylinder 376 has a cylindrical shape with a slightly smaller diameter than the diameter of the support pipe 288, is provided with openings at its upper and lower ends, and is inserted into the support pipe 288. The elevation cylinder 376 is capable of moving with respect to the support pipe 288 in the axial direction (vertical direction).

As shown in FIGS. 45 and 46, a connecting member 377 includes a lower wall 377*a*, a front wall 377*b* extending upward from a front portion of the lower wall 377*a*, and a rear wall 377*c* extending upward from a rear portion of the lower wall 377*a*. An upper end of the elevation cylinder 376 is fixed to a lower surface of the lower wall 377*a*. Upper ends of the front wall 377*b* and the rear wall 377*c* are fixed to a lower surface of the attachment plate 286. Accordingly, the attachment plate 286 is attached to the elevation cylinder 376 with the connecting member 377, and the elevation cylinder 376 is lifted and lowered (moves up and down) together with the attachment base 93. In addition, by lifting and lowering the elevation cylinder 376, the vertical position of the attachment base 93 can be adjusted.

As shown in FIG. 45, a communication opening 381 is formed in the lower wall 377*a* of the connecting member 377, and is joined to the upper end opening of the elevation cylinder 376. In this alternative embodiment, a harness 382 connected to the devices (such as the manipulator 82, monitor 84, and switches) attached to the attachment base 93 is extended into the elevation cylinder 376 from the devices-attached portion of the attachment base 93 through a cut-out portion 286*a* (see FIG. 43) formed on the attachment plate 286, the communication opening 381, and the upper end opening of the elevation cylinder 376. The harness 382 passed through the elevation cylinder 376 is extended to below the floor portion 5B through the lower end opening of the elevation cylinder 376 and the lower end opening of the support pipe 288. The harness 382 is flexed below the floor portion 5B to allow vertical movement of the devices attached to the attachment base 93.

As shown in FIG. 45, the elevation device 86 includes a position adjuster portion 383 configured to adjust the vertical position of the elevation cylinder 376 (attachment base 93). The position adjuster portion 383 is provided on a rear half portion (the operator seat 6 side) of the elevation device 86. The position adjuster portion 383 includes a plurality of lock holes 384 formed in the elevation cylinder 376 and a lock pin 385 provided in the support pipe 288 and selectively insertable to one of the lock holes 384. The lock holes 384 are arranged at intervals in the vertical direction. By inserting the lock pin 385 into one of the lock holes 384, the vertical movement of the elevation cylinder 376 relative to the support pipe 288 is stopped. By removing the lock pin 385 entirely from the lock hole 384, the vertical movement of the elevation cylinder 376 relative to the support pipe 288 is permitted. To adjust the vertical position of the attachment base 93, the lock pin 385 is removed entirely from the lock hole 384, then the elevation cylinder 376 is moved up and down to adjust the position of the attachment base 93, and then the lock pin 385 is inserted into the lock hole 384 at the adjusted position to stop the vertical movement of the elevation cylinder 376. In this embodiment, six lock holes 384 are formed. That is, the vertical position of the attachment base 93 can be adjusted in six steps according to this embodiment.

As shown in FIG. 47, the position adjuster portion 383 includes a support bracket 386 to support the lock pin 385 and an operation member 387 to operate the lock pin 385. The support bracket 386 is fixed to the support pipe 288. In detail, the support bracket 386 includes a first wall 386*a*, a second wall 386*b* and a third wall 386*b*. The first wall 386*a* is spaced rearward from the support pipe 288. The second wall 386*b* extends from a left end portion of the first wall 386*a* to the support pipe 288 and is fixed to the support pipe 288. The third wall 386*b* extends from a right end portion of the first wall 386*a* to the support pipe 288 and is fixed to the support pipe 288. The support hole 388 penetrates through the first wall 386*a*. One end portion (i.e., a rear portion) of the lock pin 385 is inserted and supported into the support hole 388.

Figure 48:
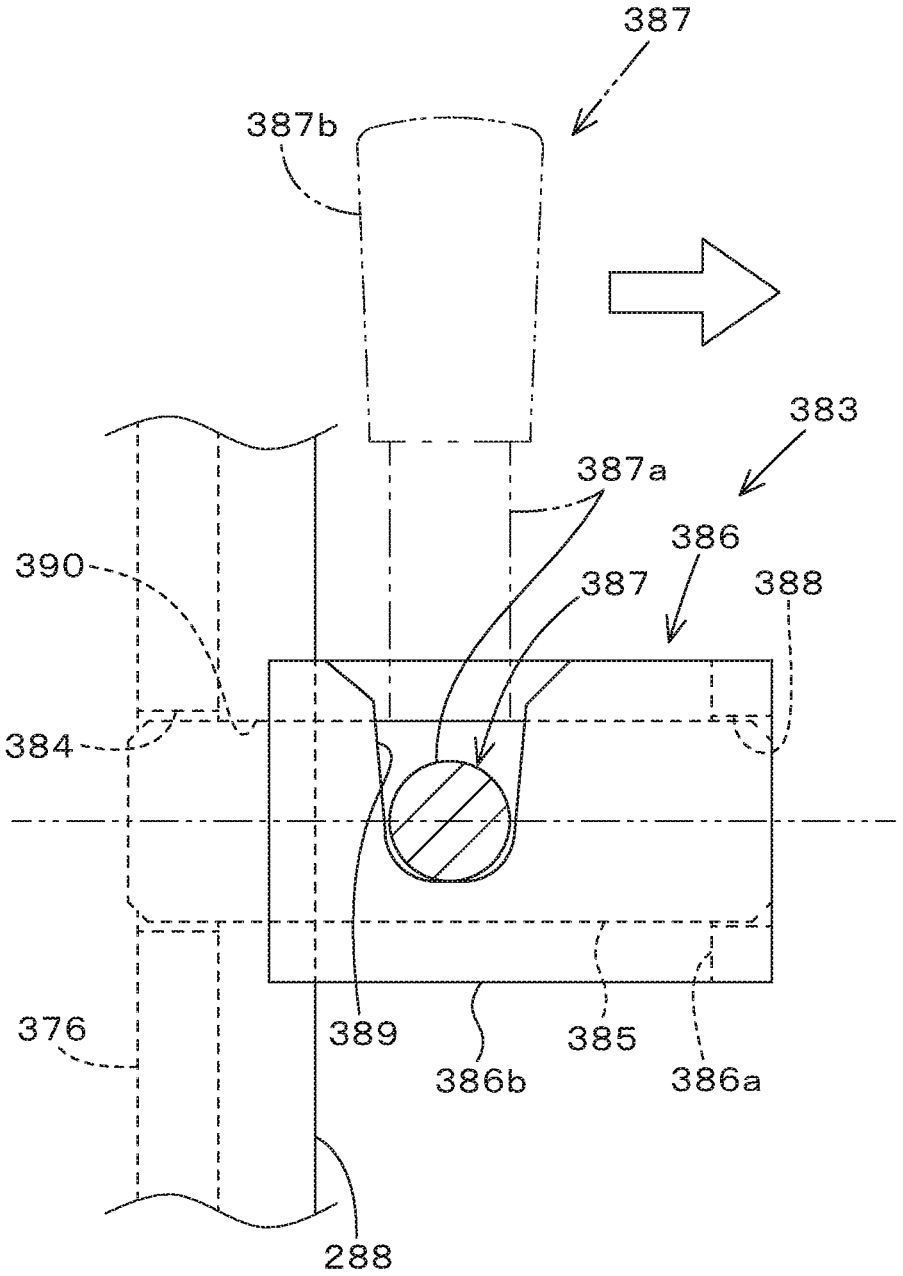
FIG. 48 is a side view of a position adjuster portion.

As shown in FIG. 48, the second wall 386 is formed with a regulation groove 389 extending downward from an upper end of the second wall 386. The regulation groove 389 is formed to have a tapered upper portion that is widened upward, and a vertically straight lower portion. The other end portion (i.e., a front portion) of the lock pin 385 is inserted into one of the lock holes 383 through a through hole 390 formed in the support pipe 288. The lock pin 385 is axially movably supported in the support hole 388 and the through hole 390.

The operation member 387 includes a rod 387*a* attached to the lock pin 385 and a knob 387*b* fixed to the rod 387*a*. One end portion of the rod 387*a* is defined as a penetrating portion 387*c* that is passed crossingly (orthogonally) through a middle portion (a center portion) of the lock pin 385. The knob 387*b* is fixed to the other end portion of the rod 387*a*. A portion (i.e., a regulated portion) 387*d* of the rod 387 between the penetrating portion 387*c* and the knob 387*b* can be inserted into the regulating groove 389 under a state where the front portion of the lock pin 385 is inserted into the lock hole 384. By fitting the regulated portion 387*d* in the regulating groove 389, an axial (fore-and-aft) movement of the lock pin 385 is regulated, and the lock pin 385 is prevented from escaping from the lock hole 384. By grasping the knob 387*b* and rotating the operation member 387 upward around the axis of the lock pin 385, the regulated portion 387*d* (of the rod 387) is released from the regulating groove 389 as shown by the virtual line in FIG. 48. In this manner, the lock pin 385 is allowed to move in the axial direction. From this state, the lock pin 385 can be removed entirely from the lock hole 384 when the operation member 387 is moved away from the support pipe 288 as shown by the arrowed line in FIG. 48.

The gas spring 378 is a spring to bias the elevation cylinder 376 and the attachment plate 286 upward so as to assist the upward movement of the elevation cylinder 376 and the attachment plate 286. As shown in FIGS. 46 and 47, the gas spring 378 includes a cylinder tube 378A and a piston rod 378B inserted into the cylinder tube 378A and protruding from the cylinder tube 378A, thereby being telescopically movable in the length direction thereof. The gas spring 378 uses a reaction force of compressed gas pushing the piston rod 378B in the extension direction, and is incapable of staying at any telescopic movement position. That is, the gas spring 378 according to this alternative embodiment is an inexpensive (low-cost) spring incapable of stopping the piston rod 378B at any position in the length direction with respect to the cylinder tube 378A.

As shown in FIGS. 45 and 46, the gas spring 378 is inserted along the axial direction into the elevation cylinder 376 so as to have the piston rod 378B extended upward. As shown in FIG. 47, the gas spring 378 is located at a position deviated (in this embodiment, forward) from a center C1 of the elevation cylinder 376. Accordingly, an arrangement space for arranging (inserting) the harness 382 is provided in a rear half portion of the elevation cylinder 376.

As shown in FIG. 46, a pivot tab (referred to as a first pivot tab) 391A is fixed to a lower end portion of the cylinder tube 378A (one end portion of the gas spring 378). The first pivot tab 391A is pivotally supported on a pivot pin 393 by at least one support block 392 fixed to the reinforcing plate 379. In this embodiment, two support blocks 392 are arranged side by side in the machine width direction K2. The pivot pin 393 has an axis extending in the machine width direction K2.

As shown in FIG. 46, a pivot tab (referred to as a second pivot tab) 391B is fixed to an upper end portion of the piston rod 378B (the other end portion of the gas spring 378). The second pivot piece 391B is pivotally supported on a pivot pin 395 by at least one support blocks 394 fixed to the connecting member 377 (or the lower wall 377*a*). In this embodiment, two support blocks 394 are arranged side by side in the machine width direction K2. The pivot pin 395 has an axis extending in the machine width direction K2.

Figure 44:
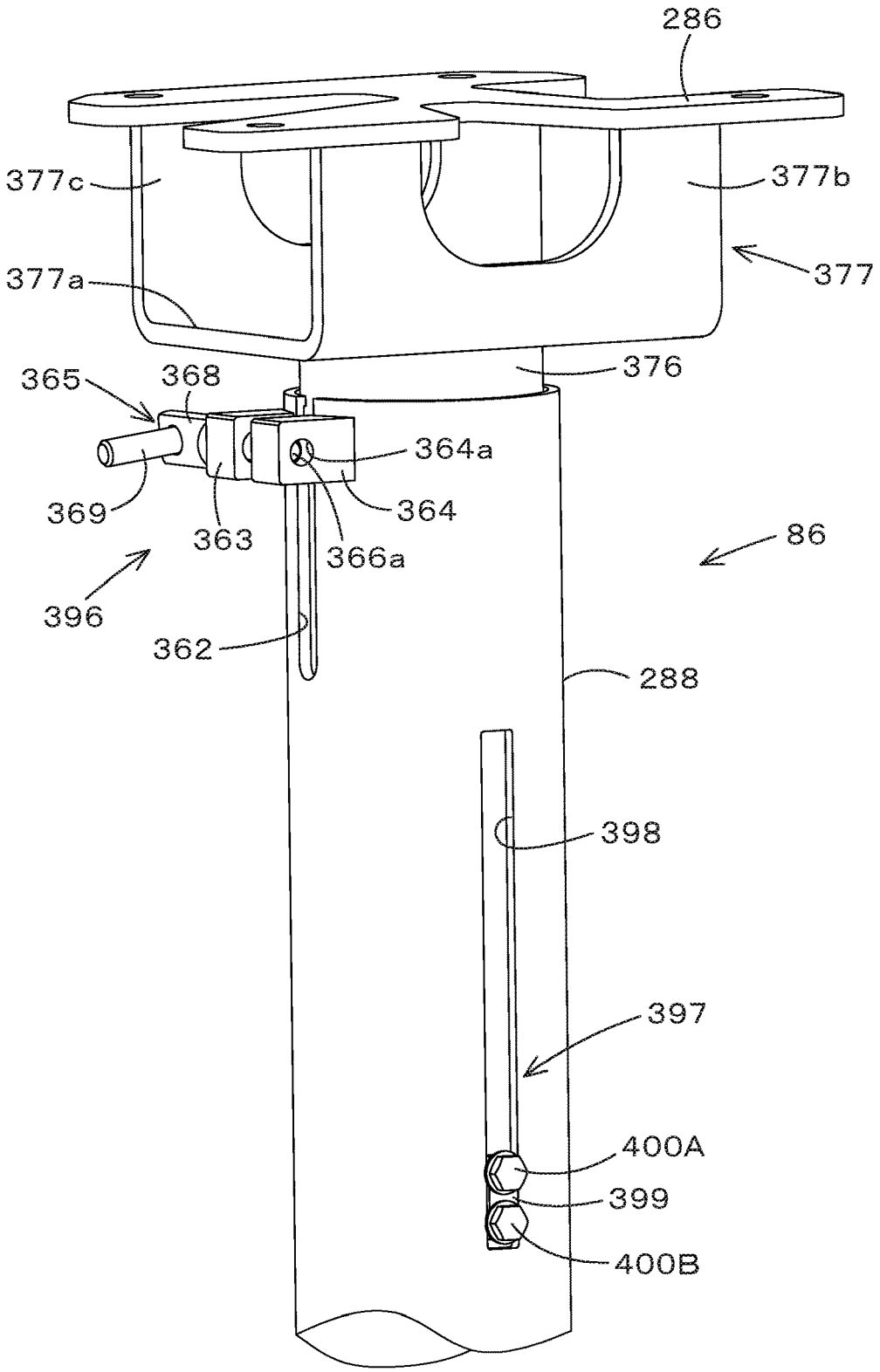
FIG. 44 is a diagonal view of the elevation device seen from the right front according to the alternative embodiment.

As shown in FIGS. 44, 46 and 47, the elevation device 86 includes a fixing portion 396 that fixes the elevation cylinder 376 to the support pipe 288 to prevent the elevation cylinder 376 from rattling. Since the fixing portion 396 has the same configuration as the configuration of the fixing portion 361 described in the foresaid first embodiment, description is omitted by appending the same sign to similar components and portions.

As shown in FIGS. 44 and 45, the elevation device 86 includes a vertical movement limiter 397 configured to regulate the lifting and lowering limits of the gas spring 378. The vertical movement limiter 397 is provided at a front portion of the elevation device 86. The vertical movement limiter 397 includes a long hole 398 formed in the support pipe 288 and a regulation member 399 attached to the elevation cylinder 376. The long hole 398 is formed in a front upper portion of the support pipe 288. The long hole 398 is elongated in the vertical direction, and penetrates through the support pipe 288.

The regulation member 399 is inserted through the long hole 398 and is brought in contact with a front surface of the elevation cylinder 376. The regulation member 373 is formed to have a rectangular shape long in the longitudinal direction of the long hole 398, and is attached to the elevation cylinder 376 with a first bolt 400A and a second bolt 400B. The first bolt 400A penetrates through the regulation member 399, and is screwed into a threaded hole 401A formed in the elevation cylinder 376. The second bolt 400A is located below the first bolt 400A, and penetrates through the regulation member 399 and screwed into a threaded hole 401B formed in the elevation cylinder 376. The regulation member 399 slightly protrudes from the long hole 398 in the direction opposite to the elevation cylinder 376, so that tightening forces of the first bolt 400A and the second bolt 400B do not act on the support pipe 288. The regulation member 373 may be attached to the elevation cylinder 376 by welding, riveting, or the like.

In the vertical movement limiter 397, an upper end of the regulation member 399 contacts an upper end of the long hole 398 to define an extension limit of the gas spring 378, and a lower end of the regulation member 399 contacts a lower end of the long hole 398 to define a contraction limit of the gas spring 378. In this manner, over-extension and over-contracting of the gas spring 378 can be prevented, and the vertical position adjustment of the attachment base 93 can be allowed. In addition, by defining the extension limit of the gas spring 378, the upward movement limit position of the attachment base 93 is defined as a predetermined position, and by defining the contracting limit of the gas spring 378, the downward movement limit position of the attachment base 93 is defined as a predetermined position. Accordingly, the vertical movement limiter 397 defines the upward movement limit position and the downward movement limit position of the attachment base 93 as predetermined positions. In addition, the vertical movement limiter 397 has a rotation-stopping function that restricts axial rotation of the elevation cylinder 376 relative to the support pipe 288.

The vertical movement limiter 397 can be modified in various ways. For example, the long hole 398 may be formed in the elevation cylinder, and the regulation member 399 may be attached to the support pipe 288.

FIGS. 49 to 53 show the duct structure body 296 according to an alternative embodiment.

Figure 49:
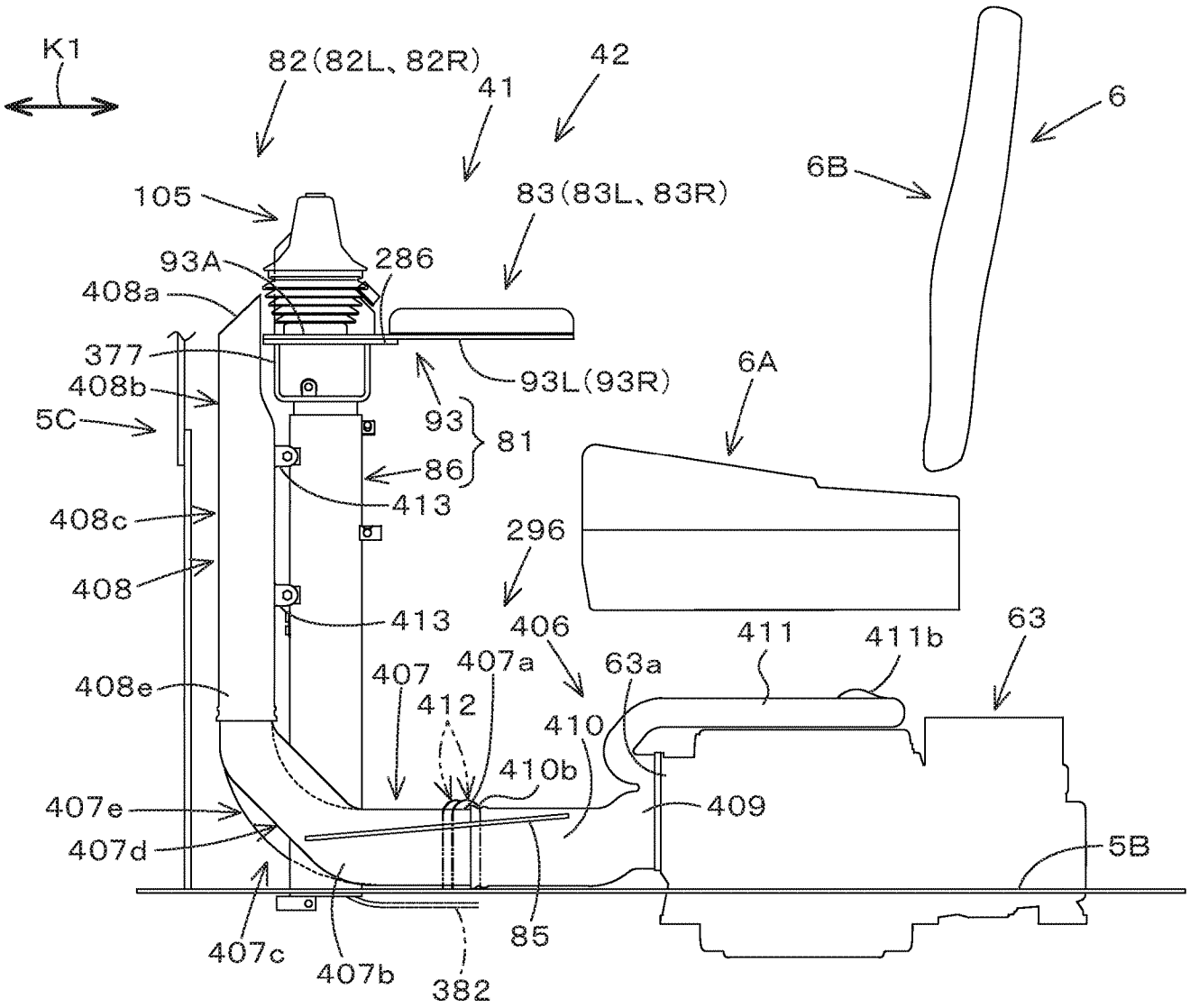
FIG. 49 is a side view of a operator section according to an alternative embodiment.

First, an outline of the duct structure body 296 according to this alternative embodiment will be described. As shown in FIG. 49, above the floor portion 5B, the duct structure body 296 extends forward from the air conditioner body 63, and extends upward between the steering device 41 and the front window 5C. In this alternative embodiment, by arranging the duct structure body 296 above the floor portion 5B, an arrangement path of the harness 382 in the space below the floor portion 5B can be secured, and sufficient flexing allowance for the harness 382 also can be secured. In addition, as shown in FIG. 51, the duct structure body 296 branches at the rear side of the manipulation device 41, passes through the left and right sides of the manipulation device 41, and then merges at the front side of the manipulation device 41 (see FIG. 50). In this manner, the duct structure body 296 can be extended from the air conditioner body 63 located below the operator seat 6 to the position between the steering device 41 and the front window 5C at a short distance, even when the manipulation device 41 is located in front of the operator seat 6, thereby suppressing a reduction in air volume.

This duct structure body 296 is described in detail below.

As shown in FIG. 49, the duct structure body 296 includes a first duct 406, a second duct 407 and a third duct 408. The first duct 406 is connected to the blowing outlet 63*a* of the air-conditioner body 63. The second duct 407 is located above the floor portion 5B, is joined to the first duct 406, and is extended forward from the first duct 406. The third duct 408 is provided between the steering device 41 and the front window 5C and is connected to the second duct 407.

Figure 50:
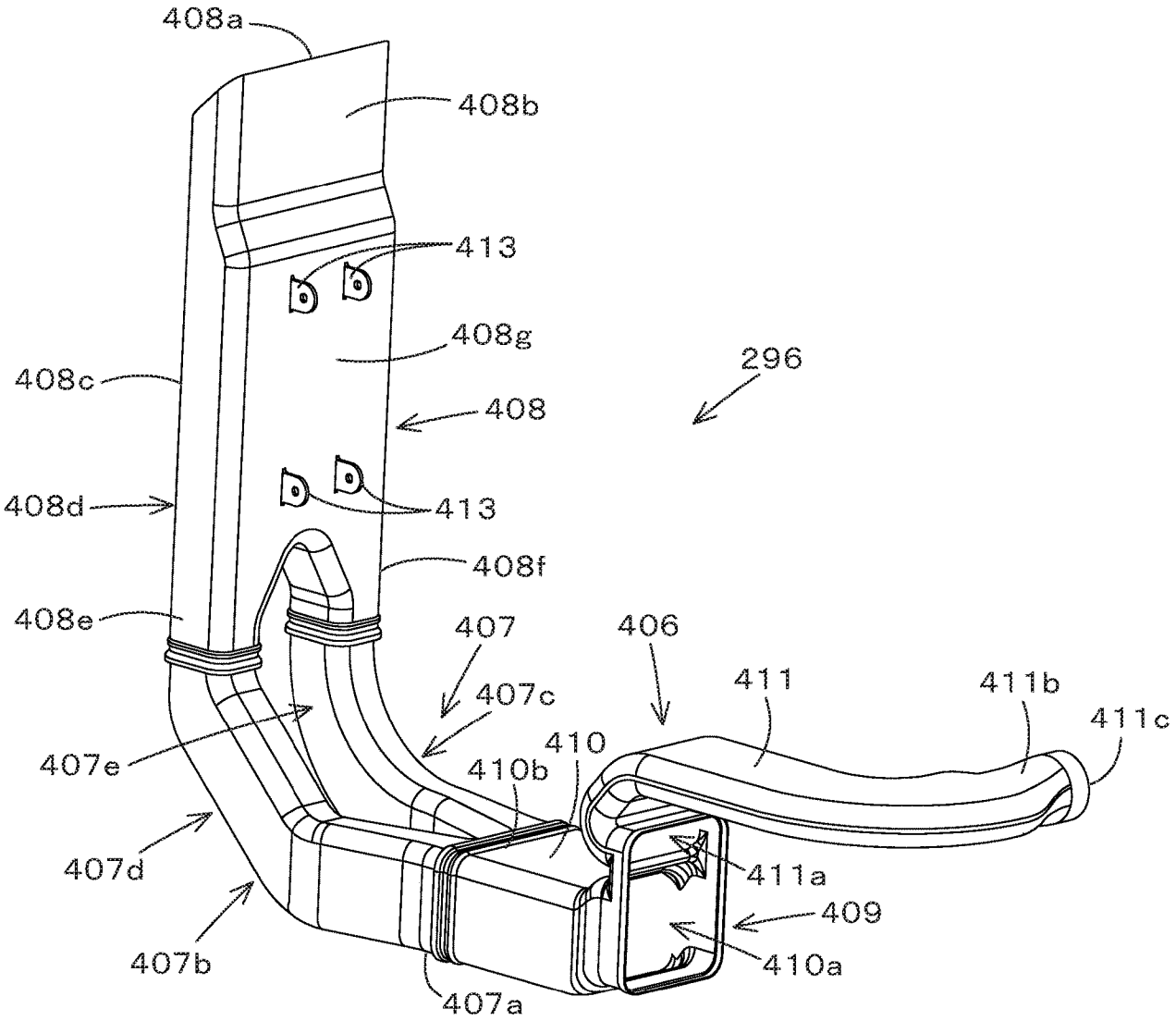
FIG. 50 is a diagonal view of a duct structural body according to the alternative embodiment.
Figure 51:
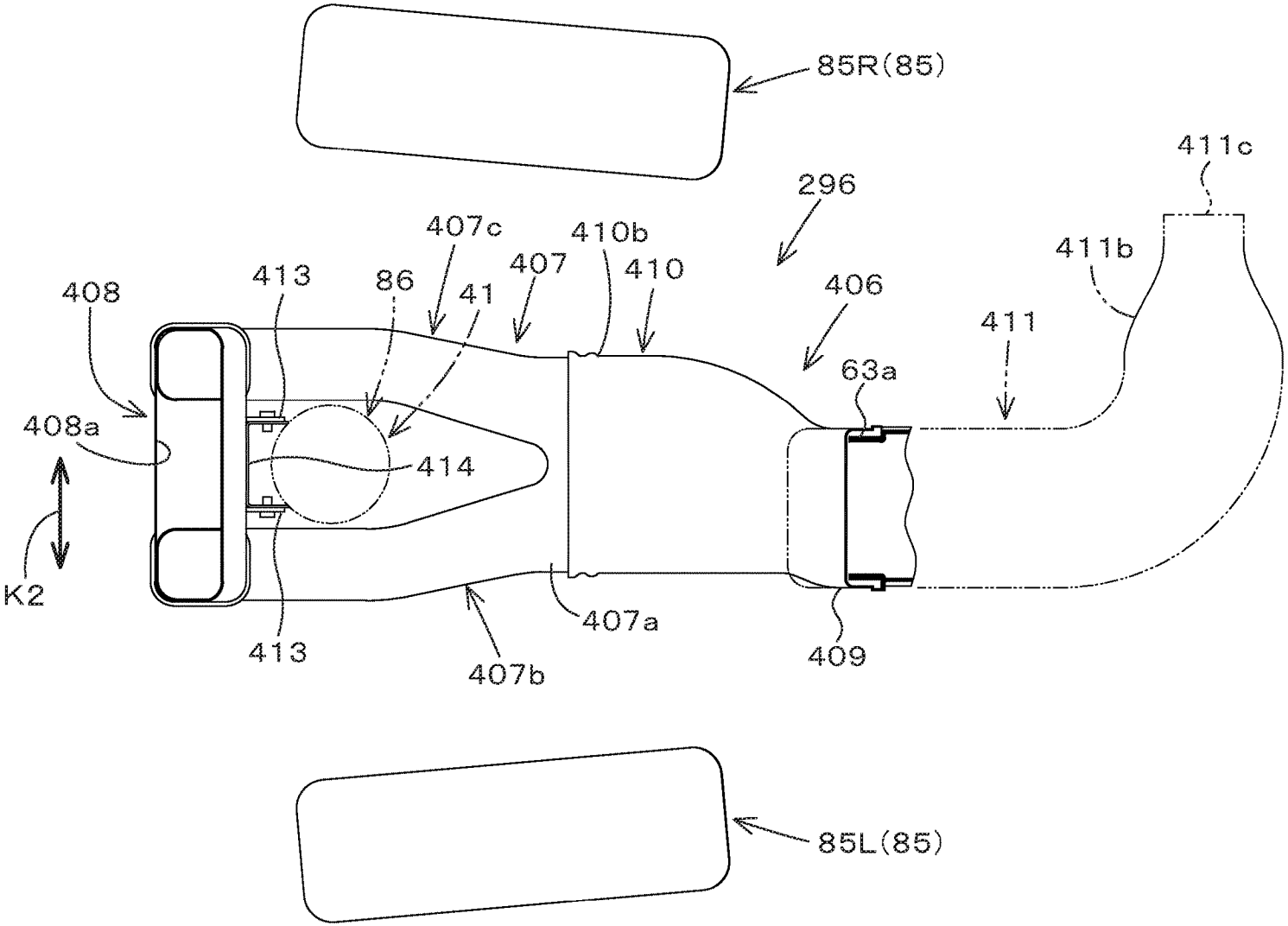
FIG. 51 is a plan view of the duct structural body according to the alternative embodiment.
Figure 53:
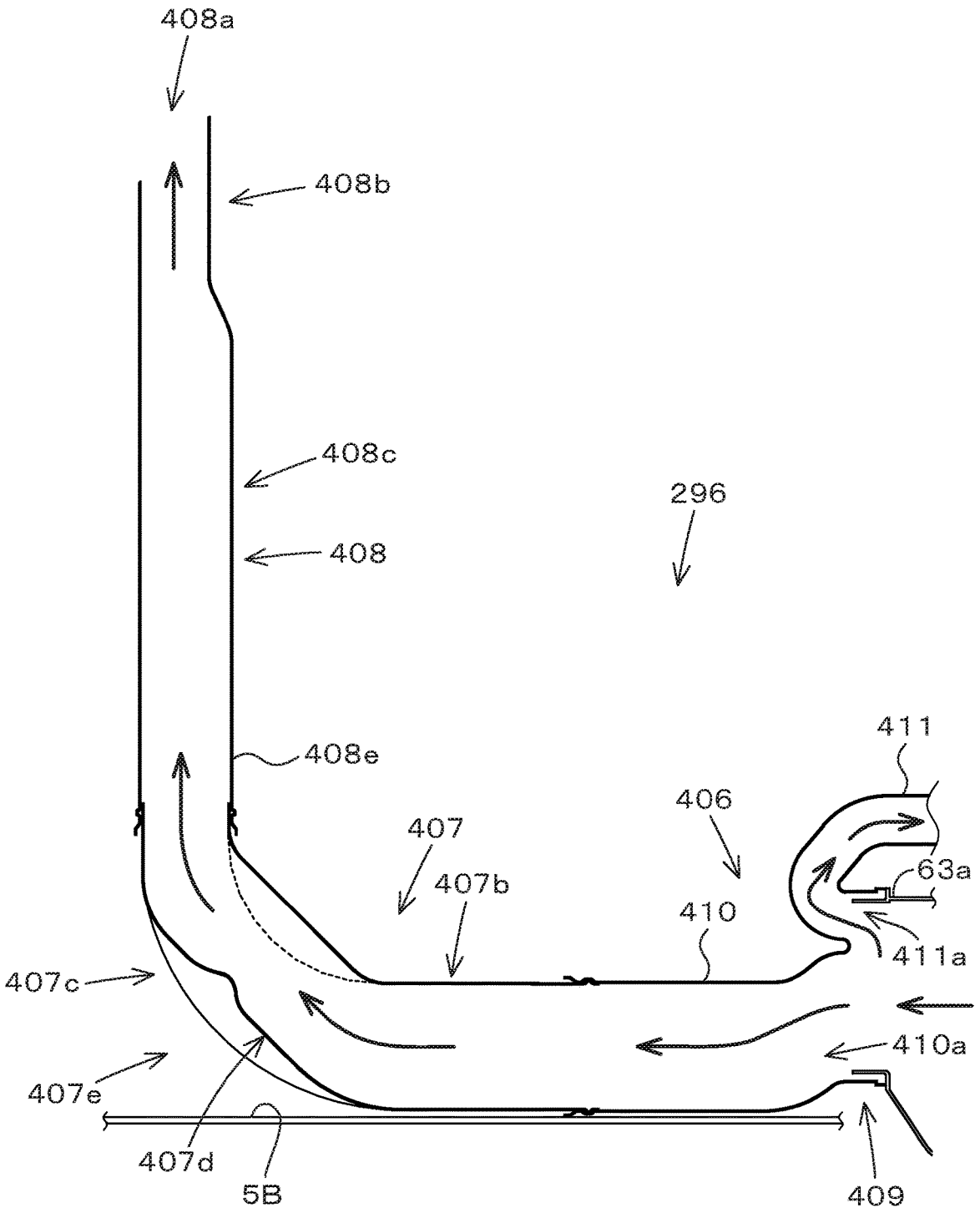
FIG. 53 is a side cross-section view of the duct structural body according to the alternative embodiment.

As shown in FIGS. 49, 50, and 53, the first duct 406 includes a connection port 409, a main duct portion 410, and a side duct portion 411. The connection port 409 is formed to have a rectangular shape in a back view (in a cross section), and is connected to the blowing outlet 63*a* of the air-conditioner body 63. The main duct portion 410 extends forward from a lower portion of the connection port 409, and is connected to the second duct 407. The side duct portion 411 branches from an upper portion of the connection port 409. In addition, the side duct portion 411 is bent rearward from the connection port 409, and extends rearward above the air conditioner body 63 and below the operator seat 6. The side duct portion 411 includes a rear portion 411*b* extending laterally (rightward) below a rear portion of the operation seat 6, and opens to a space on the side of the operator seat 6. Accordingly, the side duct portion 411 blows the air-conditioned air from the air conditioner body 63 to the space on the side of the operation seat 6.

As shown in FIG. 51, the side duct portion 411 includes a second blowing portion 411*c* that blows out the air-conditioned air, and the second blowing portion 411*c* is located on the machine inward directional side with respect to the second traveling pedal 85R. In this manner, the operator's foot can be prevented from contacting the side duct portion 411 when the operator moves his/her foot rearward from the second traveling pedal 85R.

As shown in FIG. 53, the opening area of the communication port 410*a* of the main duct portion 410 communicated with the connection port 409 is larger than the opening area of the communication port 411*a* of the side duct portion 411 communicated with the connection port 409.

As shown in FIG. 49, the main duct portion 410 and the rear half portion of the second duct 407 (the portion rearward from the elevation device 86) is located lower than an upper end of a pedal bracket 412 erected on the floor portion 5B to support the traveling pedal 85. In this manner, the duct structure body 296 can be prevented from being an obstacle against an operator who boards on and gets off the machine.

As shown in FIG. 51, the second duct 407 includes a rear portion 407*a* connected to the front portion 410*b* of the main duct portion 410. In addition, the second duct 407 includes a first branching portion 407*b* and a second branching portion 407*c* each branched from the rear portion 407*a*.

The first branching portion 407*b* extends forward from a left side of the rear position 407*a*. The first branching portion 407*b* extends to the front side of the elevation device 86 through the left side (or one side) of the elevation device 86 (or the manipulation device 41). In addition, the first branching portion 407*b* is extended upward at the left side of the elevation device 86.

The second branching portion 407C extends forward from a right side of the rear portion 407*a*. The second branching portion 407*c* extends to the front side of the elevation device 86 through the right side (or the other side) of the elevation device 86 (or the manipulation device 41). In addition, the second branching portion 407*c* is extended upward at the right side of the elevation device 86.

As shown in FIG. 51, a space between the first duct 406 and the second duct 407 in the machine width direction K2 is gradually widened forward (to the elevation device 86) from the rear position 407*a*, and has a constant width at a front portion thereof forward from the elevation device 86. In addition, as shown in FIG. 53, the first branching portion 407*b* is inclined forwardly upward, and the second branching portion 407*c* is curved forwardly upward. These configurations allow the air-conditioned air to flow smoothly in the second duct 407.

As shown in FIG. 51, the duct structure body 296 (the first duct 406 and the second duct 407) are located between the first traveling pedal 85L and the second traveling pedal 85R. By branching the second duct 407 into the first branching portion 407*b* passing through the left side of the elevation device 86 and the second branching portion 407*c* passing through the right side of the elevation device 86, and extending the first and second branching portions 407*b* and 407*c* forward, the second duct 407 can be placed away from the traveling pedals 85 (i.e., the first traveling pedal 85L and the second traveling pedal 85R) (or placed closer to the elevation device 86). In this manner, the duct structure body 296 (i.e., the second duct 407) can be prevented from interfering with the operation of the traveling pedal 85.

Figure 52:
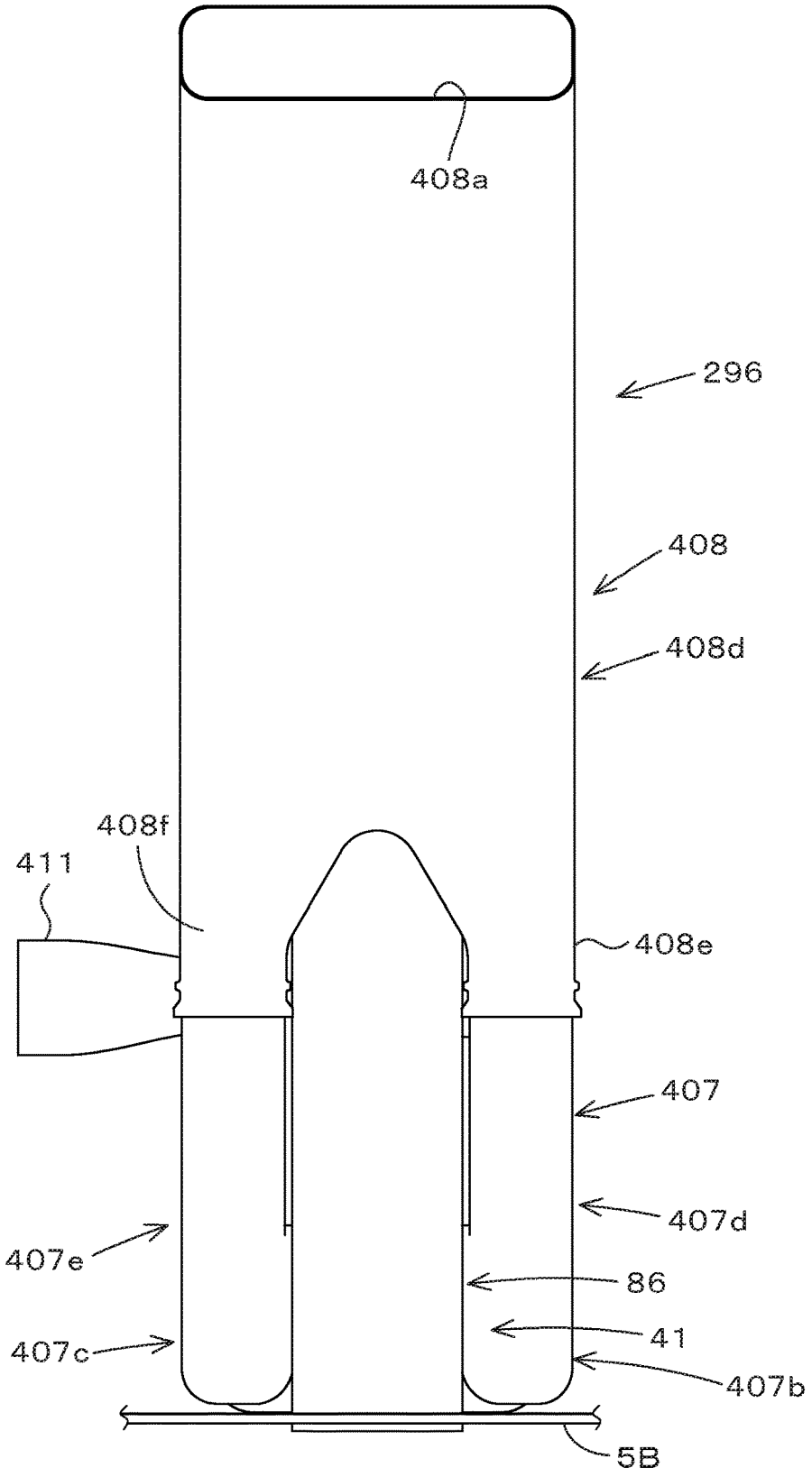
FIG. 52 is a front view of the duct structural body according to the alternative embodiment.

As shown in FIGS. 52 and 53, the third duct 408 includes a first blower portion 408*a* extending upwardly rearward and defining a rectangular opening at an upper end thereof. As shown in FIG. 49, the third duct 408 includes an upper portion 408*b* and a lower portion 408*c*, such that a longitudinal width of the upper portion 408*b* in the fore-and-aft direction K1 of the machine is less than that of the lower portion 408*c*. Therefore, according to this alternative embodiment, the third duct 408 is configured to prevent reduction of the flow velocity of the air-conditioned air blown out from the first blower portion 408*a*.

As shown in FIG. 50, the third duct 408 includes a forked portion 408*d* in the lower portion 408*c*. The forked portion 408*d* includes a first connecting portion 408*e* a second connecting portion 408*f*. The first connecting portion 408*e* is connected to a rising portion 407*d* of the first branching portion 407*b*, and the second connecting portion 408*f* is connected to a standing portion 407*e* of the second branching portion 407*c*. In addition, two pairs of attachment tabs 413 are provided on a rear surface 408*g* of the third duct 408, so that each pair of attachment tabs 413 are arranged side by side in the machine width direction K2, and so that the two pairs of attachment tabs 413 are arranged up and down in the vertical direction. As shown in FIG. 51, the attachment tabs 413 are attached with bolts or the like to an attachment stay 414 fixed to the elevation device 86 (i.e., the support pipe 288).

FIGS. 54 to 60 show an alternative embodiment of the receptacle 331 for receiving oil that flows down when removing the oil filter 322.

Figure 54:
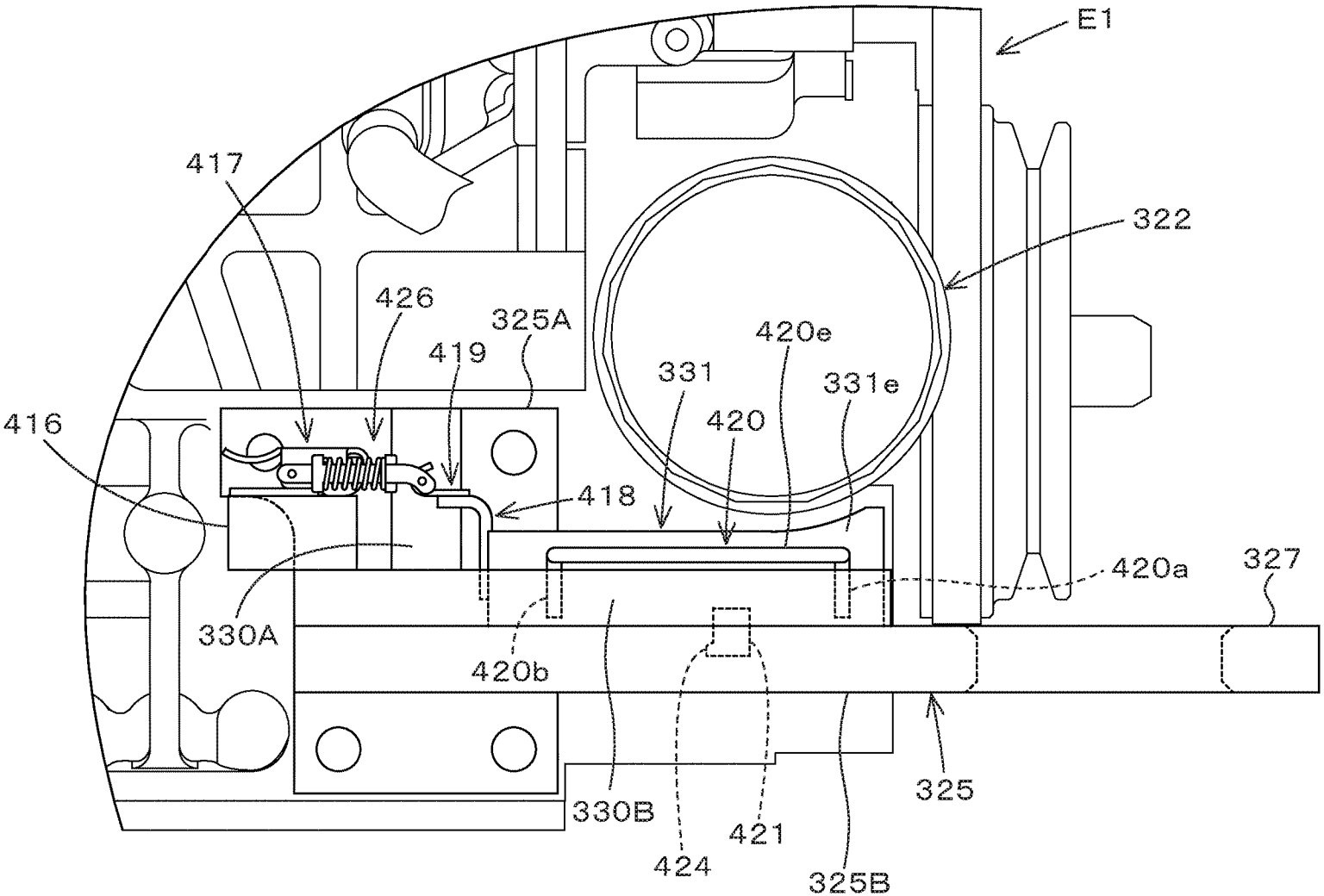
FIG. 54 is a side view of an attachment portion of a receptacle according to an alternative embodiment.
Figure 55:
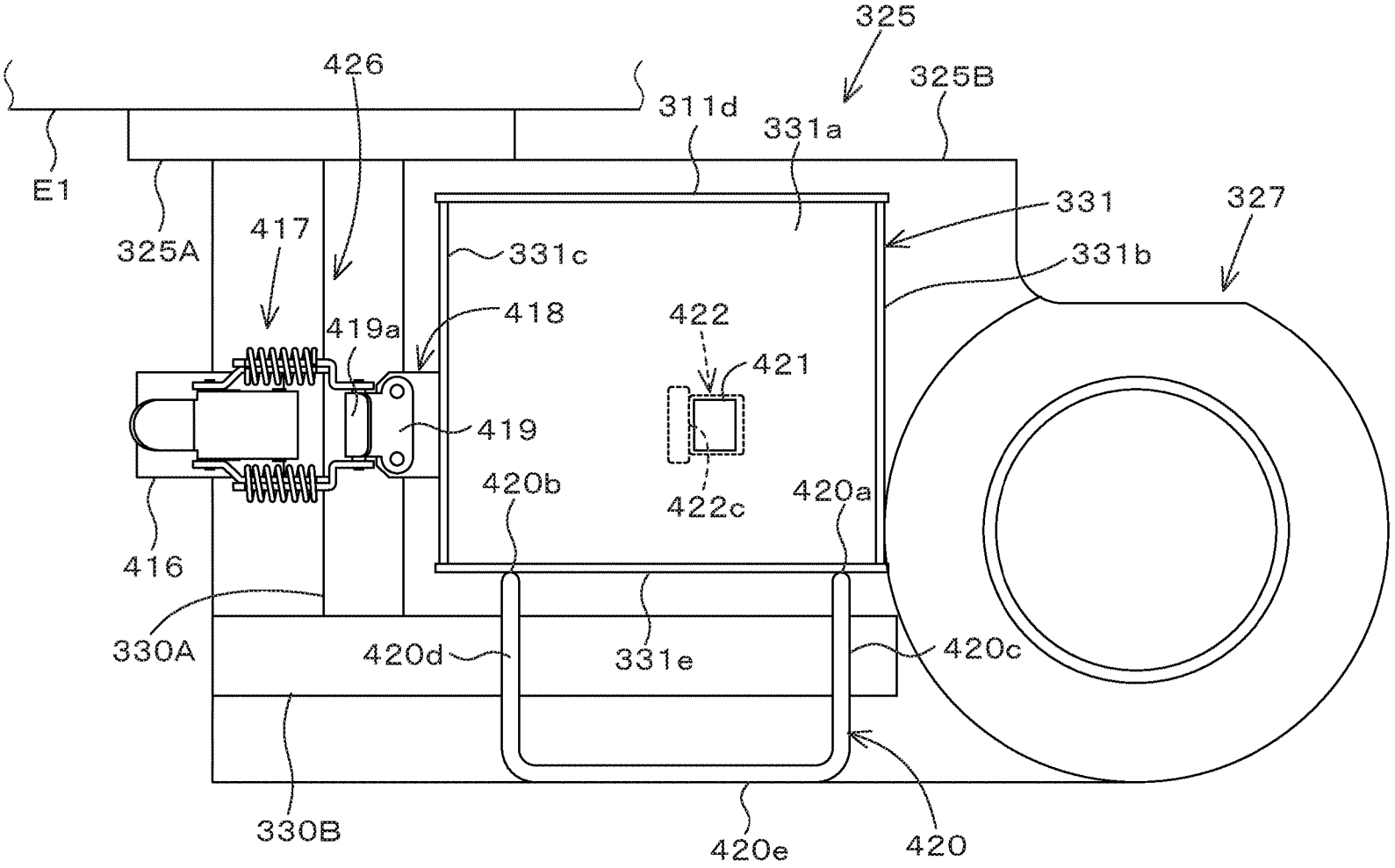
FIG. 55 is a plan view of the receptacle, a support base, and a fixing mechanism according to the alternative embodiment.
Figure 56:
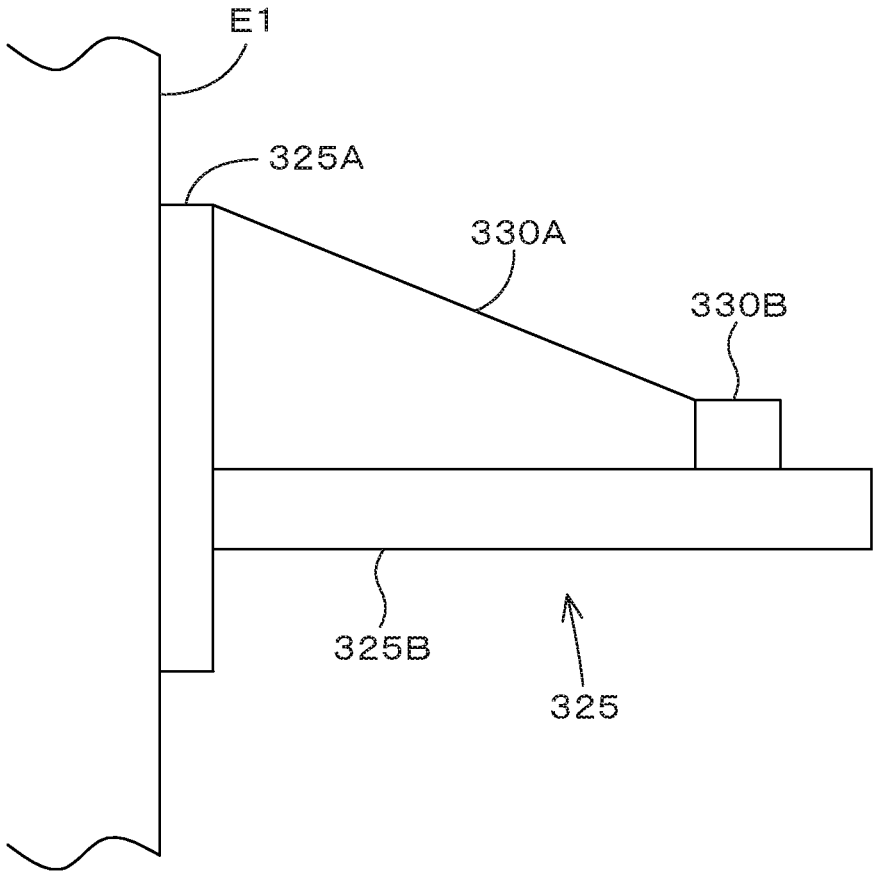
FIG. 56 is a back view of the support base according to the alternative embodiment.

In this alternative embodiment, the support base 325 is configured in a manner similar to the configuration of the first embodiment. That is, as shown in FIGS. 54, 55, and 56, the support base 325 includes the first plate 325A attached by a plurality of bolts to the right side surface of the prime mover E1, and the second plate 325B whose rear portion is fixed to the side surface of the first plate 325A. In addition, while the front portion of the second plate 325B is defined as the mount attachment portion 327, the first reinforcing portion 330A and the second reinforcing member 330B are fixed to the rear portion of the second plate 325B.

An attachment base 416 to which a later-discussed locking tool 417 is attached is fixed to the rear portion of the second plate 325B. The attachment base 416 is located between the first plate 325A and the second reinforcing member 330B. The attachment base 416 includes an upper wall portion 416*a*, a first side wall portion 416*b* and a second side wall portion 416*c*. The first side wall portion 416*b* extends downward from a left end of the upper wall portion 416*a* and is fixed to the second plate 325B, and the second side wall portion 416*c* extends downward from a right end of the upper wall portion 416*a* and is fixed to the second plate 325B.

As shown in FIG. 55, the receptacle 331 is formed to have a box shape whose upper end is open. In detail, the receptacle 331 includes the bottom wall 331*a* having a rectangular shape, the front wall 331*b* extending upward from the front end of the bottom wall 331*a*, the rear wall 331*c* extending upward from the rear end of the bottom wall 331*a*, the first side wall 331*d* extending upward from the left end of the bottom wall 331*a*, and the second side wall 331*e* extending upward from the right end of the front portion of the bottom wall 331*a*.

Figure 57:
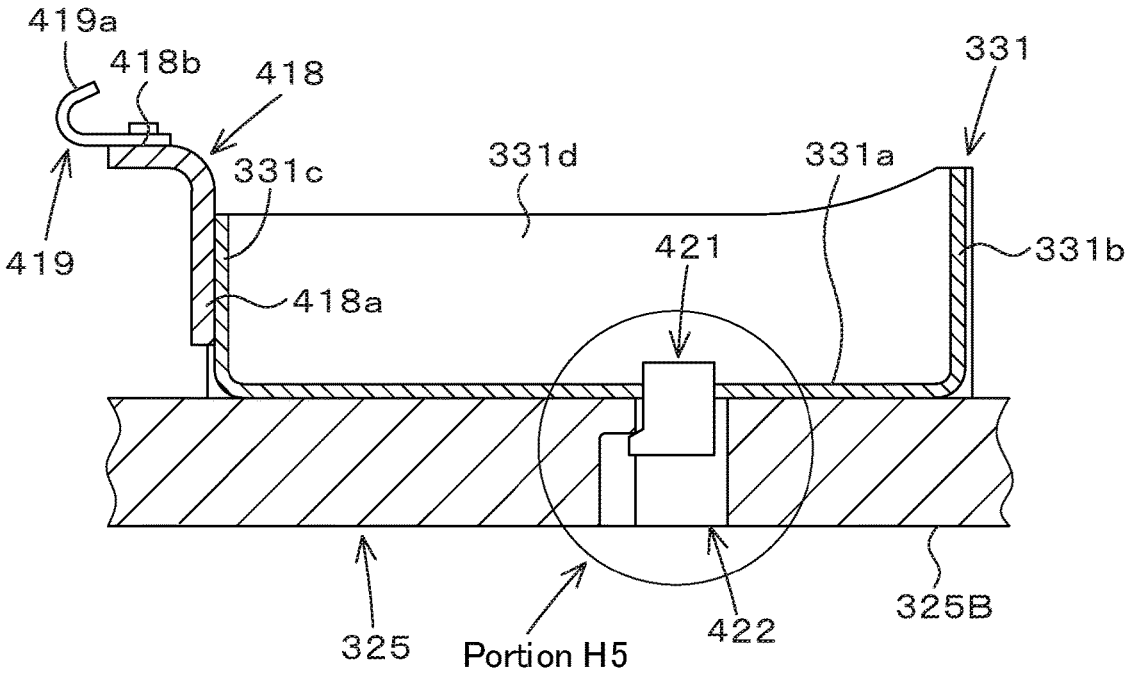
FIG. 57 is a side cross-section view of the attachment portion of the receptacle according to the alternative embodiment.
Figure 57:
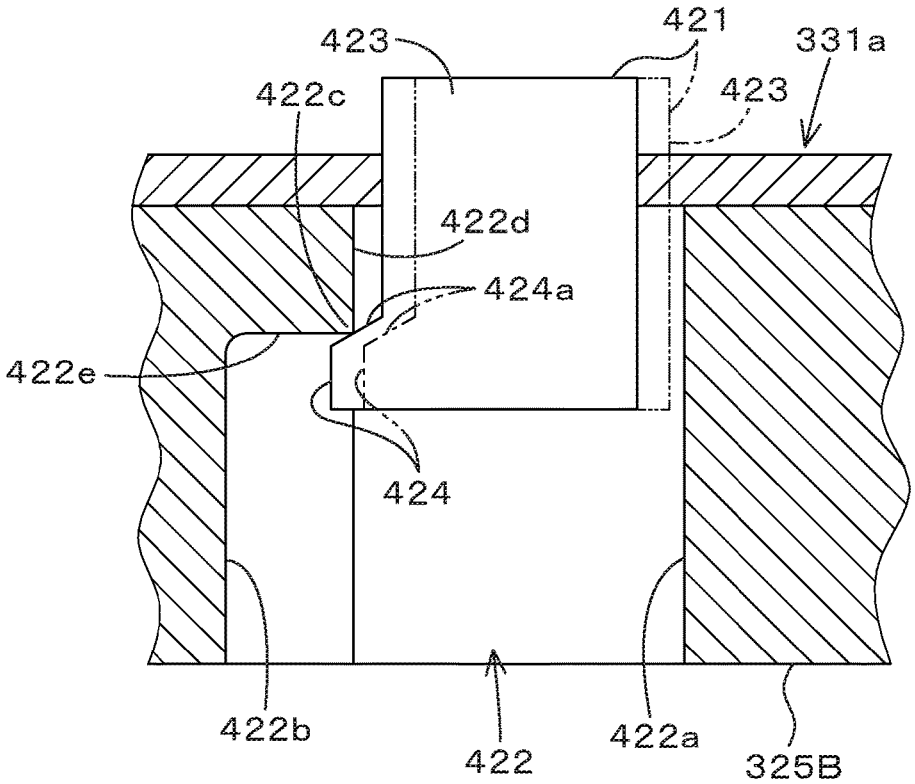

As shown in FIG. 57, the rear wall 331*c* is provided with an attachment stay 418 and a hooking tool 419. The attachment stay 418 includes a vertical wall 418*a* fixed to a rear surface of the rear wall 331*c* and a horizontal wall 418*b* extending rearward from an upper end of the vertical wall 418*a*. As shown in FIG. 55, the attachment stay 418 is located at a position deviated in the machine outward direction from the center portion of the receptacle 331 in the machine width direction K2.

As shown in FIG. 57, the hooking tool 419 includes a front portion attached to a horizontal wall 418*b* of the attachment stay 418, and includes a hook-shaped rear portion defined as a hooking portion 419*a*.

As shown in FIGS. 54 and 55, a handle 420 for holding the receptacle 331 is provided on the second side wall 331*e*. The handle 420 is formed of a bar-shaped member. The handle 420 includes a first bar portion 420*a*, a second bar portion 420*b*, a third bar portion 420*c*, a fourth bar portion 420*d* and a fifth bar portion 420*e*. The first bar portion 420*a* and the second bar portion 420*b* are fixed to a right side surface of the second side wall 331*e* and are spaced from each other in the fore-and-aft direction. The third rod portion 420*c* extends from an upper end of the first bar portion in the machine outward direction above the second reinforcing member 330B. The fourth rod portion 420*d* extends from an upper end of the second bar portion 420*b* in the machine outward direction above the second reinforcing member 330B. The fifth rod portion 420*e* connects a machine-outward side end of the third rod portion 420*c* to a machine-outward side end of the fourth rod portion 420*d*. The fifth bar portion 420*e* serves as a gripper.

As shown in FIG. 57, the receptacle 331 includes a single engagement pin 421 protruding downward from the bottom wall 331*a*. As shown in FIG. 55, the engagement pin 421 is located at a position deviated in the machine outward direction from the center portion of the receptacle 331 in the machine width direction K2, and is located forward from the attachment stay 418 and the hooking tool 419.

Figure 58:
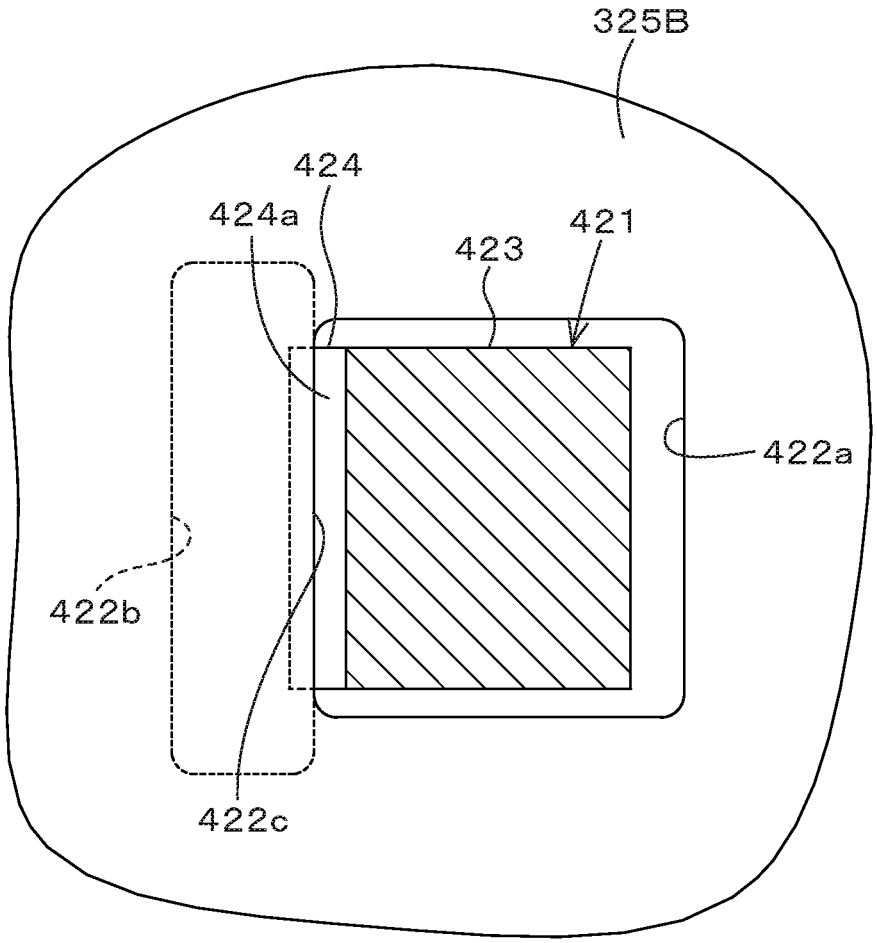
FIG. 58 is a plan cross-section view of an engagement pin and an insertion hole according to the alternative embodiment.

As shown in FIGS. 57 and 58, an engagement pin 421 includes a pin body 423 and a pushing portion 424 provided on the pin body 423. The pin body 423 is formed to have a vertically axial square-columnar shape. An upper portion of the pin body 423 penetrates the bottom wall 331*a*, and is fixed to the bottom wall 331*a*. The pushing portion 424 protrudes rearward from a rear surface of a lower portion of the pin body 423. The pushing portion 424 includes a forwardly upward inclined upper surface defined as a pushing surface 424*a*.

As shown in FIG. 57, the second plate 325B includes an insertion hole 422 through which the engagement pin 421 is inserted under a state where the receiving plate 331 is placed on the second plate 325B.

As shown in FIGS. 57 and 58, the insertion hole 422 includes a first hole portion 422*a* and a second hole portion 422*b*. The first hole portion 422*a* is formed as a square-sectional vertical hole penetrating the second plate 325B. The engagement pin 421 can be inserted downward into the first hole portion 422*a*. The second hole portion 422*b* extends rearward from a rear surface of the first hole portion 422*a* in a vertical range from a vertically middle portion of the first hole portion 422*a* to a lower end of the first hole portion 422*a*.

As shown in FIG. 57, the insertion hole 422 includes an inner surface defined as a contacting portion 422*c* such that, when the engagement pin 421 is inserted into the insertion hole 422, the pushing portion 424 (i.e., the pushing surface 424*a*) can contact the contacting portion 422*c*. The contacting portion 422*c* is defined by a corner portion of the insertion hole 422 formed between a rear surface 422*d* of the first hole portion 422*a* and an upper surface 422*e* of the second hole portion 422*b*. The pushing surface 424*a* can be brought in contact with the contacting portion 422*c* by moving the receptacle 331 rearward after the engagement pin 421 is inserted into the insertion hole 422 (i.e., the first hole portion 422*a*).

The second hole portion 422*b* has a width in the machine width direction K2 that is larger than that of the first hole portion 422*a* in the machine width direction K2. Alternatively, the width of the second hole portion 422*b* in the machine width direction K2 may be the same as that of the first hole portion 422*a* in the machine width direction K2.

In this alternative embodiment, as shown in FIGS. 55 and 56, a fixing mechanism 426 is configured to press the engagement pin 421 against an inner surface of the insertion hole 422 so as to fix the receptacle 331 to the support base 325. The fixing mechanism 426 includes the contacting portion 422*c*, the pushing portion 424, and the locking tool 417.

Figure 59:
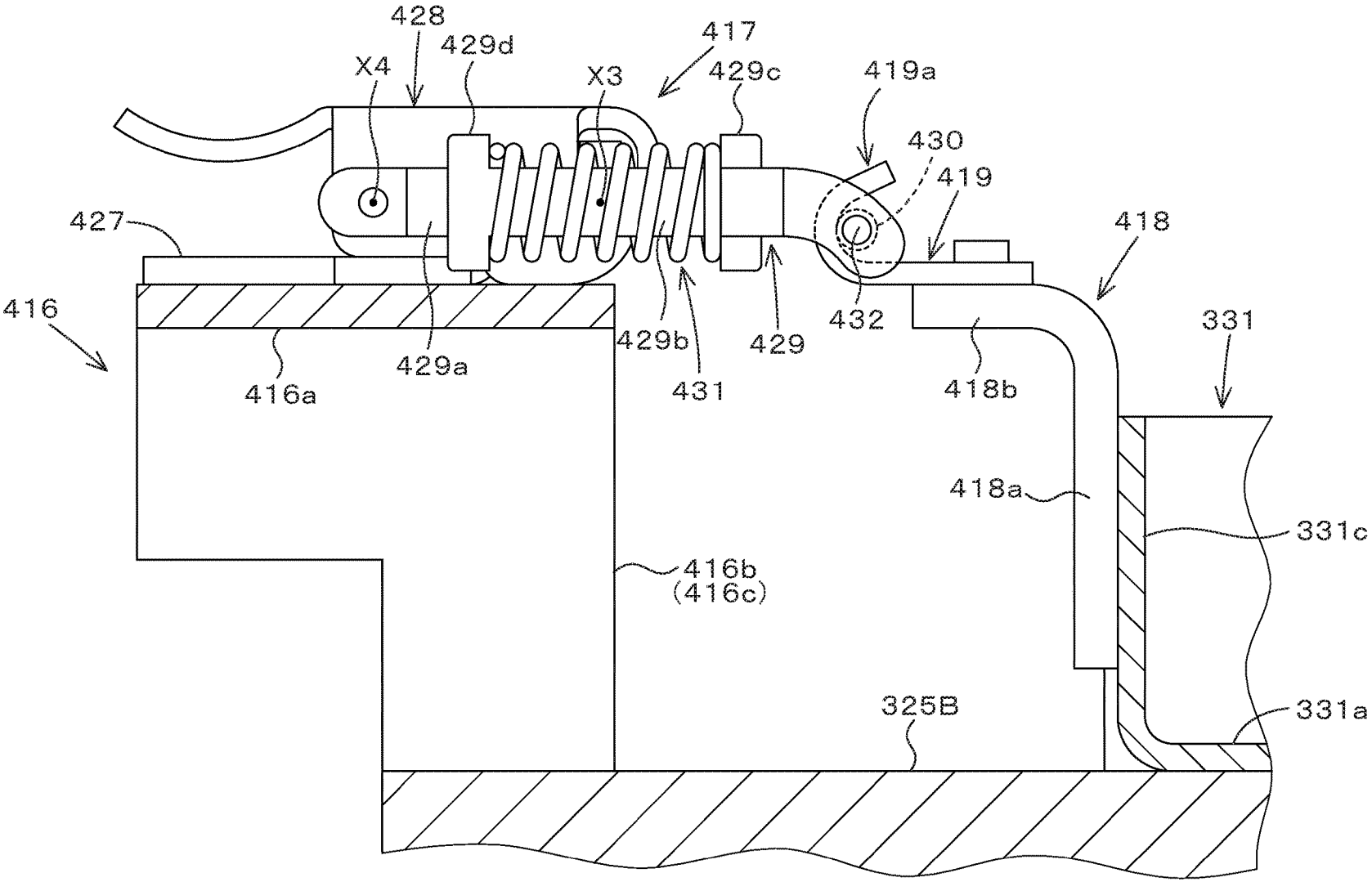
FIG. 59 is a side view of the fixing mechanism according to the alternative embodiment.
Figure 60:
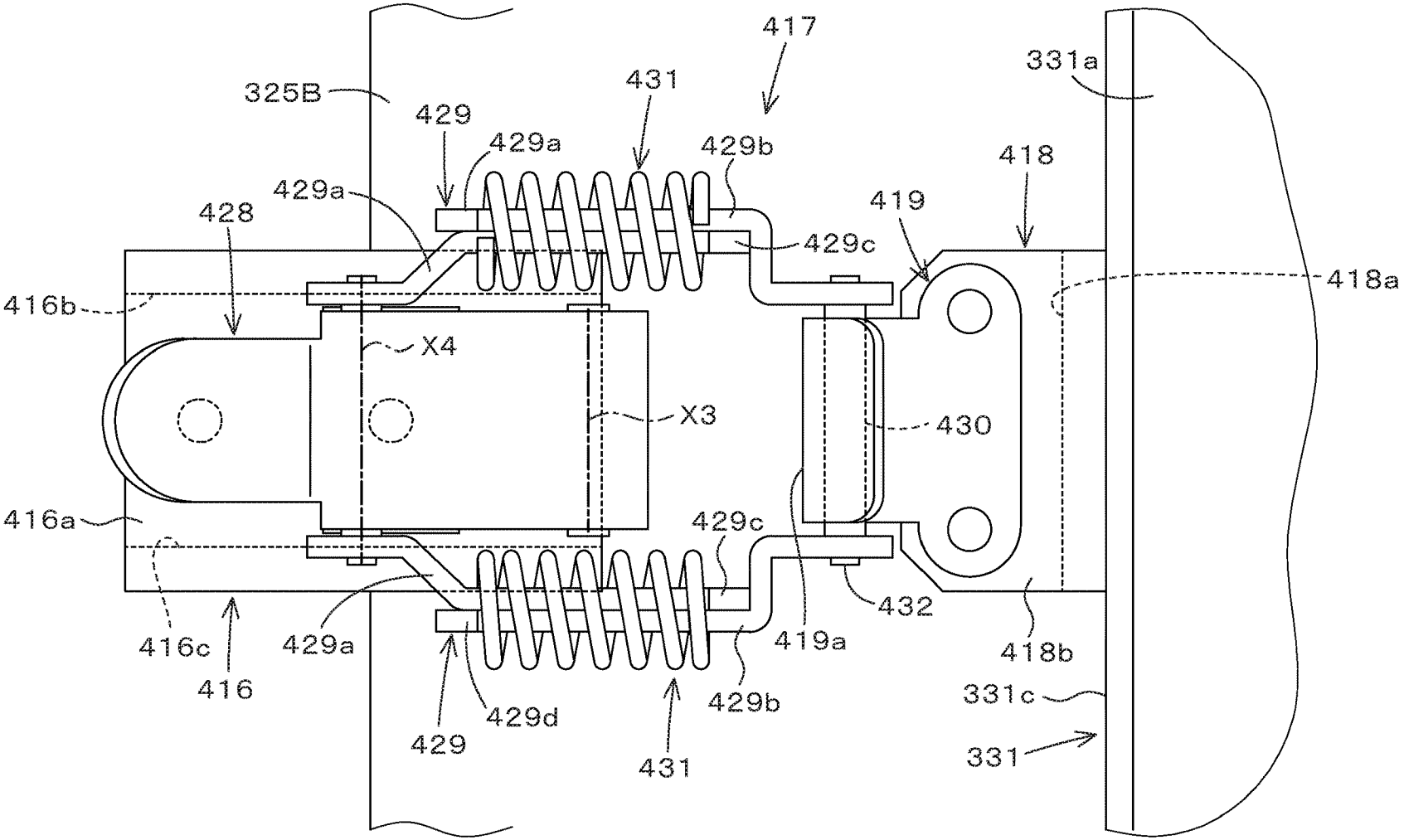
FIG. 60 is a plan view of the fixing mechanism according to the alternative embodiment.

As shown in FIGS. 59 and 60, the locking tool 417 is formed by a so-called draw latch. The locking tool 417 is located rearward from the attachment stay 418 and the hooking tool 419, and is attached to the attachment base 416. The locking tool 417 includes an attachment base 427, an operation body 428, left and right arm units 429, and a hooking pin 430.

The attachment base 417 is joined to the attachment base 416 (i.e., the upper wall portion 416*a*) with bolts or the like.

The operation body 428 is supported on the attachment base 417 rotatably around a first axis X3 extending in the machine width direction K2.

The left arm unit 429 is located on a left side of the operation body 428, and the right arm unit 429 is located on a right side of the operation body 428. Each arm unit 429 includes a first arm 429*a* on the machine inward directional side and a second arm 429*b* on the machine outward directional side. The first arm 429*a* includes a rear portion attached to the operation body 428 rotatably around a second axis X4 extending in the machine width direction K2. The second axis X4 is located behind the first axis X3. The first arm 429*a* includes a front portion defined as a spring retainer 429*c*. The second arm 428*b* includes a rear portion defined as a spring retainer 429*d*. A biasing member 431 is interposed between the spring retainer 429*c* and the spring retainer 429*d*. The biasing member 431 is formed of a coil spring, and is wound around mutually overlapping portions of the first arm 429*a* and the second arm 429*b*. A support shaft 432 is located between the front portions of the second arm 429*b* of the left arm unit 429 and the second arm 429*b* of the right arm unit 429.

The hooking pin 430 is formed to have a cylindrical shape, and is externally fitted on the support shaft 432.

The fixing mechanism 426 is configured to fix the receptacle 331 through an operation described below.

As shown in FIG. 57, the receptacle 331 is placed on the second plate 325B and the engagement pin 421 is inserted into the insertion hole 422. In this state, the operation body 428 is raised and the hooking pin 430 is hooked onto the hooking portion 419*a*. Then, when the operation body 428 is pivoted downward around the first axis X3, the receptacle 331 is pulled rearward, and the pushing portion 424 (i.e., the pushing surface 424*a*) is pressed against the contacting portion 422*c*. In this manner, the upward and horizontal movements of the receptacle 331 are restricted, and the receptacle 331 is fixed to the support base 325 without rattling.

In this alternative embodiment, the receptacle 331 is restricted by the oil filter 322 from being detached, and can be detached when the oil filter 322 is removed.

In addition, the upward movement of the receptacle 331 is restricted by the oil filter 322, and thereby the engagement pin 421 is restricted from being detached from the insertion hole 422.

Other configurations of the other embodiment are configured in the same manner as the configuration of the first embodiment.

The working machine 1 according to the embodiment provides the following effects.

The working machine 1 includes the machine body 2, the support bracket 20 protruding forward from the machine body 2, the swing bracket 21 pivotally supported by the support bracket 20 to be capable of horizontally pivoting, the working device 4 attached to the swing bracket 21, the swing sensor 261 configured to detect a position of the swing bracket 21, the controller U1 configured to acquire a detection signal from the swing sensor 261 and to control the pivotal movement of the swing bracket 21, and the regulator switch 281 connected to the controller U1. The controller U1 includes the memory unit 276 configured to store the arbitrary regulation position when the swing bracket 21 is stopped at the arbitrary regulation position and the regulator switch 281 is turned on, and the pivoting stopper unit 277 configured to stop the pivotal movement of the swing bracket 21 when the swing sensor 261 detects that the swing bracket 21 reaches the regulation position.

According to this configuration, the working device 4 can be prevented from interfering with the machine body 2 or the operator section or the like mounted on the machine body 2.

In addition, the controller U1 includes the memory release unit 284 to release the memory of the memory portion 276 when the regulator switch 281 is turned off or when a regulation release switch different from the regulator switch 281 is operated.

According to this configuration, the regulation position can be reset, for example, when the different working tool 24 is attached to the working device 4.

In addition, the working device sensor is provided to detect the state of the working device 4, the controller U1 is configured to obtain a detection signal from the working device sensor, and the memory unit 276 stores the regulation position of the swing bracket 21 defined when the working device 4 is in a predetermined state.

According to this configuration, the regulation position can be set in correspondence to the state of the working device 4.

In addition, the working device 4 includes the boom 22 supported by the swing bracket 21 pivotably in the vertical direction, the arm 23 pivotably supported by the boom 22 to pivot in directions toward and away from the boom 22, and the working tool 24 pivotably supported by the arm 23 to pivot in directions toward and away from the arm 23. The predetermined state of the working device 4 is the state in which the boom 22 reaches the uppermost pivotal movement position, the arm 23 reaches the pivotal movement position closest to the boom 22, and the working tool 24 reaches the pivotal movement position closest to the arm 23.

According to this configuration, the regulation position is set in the state where the working device 4 is highly likely to cause interference with the operator section 42, thereby preventing the interference of the working device 4 with the operator section 42.

In addition, the working machine 1 includes the operator section 42 having the operator seat 6 and the manipulation device 41 mounted on the machine body 2, and the regulation position can be set at a pivotal movement position of the swing bracket 21 closer to the operator section 42 than the center position where the boom 22 is oriented in the forward direction of the machine body 2.

According to this configuration, the working device 4 in the area where it is highly likely to interfere with the operator section 42 can be prevented from causing the interference.

In addition, any one selected from various working tools 24 of different sizes can be attached.

According to this configuration, the position at which the working tool 24 is stopped can be set in correspondence to the kind of working tool 24 to be attached, and even when any one is selected from the various types of working tool 24, the operator can carry out operations freely from the fear of the interference of the working tool 24 with the operator section 42.

In addition, the working machine 1 includes the operator section 42 having the operator seat 6 and the manipulation device 41 mounted on the machine body 2, and the boom sensor 263A configured to detect a pivoting angle of the boom 22. The controller U1 judges, based on the detection results of the swing sensor 261 and the boom sensor 263A, a position of the boom 22 during the pivotal movement of the swing bracket 21 with the boom 22 having been pivoted upward to a lateral side of the operator section 42, and stops the pivoting movement of the swing bracket 21 before reaching a position where the boom 22 comes to interfere with the operator section 42.

According to this configuration, the boom 22 can be prevented from interfering with the operator section 42.

In addition, the working machine 1 includes the operator section 42 having the operator seat 6 and the manipulation device 41 mounted on the machine body 2, and the boom sensor 263A configured to detect a pivoting angle of the boom 22. The controller U1 judges, based on the detection results of the swing sensor 261 and the boom sensor 263A, a position of the boom 22 when pivoted upward with the swing bracket 21 having been pivoted to a position more laterally distant from the operator section 42 than the center position where the boom 22 is orientated in the forward direction of the machine body, and the controller U1 stops the pivotal movement of the boom 22 before reaching a position where the boom 22 comes to interfere with the operator section 42.

According to this configuration, the boom 22 can be prevented from interfering with the operator section 42.

In addition, the working machine 1 includes the machine body 2, the support bracket 20 protruding forward from the machine body 2, the swing bracket 21 pivotably supported by the support bracket 20 to be capable of horizontally pivoting, the working device 4 attached to the swing bracket 21, the swing sensor 261 configured to detect a position of the swing bracket 21, the operator section 42 having the driver seat 6 and the steering device 41 mounted on the machine body 2, the boom sensor 263A configured to detect a pivoting angle of the boom 22, and the controller U1 configured to acquire the detection signals from the swing sensor 261 and the boom sensor 263A. The boom 22 can be pivoted upward to a lateral side of the operator section 42. The controller U1 judges, based on the detection results of the swing sensor 261 and boom sensor 263A, a position of the boom 22 during the pivotal movement of the swing bracket 21 with the boom 22 having been pivoted upward to the lateral side of the operator section 42, and the controller U1 stops the pivotal movement of the swing bracket 21 before reaching a position where the boom 22 comes to interfere with the operator section 42.

According to this configuration, the boom 22 can be prevented from interfering with the operator section 42.

In addition, the working machine 1 includes the machine body 2, the support bracket 20 protruding forward from the machine body 2, the swing bracket 21 pivotably supported by the support bracket 20 to be capable of horizontally pivoting, the working device 4 attached to the swing bracket 21, the swing sensor 261 configured to detect a position of the swing bracket 21, the operator section 42, having the driver seat 6 and the steering device 41, mounted on the machine body 2, the boom sensor 263A configured to detect a pivoting angle of the boom 22, and the controller U1 configured to acquire the detection signals from the swing sensor 261 and the boom sensor 263A. The boom 22 can be pivoted upward to a lateral side of the operator section 42. The controller U1 judges, based on the detection results of the swing sensor 261 and the boom sensor 263A, a position of the boom 22 when pivoted upward with the swing bracket 21 having been pivoted to a position more laterally distant from the operator section 42 than the center position where the boom 22 is orientated in the forward direction of the machine body, and the controller U1 stops the upward pivotal movement of the boom 22 before reaching a position where the boom 22 comes to interfere with the operator section 42.

According to this configuration, the boom 22 can be prevented from interfering with the operator section 42.

In addition, the working machine 1 includes the machine body 2, the support bracket 20 protruding forward from the machine body 2, the swing bracket 21 pivotably supported by the support bracket 20 to be capable of horizontally pivoting, the boom 22 pivotably supported by the swing bracket 21 to be capable of pivoting up and down, the swing sensor 261 configured to detect a position of the swing bracket 21, and the controller U1 configured to acquire the detection signal from the swing sensor 261 and to control the swinging movement defined as the pivotal movement of the swing bracket 21. The controller U1 includes the swinging stopper unit 279 configured to stop the swinging movement when the swing bracket 21 in the pivotal movement reaches the center position where the boom 22 is orientated in the forward direction of the machine body 2.

According to this configuration, the swinging movement is stopped when the swing bracket 21 is positioned at the center position, and the operator can recognize that the swing bracket 21 is positioned at the center position, thereby ensuring the positioning of the swing bracket 21 at the center position.

The swinging stopper unit 279 releases the stop of the swinging movement after passage of a predetermined time from the stop of the swinging movement.

According to this configuration, working can be continued when it is not necessary to stop the swing bracket 21 at the center position.

In addition, the working machine 1 includes the stopping release switch 282 connected to the controller U1. The controller U1 includes the stopping-function release unit 280 that is configured so that, according to operation of the stopping release switch 282, the stopping-function release unit 280 prevents the swinging stopper portion 279 from stopping the swinging movement.

According to this configuration, the working machine 1 can be used comfortably by an operator who does not require the center-stopping function of the swinging movement.

In addition, the working machine 1 includes the operator section 42, having the driver seat 6 and the steering device 41, mounted on the machine body 2, and the detection sensor 285 configured to detect a position of the boom 22 with respect to the operator section 42, and the controller U1 includes the boom stopper unit 278 configured to acquire a signal from the detection sensor 285, and stops the boom 22 before reaching a position where the boom 22 comes to interfere with the operator section 42.

According to this configuration, the boom 22 can be prevented from interfering with the operator section 42.

In addition, the working machine 1 includes the prime mover E1, the oil filter 322 attached to the prime mover E1, the support base 325 provided below the oil filter 322, and a receptacle 331 provided detachably on the support base 325. The receptacle 331 is configured to receive oil flowing down from the oil filter 322 when being detached, and is configured to retain the received oil.

According to this configuration, the oil flowing down from the oil filter 322 when being removed can be received and retained by the receptacle 331, and disposal of the retained oil can be achieved by detaching the receptacle 331 from the support base 325. Accordingly, the oil remaining in the receptacle 331 can be prevented from dripping off and contaminating the surroundings.

In addition, the oil filter 322 restricts the receptacle 331 from being detached from the support base 325, so that the receptable 331 is allowed to be detached when the oil filter 322 is detached.

According to this configuration, the receptacle 331 cannot be detached except when necessary, such as when replacing the oil filter 322, and the loss of the receptacle 331 can be prevented.

In addition, the receptacle 331 includes the engagement pins (first engagement pin 332A, second engagement pin 332B, engagement pin 421) that are inserted into the insertion holes (first insertion hole 333A, second insertion hole 333B, insertion hole 422) formed in the support base 325. The oil filter 322 restricts the upward movement of the receptacle 331 to restrict the detachment from the insertion holes.

According to this configuration, attachment, detachment, and prevention of detachment of the receptacle 331 can be performed with a simple configuration.

In addition, the working machine 1 includes the fixing mechanism 426 configured to fix the receptacle 331 to the support base 325 by pressing the engagement pin 421 against the contacting portion 422*c* formed on the inner surface of the insertion hole 422.

According to this configuration, the receptacle 331 is prevented from rattling due to vibrations of the machine body 2 or the like.

In addition, the fixing mechanism 426 includes the pressure portion 424 and the locking tool 417. The pressure portion 424 is provided on the engagement pin 421 and is configured to contact the contacting portion 422*c* with the engagement pin 421 inserted into the insertion hole 422. The locking tool 417 is operable to press the pressure portion 424 against the contacting portion 422*c*. The pressure portion 424 includes the pressure surface 424*a* to be pressed against the contacting portion 422*c*. The pressure surface 424*a* has an inclining shape shifting in the horizontal direction as extending upward.

According to this configuration, the upward movement and horizontal movement of the receptacle 331 can be restricted with a simple configuration.

In addition, the prime mover E1 includes the filter joint portion 323 to which the base portion 322*a* of the oil filter 322 is joined. The oil filter 322 includes a filter head portion 322*b* opposite to the base portion 322*a*, and the engagement pin is provided closer to the filter head portion 322*b* than the filter joint portion 323.

According to this configuration, the engagement pin and the insertion hole can be easily watched, and the receptacle 331 can be easily attached.

In addition, the working machine 1 includes the machine body 2 in which the prime mover E1 is mounted. The support base 325 is attached to the prime mover E1 and supported by the machine body 2 via the vibro-isolating mount member (the prime mover mount 324).

According to this configuration, the structure can be simplified through the dual use of the component.

In addition, the working machine 1 includes the machine body 2, the valve base 337 having the base plate 338 attached to the machine body 2, the control valve V1 attached to the valve base 337, the support frame (the rear support frame 147) provided on the machine body 2, the vertical plate 339 located above the base plate 338 in separation from the base plate 338, and the anti-sway member 352 connecting the upper portion of the vertical plate 339 to the support frame (the rear support frame 147). The control valve V1 is the composite control valve of the sectional type with the plurality of control valves coupled to one another and stacked one on another in the vertical direction. The lowermost section (the fourteenth section VS14) is placed on the base plate 338 and fixed to the base plate 338 with bolts, and the plurality of sections are fixed to the vertical plate 339 with bolts.

According to this configuration, the force acting on the control valve V1 acts on the base plate 338 through the lowermost section, so that a large load does not act on the vertical plate 339, and the valve base 337 can be made lighter. In addition, by fixing the plurality of sections to the vertical plate, the sections can be prevented from slipping against each other.

In addition, the lowermost section of the control valve V1 is fixed to the vertical plate 339 with bolts.

According to this configuration, the sections are more appropriately prevented from slipping against each other.

In addition, the working machine 1 includes the weight 10 attached to the machine body 2, and the support frame includes the upright frame 316 erected on the machine body 2, the connecting frame 317 connecting the upright frame 316 and the weight 10, and the protruding frame 318 protruding upward from the upright frame 316 to above the valve base 337. The anti-sway member 352 connects the protruding frame 318 to the vertical plate 339.

According to this configuration, the upper portion of the valve base 337 can be securely supported.

In addition, the vertical plate 339 includes the upper portion defined as the connecting plate 341, and the anti-sway member 352 includes the attachment stay 353 attached to the protruding frame 318, the retaining cylinder 354 fixed to the attachment stay 353, the anti-vibration bush 355 held in the retaining cylinder 354, and the attachment tool 359 configured to attach the anti-vibration bush 355 to the connecting plate 341.

According to this configuration, the valve base 337 is vibro-isolated with a simple configuration.

In addition, the connecting plate 341 includes the engagement portion (the first engagement portion 342A, the second engagement portion 342B) to engage the suspension tool 359 for suspending the valve base 337.

According to this configuration, the structure is simplified through the dual use of the component.

In addition, the working machine 1 includes the valve receiving base 319 fixed to the machine body 2, and the valve mounts (the first to fourth valve mounts 336A to 336D) to vibro-isolatedly support the base plate 338 on the valve receiving base 319.

According to this configuration, the vibration of the control valve V1 can be effectively suppressed.

In addition, the working machine 1 includes the operator seat 6, the manipulation device 41 located in front of the operator seat 6, the front window 5C located in front of the manipulation device 41, the air-conditioner body 63 located below the operator seat 6, and the duct structure body 296 extending forward from the air-conditioner body 63 and upward in the space between the manipulation device 41 and the front window 5C.

According to this configuration, the duct structure body 296, which distributes the air-conditioned air blown from the air-conditioner body 63, extends upward in the space between the manipulation device 41 and the front window 5C, so that the duct structure body 296 can be brought closer to the front window 5C, and the visibility of the front window 5C can be secured quickly during demisting and defrosting. In addition, by extending the duct structure body 296 forward, and extending the duct structure body 296 upward in the space between the steering device 41 and the front window 5C, the portion of the duct structure body 296 between the manipulation device 41 and the front window 5C can be shortened, and accordingly the airflow reduction can be suppressed.

In addition, the duct structure body 296 branches off on the rear side of the manipulation device 41, and the branches of the duct structure body 296 pass through the left and right sides of the manipulation device 41, and join together on the front side of the steering device 41.

According to this configuration, above the floor portion 5B, the duct structure body 296 can be extended bypassing the manipulation device 41 with a small length from the air conditioner body 63 until it reaches the position between the manipulation device 41 and the front window 5C.

In addition, the working machine 1 includes the operator section 42 in which the operator seat 6, the manipulation device 41, and the air-conditioner body 63 is installed. The duct structure body 296 includes the first duct 406 connected to the blowing outlet 63*a* of the air-conditioner body 63, the second duct 407 connected to the first duct 406 and located above the floor portion 5B of the operator section 42 to extend forward, and the third duct 408 provided between the steering device 41 and the front window 5C and connected to the second duct 407. The second duct 407 includes the first branching portion 407*b* that passes through the left side of the steering device 41 and is connected to the third duct 408, and the second branching portion 407*c* that passes through the right side of the steering device 41 and is connected to the third duct 408.

According to this configuration, the second duct 407 can be easily assembled with the manipulation device 41 stood on the floor portion 5B.

In addition, the first branching portion 407*b* and the second branching portion 407*c* extend upward on the front side of the manipulation device 41, and the third duct 408 includes the first connecting portion 408*e* connected to the first branching portion 407*b*, and the second connecting portion 408*f* connected to the second branching portion 407*c*.

According to this configuration, the third duct 408 can be easily assembled with the manipulation device 41 stood on the floor portion 5B.

In addition, the first duct 406 includes the connection port 409 connected to the blowing outlet 63*a* of the air-conditioner body 63, the main duct portion 410 that extends forward from the connection port 409 and is connected to the second duct 407, and the side duct portion 411 that branches off from the connection port 409 to extend rearward and blows the air-conditioned air to the side of the driver seat 6.

According to this configuration, the side duct portion 411, which blows the air-conditioned air to the side of the driver seat 6, can be arranged in a short path from the blowing outlet 63*a* of the air conditioner body 63.

In addition, the working machine 1 includes the driver seat 6, the manipulation device 41, and the operator section 42 in which the air-conditioner body 63 is installed, and the duct structure body 296 includes the first duct 297 connected to the blowing outlet 63*a* of the air-conditioner body 63, the second duct 298 located below the floor portion 5B of the operator section 42 and connected to the first duct 297 to extend forward, the third duct 299 provided between the manipulation device 41 and the front window 5C and connected to the second duct 298.

According to this configuration, the cabin space around the operator seat 6 can be widened by arranging the duct structure body 296 under the floor portion 5B.

In addition, the second duct 298 may have a rectangular cross-section shape perpendicular to the extending direction, such that the length of the rectangular shape in the direction along the floor portion 5B is longer than the length thereof in the direction perpendicular to the floor portion 5B.

According to the above configuration, even when the second duct 298 is located in a limited space below the floor portion 5B, the flow path area of the second duct 298 can be sufficiently large, so that the flow path resistance of the air-conditioned air can be reduced and the air volume can be increased.

In addition, the third ducts 299 and 408 includes the first blower portions 299*g* and 408*a* located at the upper ends thereof and configured to blow the air-conditioned air toward the front window 5C. Each of the first blower portions 299*g* and 408*a* includes the lateral width in the width direction of the machine body 2 being substantially constant from the upper portion to the lower portion, and the longitudinal width of the upper portion in the fore-and aft direction of the machine body 2 being narrower than that of the lower portion.

According to this configuration, the flow speed of the air-conditioned air blown out from the first blowing portions 299*g* and 408*a* can be prevented from being reduced.

In addition, the duct structure body 296 includes the fourth duct 313 branched from the third duct 299, and the second blower portion 314 configured to blow out, toward the operator seat 6 side, the air-conditioned air distributed through the fourth duct 313.

According to this configuration, the air-conditioned air can be supplied to the operator seat 6 side.

In addition, the second blower portion 314 is connected to the fourth duct 313 with the telescopic tube 315.

According to this configuration, the second blower portion 314 can be brought closer to the operator.

In addition, the second blower portion 314 is detachable from the fourth duct 313.

According to this configuration, the second blower portion 314 can be selectively located at either the position attached to the fourth duct 313 or the position close to the operator 295 according to the requirement, which provides significant convenience.

In addition, the telescopic tube 315 can be curved, and the orientation of the second blower portion 314 can be set as desired by curving the telescopic tube 315.

According to this configuration, the position and orientation of the second blower portion 314 can be changed as desired. This allows the operator 295 to apply the air-conditioned air to the desired portion.

In addition, the working machine 1 includes the operator seat 6 mounted on the machine body 2, the manipulation device 41 that is located in the vicinity of the operator seat 6 and stands on the machine body 2, and the working device 4 located at the front portion of the machine body 2. The manipulation device 41 includes the manipulator 82 to operate the working device 4, the attachment base 93 on which the manipulator 82 is attached, and the elevation device 86 configured to support the attachment base 93 to be capable of adjusting the vertical position of the attachment base 93.

According to this configuration, the height of the manipulator 82 can be adjusted in accordance with the height of the operator or the like.

In addition, the elevation device 86 includes the support pipe 288 erected on the machine body 2, the elevation cylinder 376 inserted into the support pipe 288 to be capable of being lifted and lowered and provided with the attachment base 93, the gas spring 378 to bias the elevation cylinder 376 upward, and the position adjuster unit 383 configured to adjust the vertical position of the elevation cylinder 376 relative to the support pipe 288.

According to this configuration, the height position of the attachment base 93 can be easily adjusted with use of the biasing force of the gas spring 378.

In addition, the harness 382 that is connected to a device attached to the attachment base 93 is arranged in the elevation cylinder 376.

According to this configuration, the arrangement path of the harness 382 can be easily secured, and the harness 382 can be protected.

In addition, the gas spring 378 is located inside the elevation cylinder 376 at a position deviated from the center C1 of the elevation cylinder 376.

According to this configuration, the space inside the elevation cylinder 376 can be effectively utilized. For example, in arranging the harness 382 inside the elevation cylinder 376, the space for arranging the harness 382 can be easily secured, and the harness 382 can be prevented from being in contact with the gas spring 378.

In addition, the position adjuster unit 383 includes a plurality of lock holes 384 formed on the elevation cylinder 376 and arranged with at least one interval therebetween in the vertical direction, and the lock pin 385 provided in the support pipe 288 and configured to be inserted selectively into any one of the plurality of lock holes 384.

According to this configuration, the position adjuster portion 383 can be easily configured.

In addition, the elevation device 86 includes the vertical movement limiter 397 configured to define the extension limit and the contraction limit of the gas spring 378, and the vertical movement limiter 397 includes the long hole 398 elongated in the vertical direction and formed in one of the support pipe 288 and the elevation cylinder 376, and the regulation member 399 inserted through the long hole 398 and attached to the other one of the support pipe 288 and the elevation cylinder 376.

According to this configuration, over-extending and over-contracting of the gas spring 378 is prevented, and the vertical position of the attachment base 93 can be easily adjusted.

The elevation device 86 includes the slit 362 formed to extend downward from the upper end of the support pipe 288, the first member 363 fixed to the support pipe 288 on one side of the slit 362 in the width direction, the second member 364 fixed to the support pipe 288 on the other side of the slit 362 in the width direction, and the fixing tool 365 configured to bring the first member 363 and the second member 364 into proximity.

According to this configuration, the elevation cylinder 376 can be fixed to the support pipe 288, and accordingly the rattling of the elevation cylinder 376 can be prevented.

In addition, the elevation device 86 includes the gas cylinder 287 including the cylinder tube 287A extend in the vertical direction and the piston rod 287B vertically movably supported by the cylinder tube 287A. The piston rod 287B is connected to the attachment base 93 and is biased upward by the gas enclosed in the cylinder tube 287A, and is capable of stopping at any position with respect to the cylinder tube 287A.

According to this configuration, the height of the manipulator 82 can be adjusted with a simple configuration.

In addition, the elevation device 86 includes the support pipe 288 erected on the machine body 2 and supporting the cylinder tube 287A, the guide member 289B attached to the support pipe 288, and the slide member 289A attached to the attachment base 93 and guided up and down by the guide member 289B.

According to this configuration, the attachment base 93 can be prevented from turning.

In addition, the gas cylinder 287 includes the head member 287C provided on the tip end side of the piston rod 287B and attached to the attachment base 93, and the lock release lever 287D to release the stopping of the piston rod 287B with respect to the cylinder tube 287A. The lock release lever 287D extends from the head member 287C toward the operator seat 6.

According to this configuration, the height of the manipulator 82 can be easily adjusted from the operator seat 6.

In addition, the manipulation device 41 is located in front of the operator seat 6 and includes the armrest member 83, the manipulator 82 includes the first manipulator handle 82L and the second manipulator handle 82R located on the side of the first manipulator handle 82L, and the armrest member 83 includes the first armrest 83L extending rearward from the rear side of the first manipulator handle 82L and the second armrest 83R extending rearward from the rear side of the second manipulator handle 82R.

According to this configuration, the height of the armrest member 83 can be adjusted at the same time along with the height adjustment of the manipulator 82.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A working machine comprising:

a machine body;

a support bracket protruding forward from the machine body;

a swing bracket pivotally supported by the support bracket to be capable of horizontally pivoting;

a boom pivotally supported by the swing bracket to be capable of pivoting up and down;

a swing sensor configured to detect a position of the swing bracket; and a controller configured to acquire a detection signal from the swing sensor and to control a swinging movement defined as the pivotal movement of the swing bracket, wherein the controller includes a swinging stopper unit configured to stop the swinging movement and cause a temporary suspension of the swinging movement when the swing bracket in the pivotal movement reaches a center position as a position of the swing bracket at which the boom is orientated in a forward direction of the machine body; and the swinging stopper unit automatically releases the temporary suspension of the swinging movement after a predetermined period of time elapses after stopping the swinging movement.

2. The working machine according to claim 1, further comprising:

a swing operation tool operably connected to the controller so that the controller causes the swing bracket to perform the swinging movement according to operation of the swing operation tool, wherein after the swinging movement is stopped to enter into the temporary suspension at the center position, the swinging movement according to the operation of the swing operation tool is resumed if the operation of the swing operation tool is continued with the elapse of the predetermined period of time after stopping the swinging movement.

3. The working machine according to claim 1, further comprising:

a stopping release switch connected to the controller, wherein the controller includes a stopping-function release unit configured to selectively make either a state in which, according to operation of the stopping release switch, the stopping-function release unit prevents the swinging stopper unit from stopping the swinging movement and causing the temporary suspension of the swinging movement or another state in which the swinging stopper unit is allowed to stop the swinging movement and cause the temporary suspension of the swinging movement.

4. The working machine according to claim 1, further comprising:

an operator section including:

an operator seat and a manipulation device mounted on the machine body; and a detection sensor to detect a position of the boom with respect to the operator section, wherein the controller includes a boom stopper unit configured to acquire a signal from the detection sensor and to stop the boom before reaching a position where the boom comes to interfere with the operator section.

* * * * *